US007057490B2

(12) United States Patent
Hashimoto et al.

(10) Patent No.: US 7,057,490 B2
(45) Date of Patent: Jun. 6, 2006

(54) RESISTOR AND PRODUCTION METHOD THEREFOR

(75) Inventors: Masato Hashimoto, Fukui (JP); Akio Fukuoka, Fukui (JP); Toshiki Matsukawa, Fukui (JP); Hiroyuki Saikawa, Fukui (JP); Tsutomu Nakanishi, Osaka (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 2 days.

(21) Appl. No.: 10/362,709

(22) PCT Filed: Aug. 30, 2001

(86) PCT No.: PCT/JP01/07499

§ 371 (c)(1),
(2), (4) Date: Aug. 5, 2003

(87) PCT Pub. No.: WO02/19347

PCT Pub. Date: Mar. 7, 2002

(65) Prior Publication Data

US 2004/0027234 A1 Feb. 12, 2004

(30) Foreign Application Priority Data

Aug. 30, 2000 (JP) ..... 2000-260401
Aug. 30, 2000 (JP) ..... 2000-260402
Sep. 29, 2000 (JP) ..... 2000-300075

(51) Int. Cl.
*H01C 1/012* (2006.01)

(52) U.S. Cl. ..... 338/309; 338/314

(58) Field of Classification Search ..... 338/309, 338/313, 314, 332

See application file for complete search history.

(56) References Cited

U.S. PATENT DOCUMENTS 4,792,781 A * 12/1988 Takahashi et al. ..... 338/307
5,815,065 A * 9/1998 Hanamura ..... 338/309
5,944,996 A * 8/1999 DeSimone et al. ..... 210/634
5,952,911 A * 9/1999 Kawase et al. ..... 338/22 R
6,150,920 A * 11/2000 Hashimoto et al. ..... 338/309

(Continued)

FOREIGN PATENT DOCUMENTS

JP 7-312302 11/1995
JP 8-64460 3/1996

OTHER PUBLICATIONS

International Search Report corresponding to application No. PCT/JP01/07499 dated Dec. 4, 2001.
Englisht translation of Form PCT/ISA/210, (Dec. 4, 2001).

*Primary Examiner*—Tu Hoang
(74) *Attorney, Agent, or Firm*—RatnerPrestia

(57) ABSTRACT

A resistor having reliability in electrical connection between an upper surface electrode and a side face electrode, and in bonding strength between a first thin film and a second thin film is provided. The resistor includes upper surface electrodes formed on a main surface a substrate and side face electrodes disposed to side faces of the substrate and connected electrically to the pair of upper surface electrodes, respectively. The upper surface electrode includes a first upper surface electrode layer and a bonding layer overlying the first upper surface electrode layer. The side face electrode includes a first thin film disposed to a side face of the substrate, a second thin film composed of copper-base alloy film and connected electrically to the first thin film, a first plating film formed by nickel plating for covering the second thin film, and a second plating film covering the first plating film.

13 Claims, 70 Drawing Sheets

U.S. PATENT DOCUMENTS 6,153,256 A * 11/2000 Kambara et al. ..... 427/103
6,314,637 B1 * 11/2001 Kimura et al. ..... 29/620
6,636,143 B1 * 10/2003 Hashimoto et al. ..... 338/309
2001/0000215 A1 * 4/2001 Oh ..... 338/306

* cited by examiner

RESISTOR AND PRODUCTION METHOD THEREFOR

This application is a U.S. national phase application of PCT international application PCT/JP01/07499.

FIELD OF THE INVENTION

The present invention relates to a resistor and a method of manufacturing the resistor, particularly to a microchip resistor and a method of the resistor.

BACKGROUND OF THE INVENTION

A conventional resistor includes a side face electrode of four-layer structure, which is disclosed in Japanese Patent Laid-Open Publication No.03-80501.

As shown in FIG. 70, the resistor includes resistor layer 3 and a pair of squared-U-shaped edge electrodes 4. Resistor layer 3 bridges a pair of upper surface electrode films 2 disposed at respective ends on an upper surface of substrate 1, and is disposed slightly inward from side faces of substrate 1. The squared-U-shaped side face electrodes 4 are provided over respective side faces of substrate 1 and electrically connected with the pair of upper surface electrode films 2. Each of the side face electrodes 4 has a four-layer structure in including squared-U-shaped first metal film 5, second metal film 6, first metal plating film 7, and second metal plating film 8. Squared-U-shaped first metal film 5 is formed of one of a thin nickel-chromium film, thin titanium film, and thin chromium film as the lowermost layer, and is electrically connected to corresponding one of the upper surface electrode films 2. Second metal film 6 is formed of a thin copper film of low resistance overlying first metal film 5. First metal plating film 7 is formed of a nickel plated film overlying second metal film 6. Second metal plating film 8 is formed of one of a lead-tin plated film and a tin plated film overlying the first metal plating film 7.

The conventional resistor, since including second metal film 6 in the side face electrode 4 composed of a thin copper film of low resistance, has the first metal film 5 and the second metal film 6 do not transform easily into solid solution in their interface if this resistor is left in high humidity. Therefore, when moisture or the like is adsorbed in an interface between the thin copper film, i.e., the second metal film 6, and the lower layer of first metal film 5, the second metal film 6 be liable to exfoliate easily from the first metal film 5

SUMMARY OF THE INVENTION

A resistor includes a substrate, a pair of upper surface electrodes formed on one of surfaces of the substrate, a resistor element electrically connected with the upper surface electrodes, a protective layer covering at least the resistor element, a pair of side-face electrodes provided on side faces of the substrate and electrically connected to the upper surface electrodes, respectively. Each of the upper surface electrodes includes a first upper surface electrode layer and a bonding layer disposed on a top of the first upper surface electrode layer. Each of the side face electrodes has a multi-layered structure including a first thin film, a second thin film, a first plating film, and a second plating film covering at least the first plating film. The first thin film is formed of one of a thin chromium film, thin titanium film, thin chromium-base alloy film, and thin titanium-base alloy film, all having a large bonding property to the substrate and is disposed to a side face of the substrate. The second thin film is formed of thin copper alloy film and is electrically connected to the first thin film. The first plating is film formed by nickel plating and covers at least the second thin film.

The resistor includes the pair of side face electrodes provided on the side faces of the substrate and electrically connected to the pair of upper surface electrodes formed of thin films. The pair of upper surface electrodes includes the first upper surface electrode layers and the bonding layers laid on top of the first upper surface electrode layers. This structure can increase contact areas between the pair of side face electrodes and the pair of upper surface electrodes, and thereby improves reliability of electrical connections between the upper surface electrodes and the side face electrodes. In addition, the side face electrodes includes the second thin films which are electrically connected with the first thin films and are formed of thin copper alloy films, admixing metal that composes the thin copper alloy films produces complete solid solution with component metal of the first thin films at the interfaces between the first thin films and the second thin films. This increases bonding strength between the first thin films and the second thin films, thereby resulting in improvement of reliability.

BRIEF DESCRIPTION OF THE DRAWINGS

FIGS. 62A through 62C are plan views of the resistor for showing the manufacturing processes.

DESCRIPTION OF THE PREFERRED EMBODIMENTS

First Exemplary Embodiment

A resistor and a method of manufacturing the resistor according to a first exemplary embodiment of the invention will be described hereinafter with reference to accompanying drawings.

Figure 1:
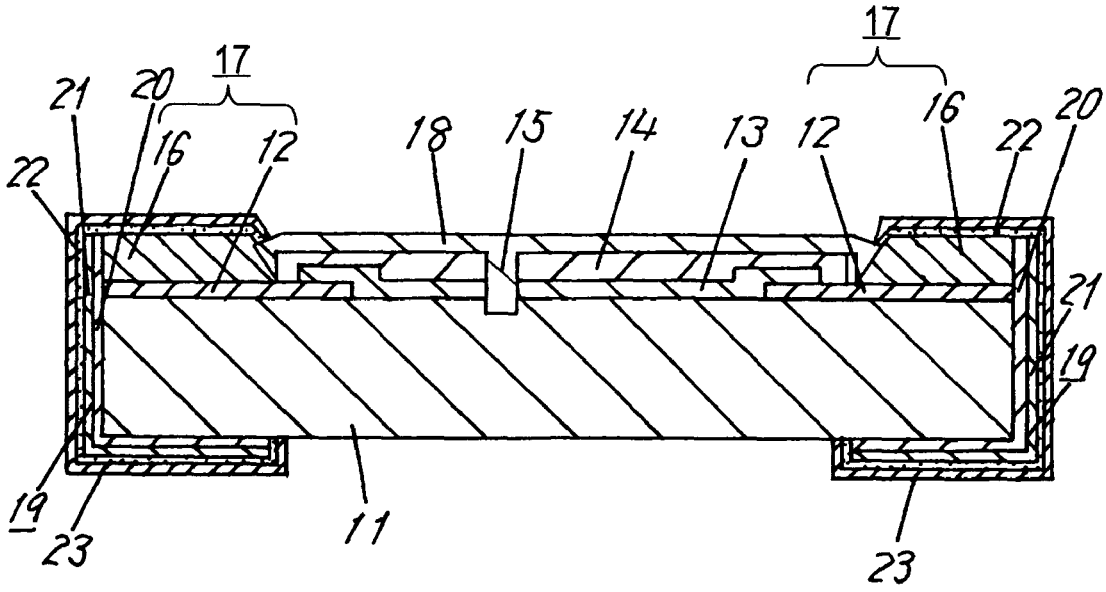
FIG. 1 is a sectional view of a resistor according to a first exemplary embodiment of the present invention.

FIG. 1 is a sectional view of the resistor according to the first embodiment of the invention. In FIG. 1, reference numeral 11 denotes a segment substrate divided along slit-like first separations and second separations intersecting at right angles with the first separations from a sheet-form substrate made of sintered 96% alumina. Reference numeral 12 denotes a pair of first upper surface electrode layers including mainly silver and formed on one of main (upper) surfaces of substrate 11. Reference numeral 13 denotes a resistor element formed of ruthenium oxide-base material on the upper surface of substrate 11 in such manner that parts of the element 13 overlap with the pair of first upper surface electrode layers 12, and thus being electrically connected to the layers 12. Reference numeral 14 denotes a first protective layer including mainly glass and formed on an upper surface of the resistor element 13. Reference numeral 15 denotes a trimming slit provided to adjust a resistance of resistor element 13 between the pair of first upper surface electrode layers 12. Reference numeral 16 denotes a pair of bonding layers made of silver-based conductive resin formed in a manner that each of them overlaps a part of the respective one of the pair of first upper surface electrode layers 12, and that the pair of bonding layers 16 together with the pair of first upper surface electrode layers 12 constitute a pair of upper surface electrodes 17. The first upper surface electrode layers 12 and the bonding layers 16 are flush with side faces of the substrate 11. In addition, the bonding layers 16 have their maximum height in their thickness direction is greater than those of the first upper surface electrode layers 12. Reference numeral 18 denotes a second protective layer including mainly resin and covering the first protective layer 14 consisting mainly of glass overlap partially the bonding layers 16. Reference numeral 19 denotes a pair of side face electrodes provided on the side faces of the substrate 11 to maintain electrical connection with the pair of upper surface electrodes 17. The pair of side face electrodes 19 have multi-layered structure including first thin film 20, second thin film 21, first plating film 22, and second plating film 23. The first thin film 20 formed substantially in an L-shape over the respective side face of the substrate 11 at a position abutting on a side face of the substrate 11, a side edge of the first upper surface electrode layer 12 as well as a side edge of the bonding layer 16, and to cover an end portion on a back surface of the substrate 11. The second thin film 21 having substantially in an L-shape formed to overlie the first thin film 20 and in electrical connection with the first thin film 20. First plating film 22 formed of nickel plating substantially in a squared-U-shape covers the second thin film 21 as well as an exposed surface of the bonding layer 16. Second plating film 23 formed by tin plating having substantially in a squared-U-shape covers the first plating film 22.

In the above-described structure, the pair of upper surface electrodes 17 includes first upper surface electrode layers 12 and bonding layers 16 overlapping the first upper surface electrode layers 12. They can therefore increase connecting areas between the pair of side face electrodes 19 and the pair of upper surface electrodes 17, so as to improve reliability of the electrical connections between the upper surface electrodes 17 and the side face electrodes 19.

Moreover, the first upper surface electrode layers 12 and the bonding layers 16 constituting the upper surface electrodes 17 are flush with the side faces of substrate 11. As a result, the side face electrodes 19 formed of thin film, which are provided over the side faces of the substrate 11 and are connected electrically to the upper surface electrodes 17, can be formed steadily and continuously from the side faces of the substrate 11 and the side edges of the first upper surface electrode layers 12 and the bonding layers 16 adjoining the side faces of substrate 11.

Furthermore, the electrical connections of the upper surface electrodes 17 to the resistor element 13 are made only with the first upper surface electrode layers 12 out of the first upper surface electrode layers 12 and the bonding layers 16 that form the upper surface electrodes 17. This structure does not cause any change in resistance even after the bonding layers 16 are subsequently formed. As a result, it can maintain good ohmic contacts, thereby achieving a highly reliable resistor with no change in its resistance after the resistance is adjusted.

Also, out of the first upper surface electrode layers 12 and the bonding layers 16 that form the upper surface electrodes 17, the bonding layers 16 have the maximum height in their thickness direction is greater than that of the first upper surface electrode layers 12. Therefore, the bonding layers 16 can increase connecting areas between the upper surface electrodes 17 and the side face electrodes 19 formed of thin film, which are provided over the side faces of substrate 11 and are connected electrically to the upper surface electrodes 17. As a result, this structure can improve reliability of the electrical connections between the upper surface electrodes 17 and the side face electrodes 19.

Moreover, the first thin films 20 and the second thin films 21 forming the side face electrodes 19 formed substantially in an L-shape over the back surface and the side faces of the substrate 11. This arrangement enables to form the first thin films 20 and the second thin films 21 only from one side of the surfaces, i.e. the back side, of the substrate 11 if they are formed with the film-forming technique, which improves productivity.

Furthermore, according to the first embodiment of the invention, as described above, the first upper surface electrode layers 12 forming the upper surface electrodes 17, in particular, are formed of silver-base material, and the bonding layers 16 are formed of silver-base conductive resin. Processing temperatures of approximately 850° C. and 200° C. are required for the first upper surface electrode layers 12 and the bonding layers 16, respectively, which prevents the resistance from shifting once it is adjusted.

Referring to the accompanying drawings, description will be provided for a method of manufacturing the resistor constructed as described above according to the first embodiment of the invention.

Figure 2:
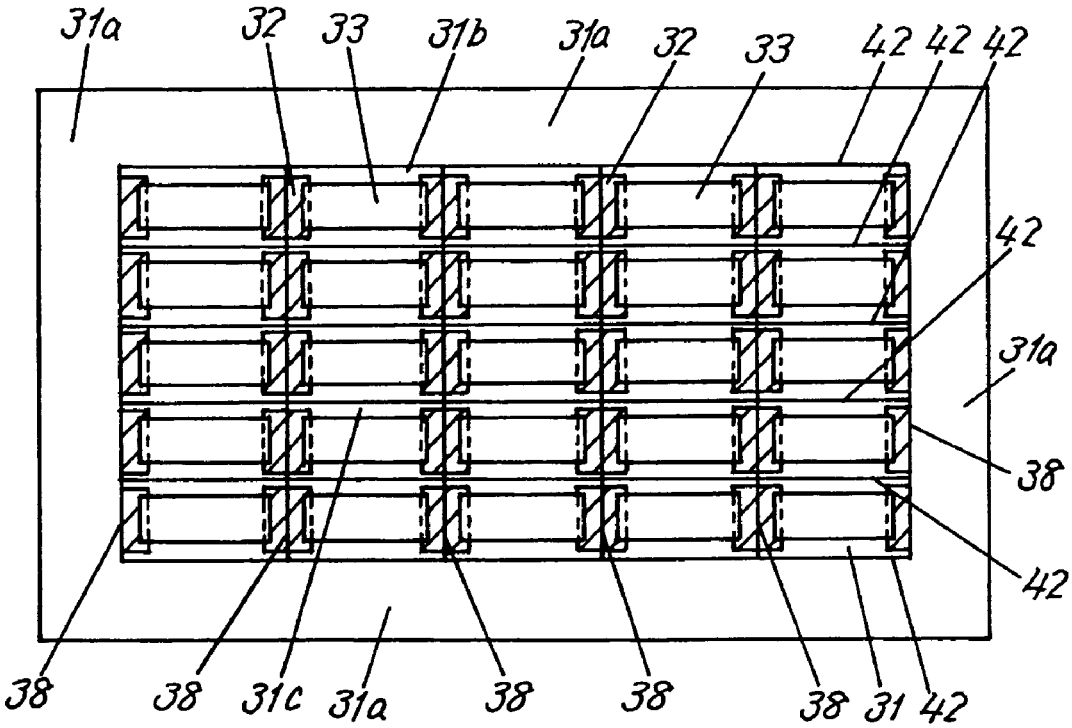
FIG. 2 is a plan view showing a sheet-form substrate for use in manufacturing the resistor, in which a void area is formed in the entire peripheral margin of the substrate.

FIG. 2 is a plan view of a sheet-form substrate for use in manufacturing the resistor of the first exemplary embodiment of the invention, in which a void area is formed in the entire peripheral margin of the substrate, and FIGS. 3A through 3C, 4A through 4C, 5A, 5B, 6A, 6B, 7A through 7C, 8A through 8C, 9A through 9C, 10A through 10C, 11A, 11B, 12A and 12B are schematic views of sequential processes illustrating the method of manufacturing the resistor according to the first exemplary embodiment of the invention.

Figure 3A:
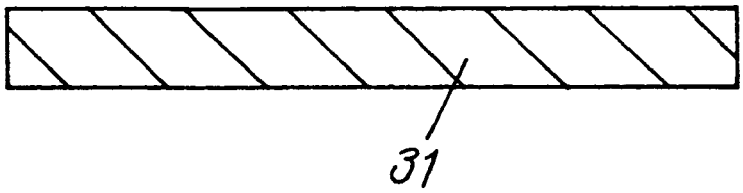
FIGS. 3A through 3C are sectional views of the resistor for showing processes of manufacturing the resistor.
Figure 4A:
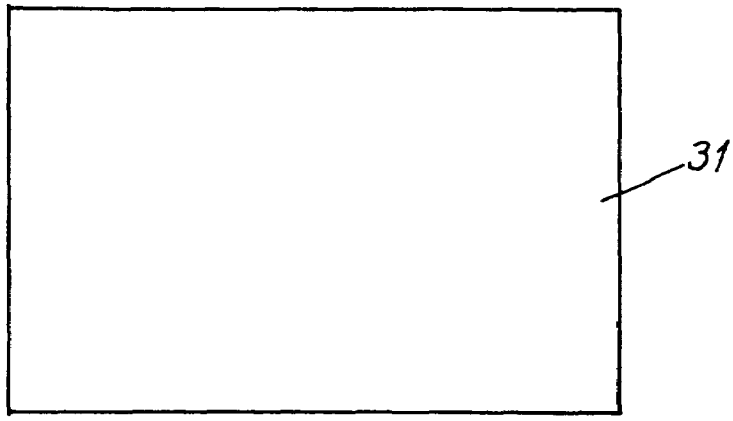
FIGS. 4A through 4C are plan views of the resistor for showing the manufacturing processes.

First, sheet-form substrate 31 of 0.2 mm thick made of sintered 96% alumina having insulating property is prepared, as shown in FIGS. 2, 3A and 4A. In this embodiment, the sheet-form substrate 31 includes void area 31*a* around the entire peripheral margin, as shown in FIG. 2, which does not yield any product in the end. Void area 31*a* is formed substantially in a square shape.

Figure 3B:
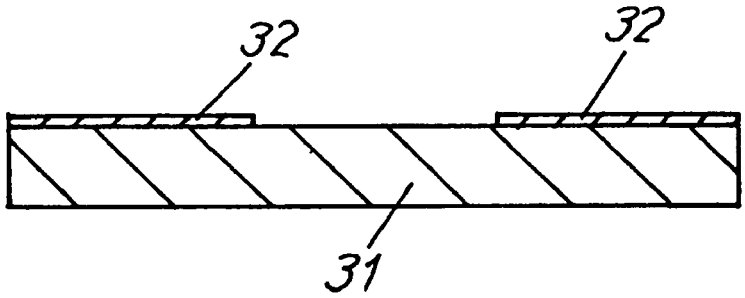
Figure 4B:
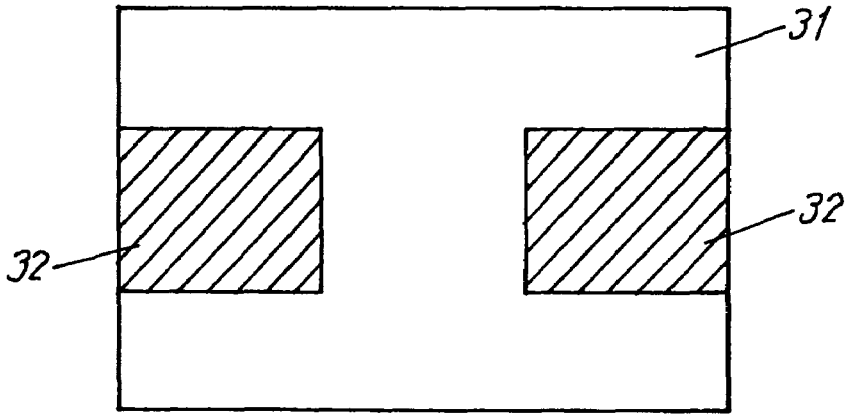

Next, as shown in FIGS. 2, 3B and 4B, plural pairs of first upper surface electrode layers 32 containing mainly silver on an upper surface of the sheet-form substrate 31 by screen printing method are formed. Then, first upper surface electrode layers 32 are made stable films by being sintered according to a sintering profile of 850° C. as a peak temperature.

Figure 3C:
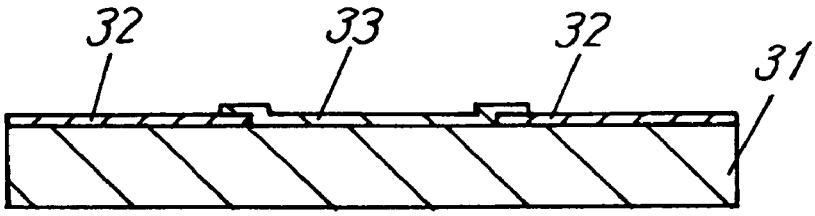
Figure 4C:
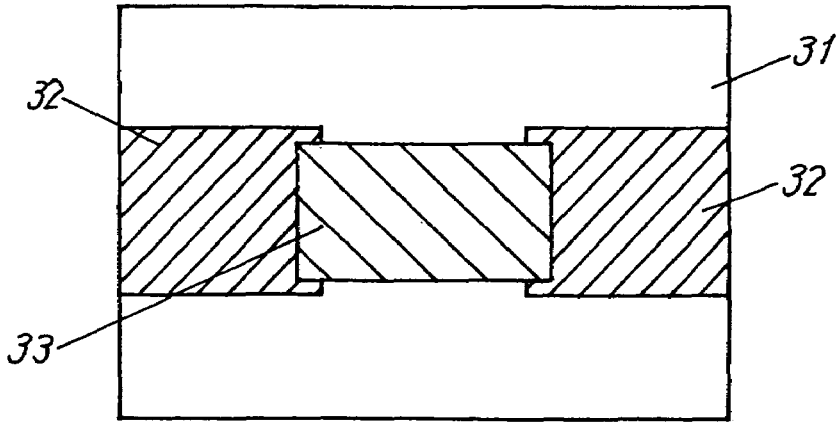

Then, plural resistor elements 33 composed of ruthenium oxide-base material are formed by screen printing method in such positions that each of them bridges each of the plural pairs of upper surface electrode layers 32, as shown in FIGS. 2, 3C and 4C. Then, resistor elements 33 are made stable films by being sintered according to a sintering profile of 850° C. as a peak temperature.

Figure 5A:
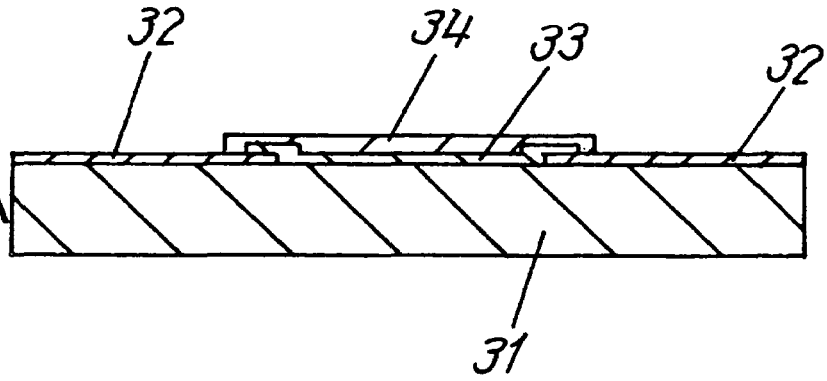
FIGS. 5A and 5B are sectional views of the resistor for showing the manufacturing processes.
Figure 6A:
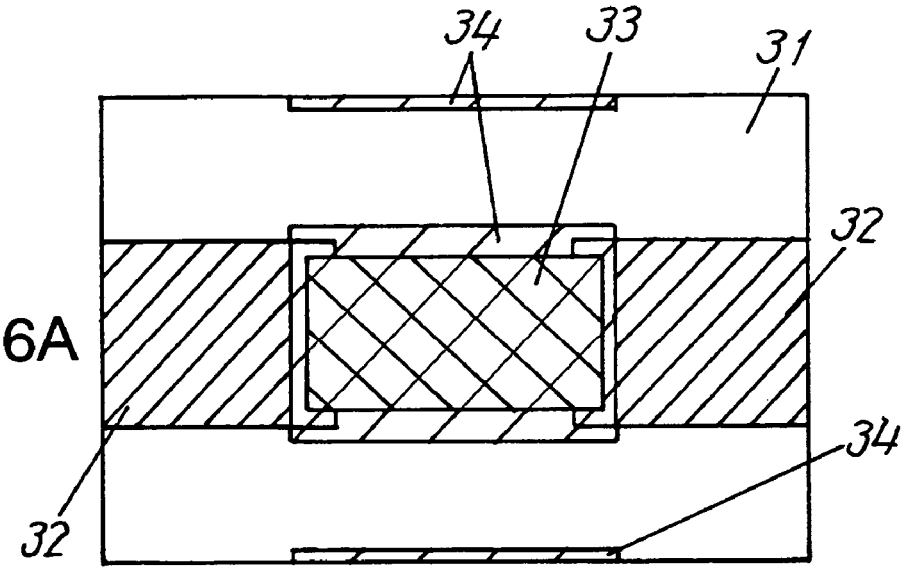
FIGS. 6A and 6B are plan views of the resistor for showing the manufacturing processes.

Next, plural first protective layers 34 containing mainly glass are formed by screen printing method in a manner that each of the layers covers the resistor elements 33 individually, as shown in FIGS. 5A and 6A. Then, first protective layers 34 formed mainly of glass are made stable films by being sintered according to a sintering profile of 600° C. as a peak temperature.

Figure 5B:
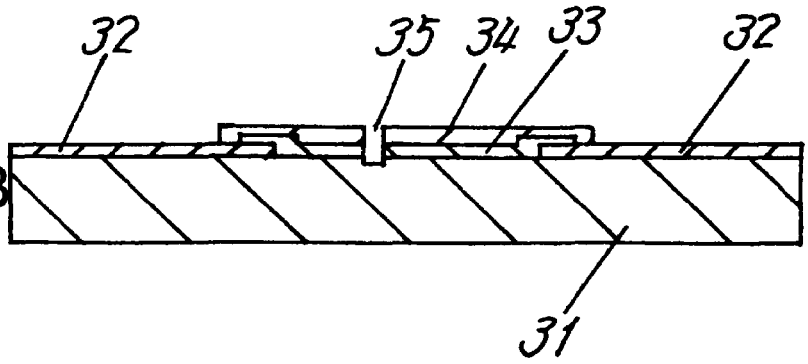
Figure 6B:
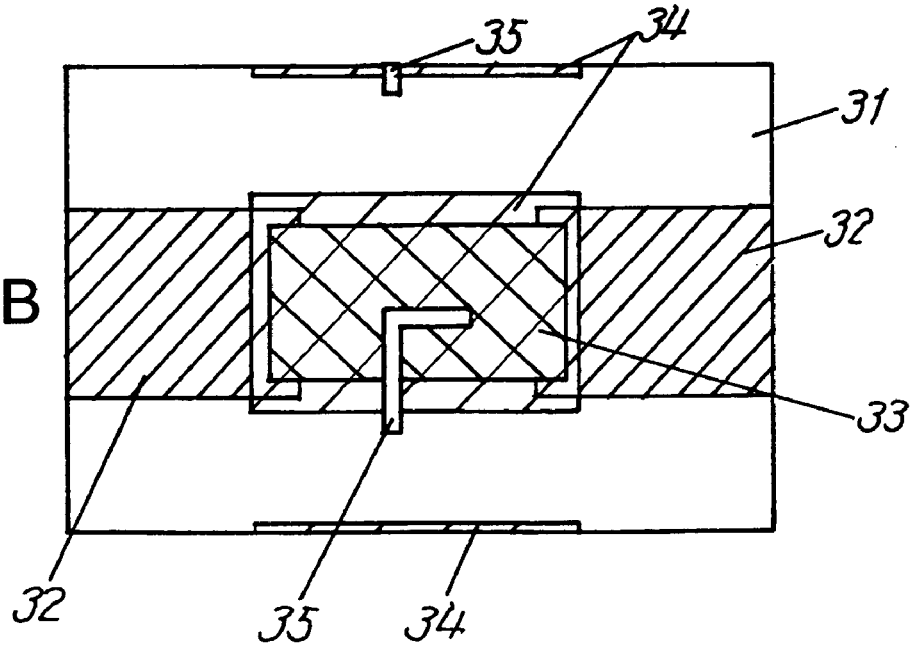

By a laser trimming method, the resistor elements 33 between the plural pairs of first upper surface electrode layers 32 are trimmed, and thus, plural trimming slits 35, as shown in FIGS. 5B and 6B, are fomred to adjust their resistances to predetermined values.

Figure 7A:
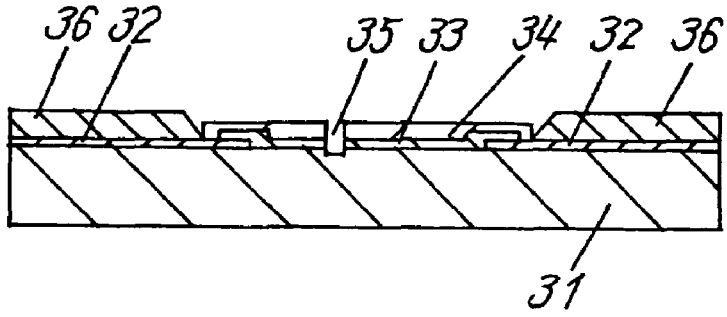
FIGS. 7A through 7C are sectional views of the resistor for showing the manufacturing processes.
Figure 8A:
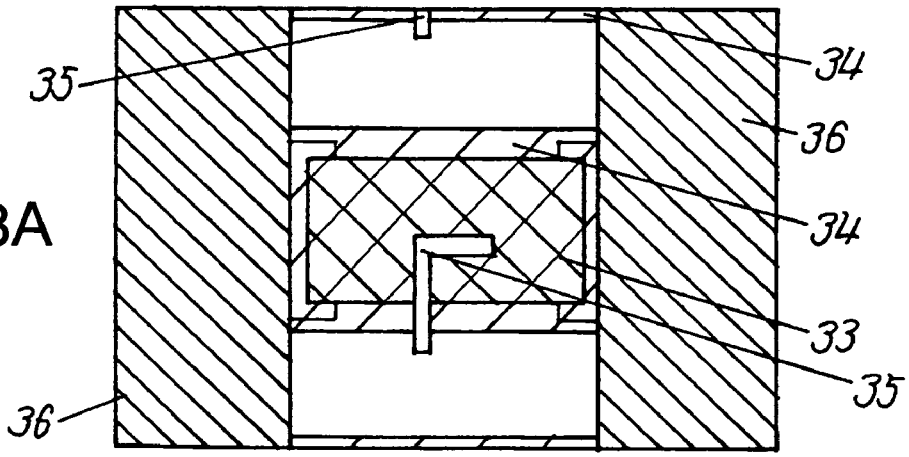
FIGS. 8A through 8C are plan views of the resistor for showing the manufacturing processes.

Next, plural pairs of bonding layers 36 consisting of silver-base conductive resin are formed by screen printing method in such positions that each of them overlaps a part of respective one of the plural pairs of first upper surface electrode layers 32, as shown in FIGS. 7A and 8A. Then, the bonding layers 36 are made stable films by being hardened according to a hardening profile of 200° C. as a peak temperature.

Figure 7B:
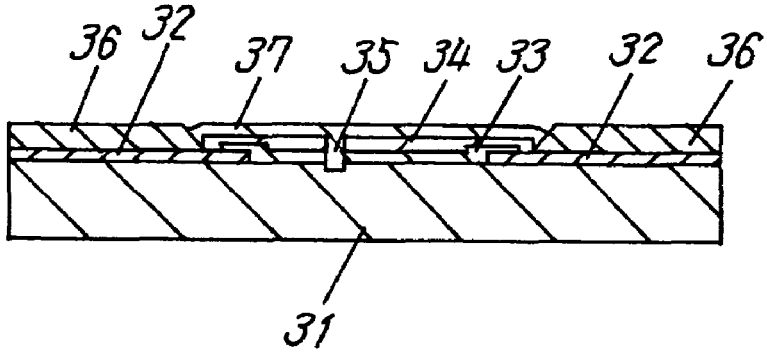
Figure 8B:
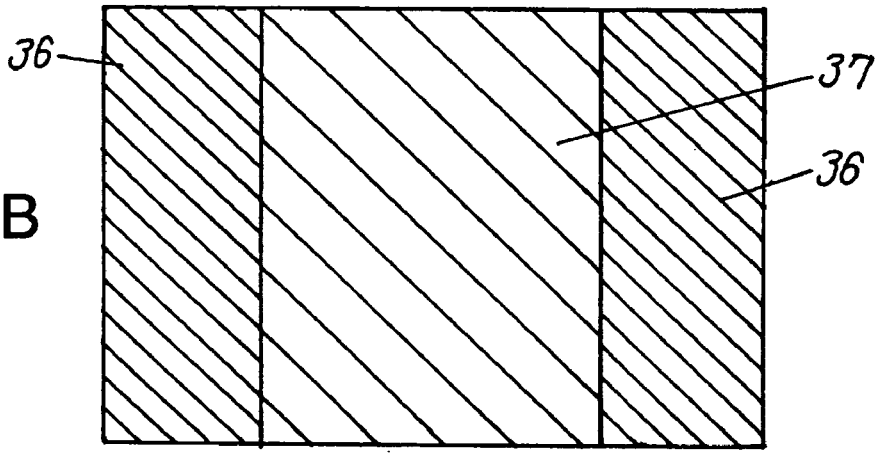

Next, as shown in FIGS. 7B and 8B, by screen printing method, plural second protective layers 37 made mainly of resin to cover the first protective layers 34 which consist mainly of glass are formed along a vertical direction in the figures, and to overlap partially the bonding layers 36. Then, the second protective layers 37 are made stable films by hardened in another hardening profile of 200° C. as a peak temperature.

Figure 7C:
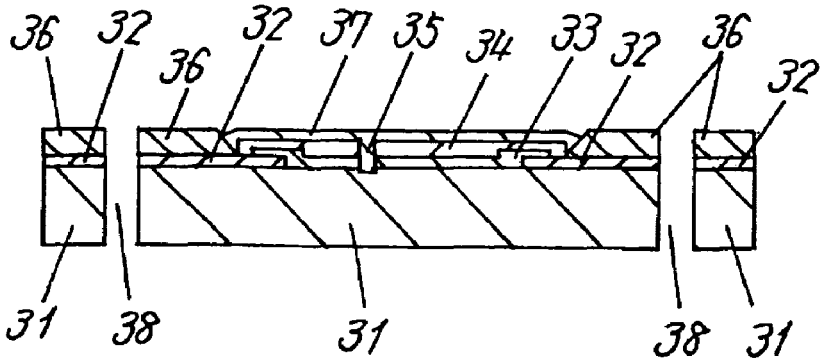
Figure 8C:
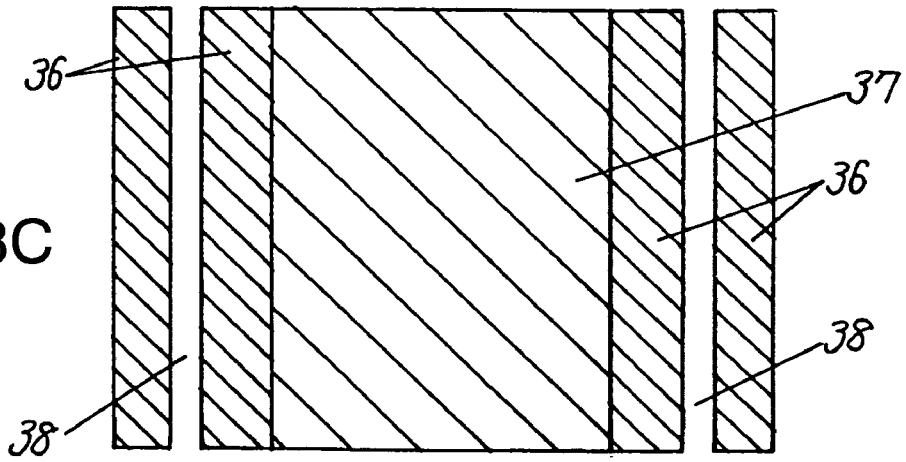

Next, plural slit-like first separations 38 are formed by dicing method in the sheet-form substrate 31 having second protective layers 37, except for the void area 31*a* formed in the entire peripheral margin of the substrate 31, as shown in FIGS. 2, 7C and 8C, to separate the first upper surface electrode layers 32 and bonding layers 36, and to obtain plural oblong substrates 31*b*. In this instance, the slit-like first separations 38 are formed with a 700 μm pitch, and each of the first separations 38 is 120 μm wide. The slit-like first separations 38 are formed into slit openings cut through the sheet-form substrate 31 in a direction of its thickness. In addition, the sheet-form substrate 31 keeps its original sheet-like shape even after the slit-like first separations 38 are formed therein since the slit-like first separations 38 are formed by the dicing method in an area excluding the void area 31*a* so as to allow the oblong substrates 31*b* communicate with each other at the void area 31*a*.

Figure 9A:
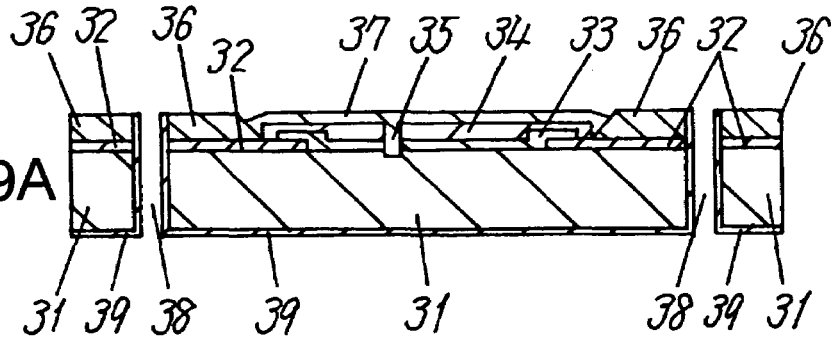
FIGS. 9A through 9C are sectional views of the resistor for showing the manufacturing processes.
Figure 10A:
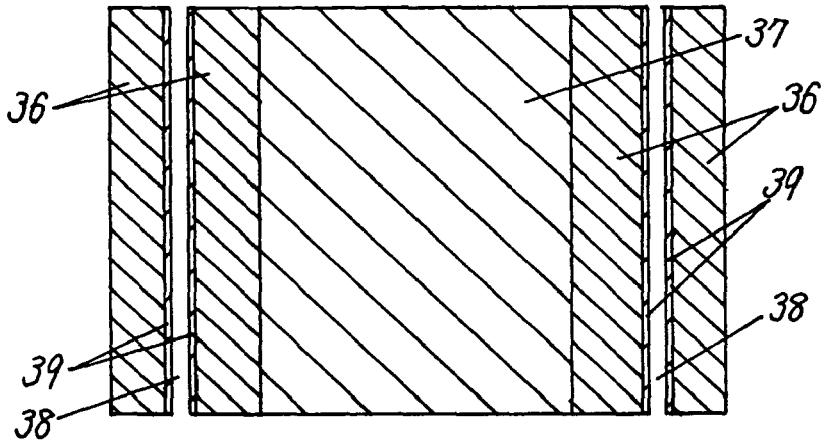
FIGS. 10A through 10C are plan views of the resistor for showing the manufacturing processes.

By a sputtering method, first thin films 39 composed of thin chromium films having a good bonding property against the substrate 31 are then formed to constitute a part of side face electrodes from the back side of the sheet-form substrate 31 toward and over an entire back surface as well as side faces of the substrate 31, side edges of the first upper surface electrode layers 32, and side edges of the bonding layers 36 located inside the slit-like first separations 38, as shown in FIGS. 9A and 10A.

Figure 9B:
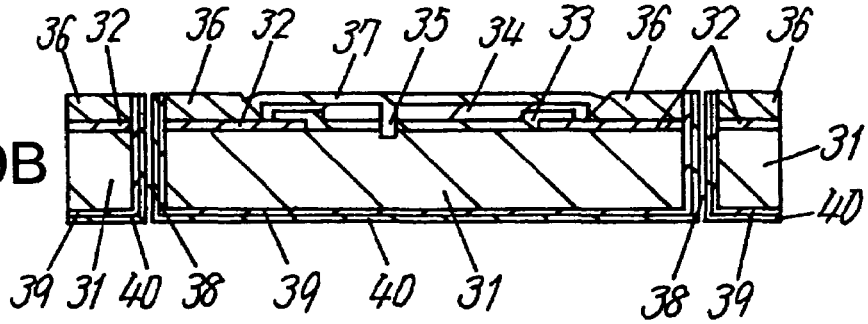
Figure 10B:
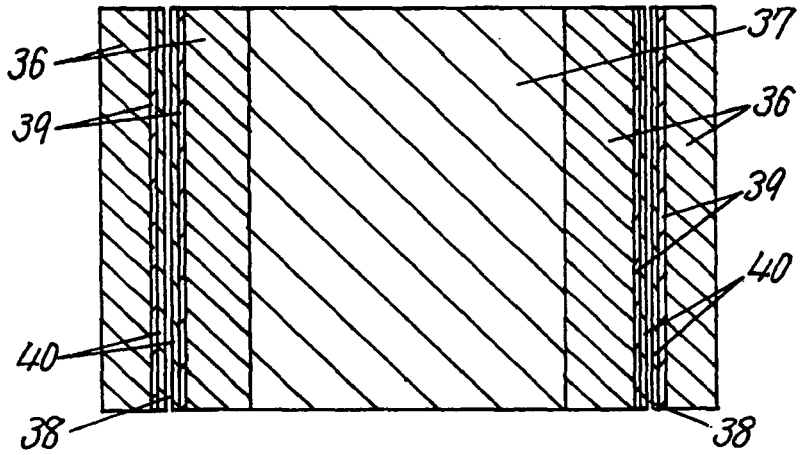

Next, by the sputtering method, plural pairs of second thin films 40 composed of thin copper-nickel alloy films to constitute another part of side face electrodes are formed from the back side of sheet-form substrate 31 on the plural pairs of first thin films 39 in an overlying manner as shown in FIGS. 9B and 10B.

Figure 9C:
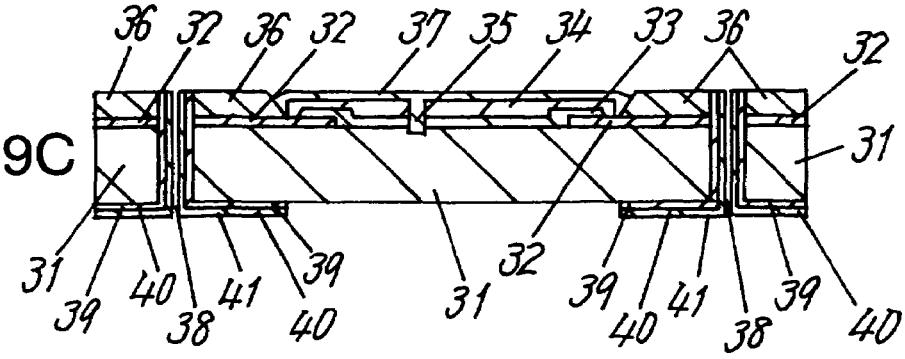
Figure 10C:
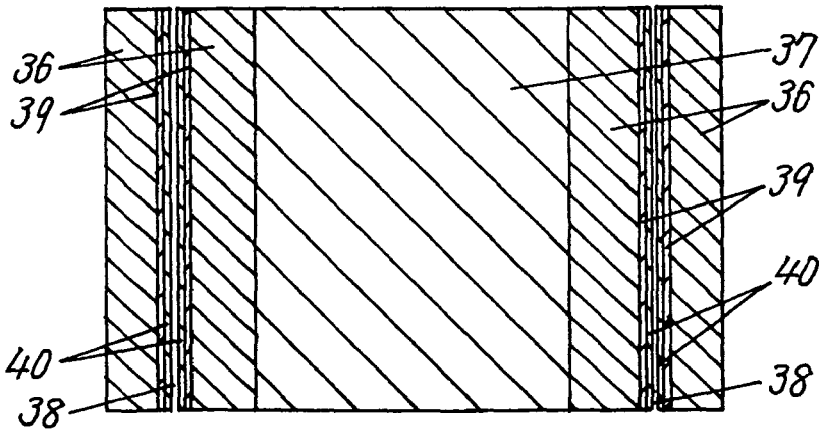

Next, plural pairs of back surface electrodes 41 are formed by removing unnecessary portions, i.e. the center portions, of the plural pairs of first thin films 39 and second thin films 40 formed on the entire back surface of the sheet-form substrate 31, as shown in FIGS. 9C and 10C, by evaporating them for approximately 0.3 mm wide by irradiation of laser beam having a spot diameter of approx. 0.3 mm.

Figure 11A:
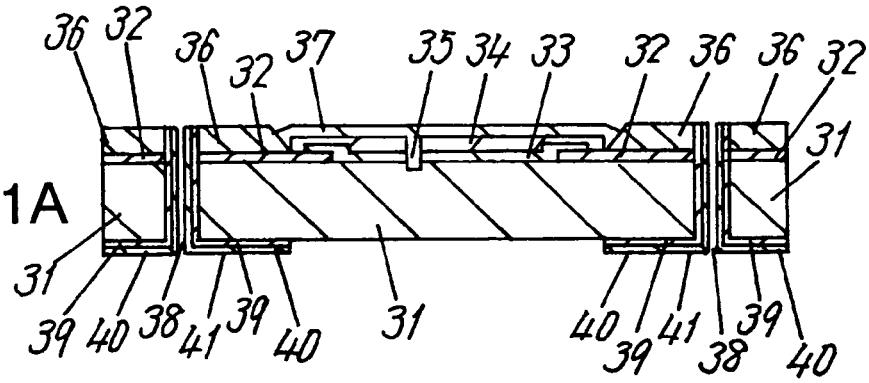
FIGS. 11A and 11B are sectional views of the resistor for showing the manufacturing processes.
Figure 12A:
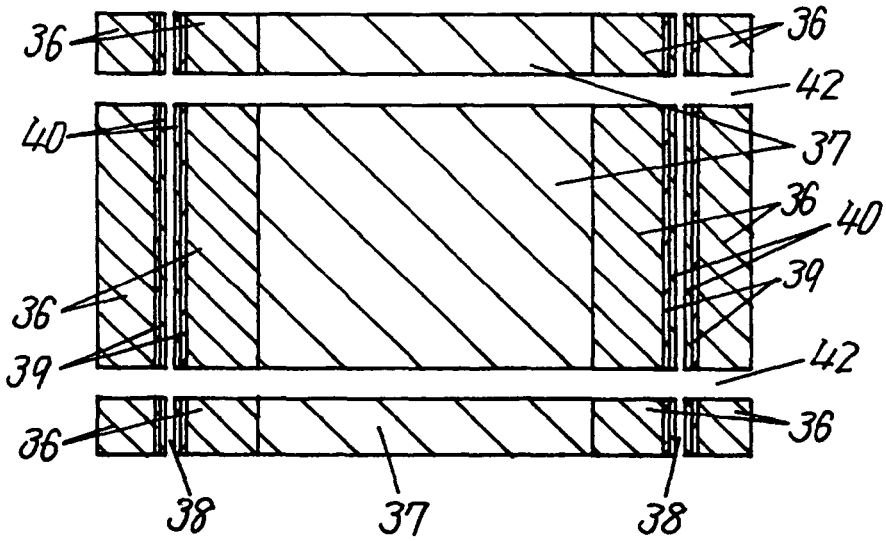
FIGS. 12A and 12B are plan views of the resistor for showing the manufacturing processes.

Next, plural second separations 42 are formed in a direction orthogonal to the slit-like first separations 38, as shown in FIGS. 2, 11A and 12A, except for the void area 31*a* formed in the entire peripheral margin of the sheet-form substrate 31, so as to allow the resistor elements 33 formed on each of the plurality of oblong substrates 31*b* of the sheet-form substrate 31 individually separable into respective segment substrates 31*c*. In this instance, the second separations 42 are formed with a 400 μm pitch, and therefore, each of the second separations 42 is 100 μm wide. The second separations 42 are formed with a laser scriber as the first step of forming separation grooves with the laser, and the separation groove portions are split with generally-available splitting equipment in the subsequent step of separating the substrate into the individual segment substrates 31*c*. In other words, this splitting method provides an advantage of separating the segment substrates 31*c* in the two steps, instead of separating them each and every time the second separations 42 are formed. In addition, since the plural second separations 42 are formed with a laser scriber only in the plural oblong substrates 31*b* excluding the void area 31*a*, the segment substrates 31*c* are divided individually when they are split along the plural second separations 42, and then are divided from the void area 31*a*.

Figure 11B:
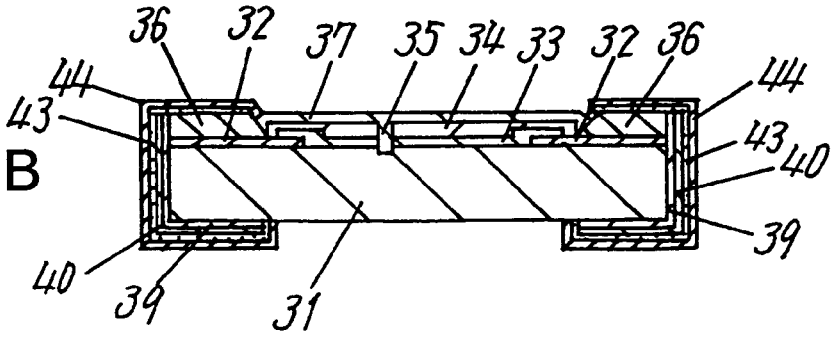
Figure 12B:
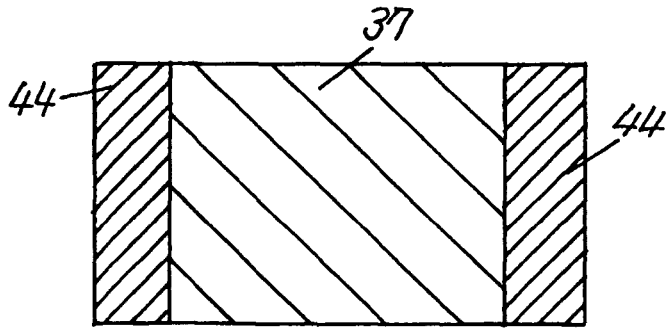

Finally, by an electroplating method, first plating films 43 of nickel plates having approximately 2 to 6 μm thickness and excellent properties are formed to prevent flow of solder and in heat resistance, to cover parts of the first thin films 39, the second thin films 40, and exposed upper surfaces of the bonding layers 36 of the segment substrates 31*c*, as shown in FIGS. 11B and 12B. Then, by an electroplating method, second plating films 44 of tin plates having approximately 3 to 8 μm thickness and excellent property in flow of solder are formed to cover the first plating films 43 of nickel plates.

The above manufacturing process yields the resistors of the first exemplary embodiment of this invention.

In the manufacturing process described above, although tin plating is used to form the second plating films 44, this is not restrictive, and they can be formed by plating any tin-base alloy, such as solder and its like material. The second plating films 44 formed of such material facilitates reliable soldering in the process of reflow soldering.

Moreover, in the above manufacturing process, the protective layer covering the resistor element 33 has a two-layer structure comprising first protective layer 34 composed of glass as the principal element disposed over the resistor element 33 and second protective layer 37 composed of resin as the principal element covering the first protective layer 34 and trimmed slit 35. This structure allows the first protective layer 34 to prevent the resistor from being cracked in the process of laser trimming so as to reduce current noises, and allows the second protective layer 37 of resin to ensure a resistance characteristic with good moisture-proof property since covering the entire resistor element 33.

Furthermore, the resistors manufactured in the above manufacturing process have high accuracy (±0.005 mm or less) in dimension of intervals of the slit-like first separations 38 formed by dicing method and the second separations 42 formed with the laser scriber. In addition, the resistors as final products have overall length and width of 0.6 mm by 0.3 mm accurately since because all of the first thin films 39, second thin films 40, first plating films 43, and second plating films 44 constituting the side face electrodes can be formed precisely in their thickness. Moreover, since pattern sizes of the first upper surface electrode layers 32 and the resistor elements 33 are so accurate that dimensional ranking of the individual segment substrates is not required, nor is it required to consider dimensional variations within the same dimensional rank of the segment substrates. As a result, the resistor has a larger effective area of the resistor elements 33 than the conventional resistor. In other words, while the conventional resistor elements have dimensions of approximately 0.20 mm long by 0.19 mm wide, resistor elements 33 of the resistors according to the first exemplary embodiment of the invention measure approximately 0.25 mm long by 0.24 mm wide, which is about 1.6 times or greater in the surface area.

In addition, in the above manufacturing process, the slit-like first separations 38 are formed by the dicing method in the sheet-form substrate 31, which does not require dimensional ranking of the segment substrates. Accordingly, a complex process which is required for the conventional resistor in the production is not needed by avoiding the dimensional ranking of the segment substrates. It also facilitates the dicing process, which can be carried out easily with conventional dicing equipment.

Moreover, in the above manufacturing process, void area 31*a* which does not become products in the end is formed around the entire peripheral margin of the sheet-form substrate 31, and the first separations 38 in a manner that the oblong substrates 31*b* communicate to each other at the void area 31*a*. Since the plural oblong substrates 31*b* communicate with each other at the void area 31*a* even after the first separations 38 are formed, the oblong substrates 31*b* are not separated from the sheet-form substrate 31. This can facilitate the subsequent process of the sheet-form substrate 31 with the void area 31*a* kept integral after the process of forming the first separations 38, thereby simplifying design of the manufacturing process.

Furthermore, in the manufacturing process above, the plural pairs of back surface electrodes 41 are formed by removing unnecessary portions of the first thin films 39 and second thin films 40 formed on the entire back surface of the sheet-form substrate 31, i.e. generally the center portions on the back surface of the sheet-form substrate 31, by evaporating them for approx. 0.3 mm wide with laser irradiation having a spot diameter of approx. 0.3 mm. This process allows the unnecessary portions of the first thin films 39 and second thin films 40 to be removed accurately, and improves dimensional preciseness of the electrodes on the back surfaces of the resistors after they come out as final products, which can hence reduce failures in mounting the resistors on their back surfaces to a mount board.

Second thin film 40 that constitutes a part of the side face electrode will be described in detail.

In particular, thin copper-nickel alloy film is used preferably for second thin films 40 out of thin films of various kinds of copper-base alloy.

A thin copper-nickel alloy film produces "complete solid solution" in which nickel, i.e. admixing component, melts uniformly into copper, or the base component of the thin alloy film and the first thin film 39, in any percent figure of composition ratio (the entire composition range) of copper. Therefore, nickel diffuses throughout an interface between the second thin film 40 of thin copper-nickel alloy film and the first thin film 39 to produce a strong bonding layer for improvement of bonding strength. The nickel in the outer surface of the second thin film 40 has an additional effect of improving anticorrosive property of its own surface, as it is dipped into a plating bath used to form first plating film 43 of nickel plate, and thereby, it also improves bonding strength in another interface of the first plating film 43 with the second thin film 40.

Figure 13:
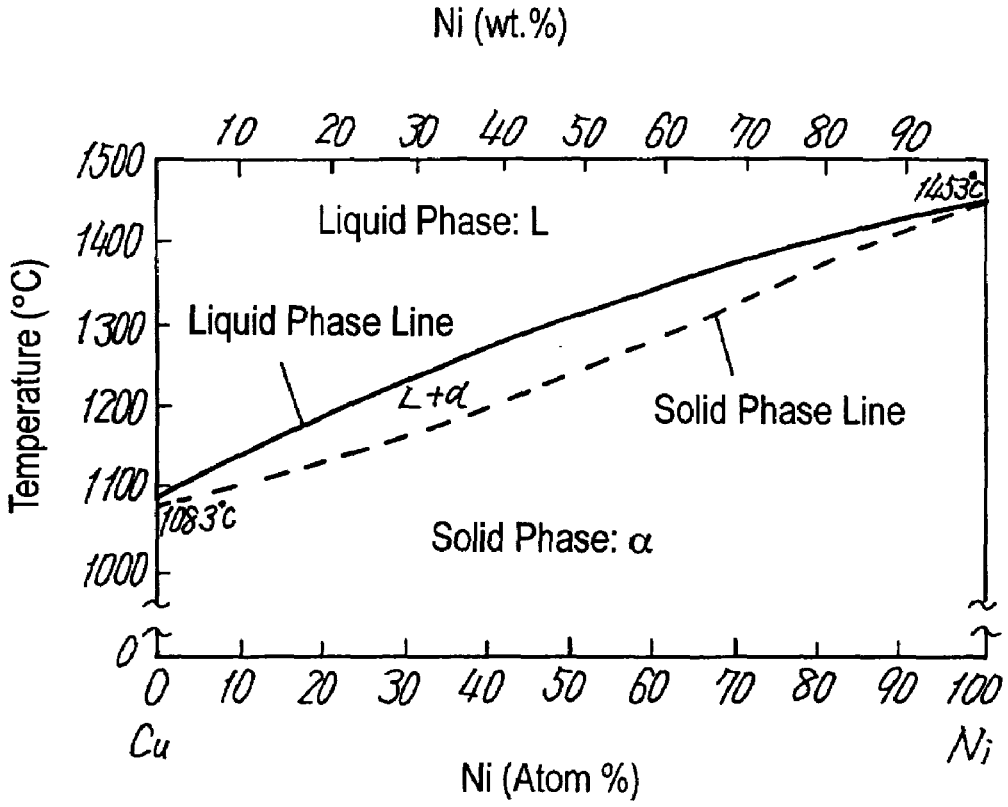
FIG. 13 is a graphic representation showing equilibrium of thin copper-nickel alloy film constituting a second thin film of the same resistor.

In the first embodiment of the invention, "complete solid solution" is illustrated by equilibrium diagram of thin copper-nickel alloy film defining the second thin film, as shown in FIG. 13. Admixing amount of nickel component and temperature are given on the axes of abscissa and ordinate respectively in FIG. 13, and the alloy stays in a state of liquid phase at any temperature above a liquid phase curve shown by the solid line, and in a state of solid phase at any temperature below a solid phase curve shown by the broken line. An area enclosed in the solid and broken lines represents a state of the "complete solid solution", in which solid phase and liquid phase are mixed. In other words, the second thin film 40 made of a thin copper-nickel alloy film of the first embodiment of the invention forms a single phase of substitutional solid solution having a structure of face-centered cubic lattices, in which nickel atoms having crystal structure of face-centered cubic lattices melt into the base metal of copper, also having the same face-centered cubic lattices, in any combination throughout the entire composition range.

Figure 14:
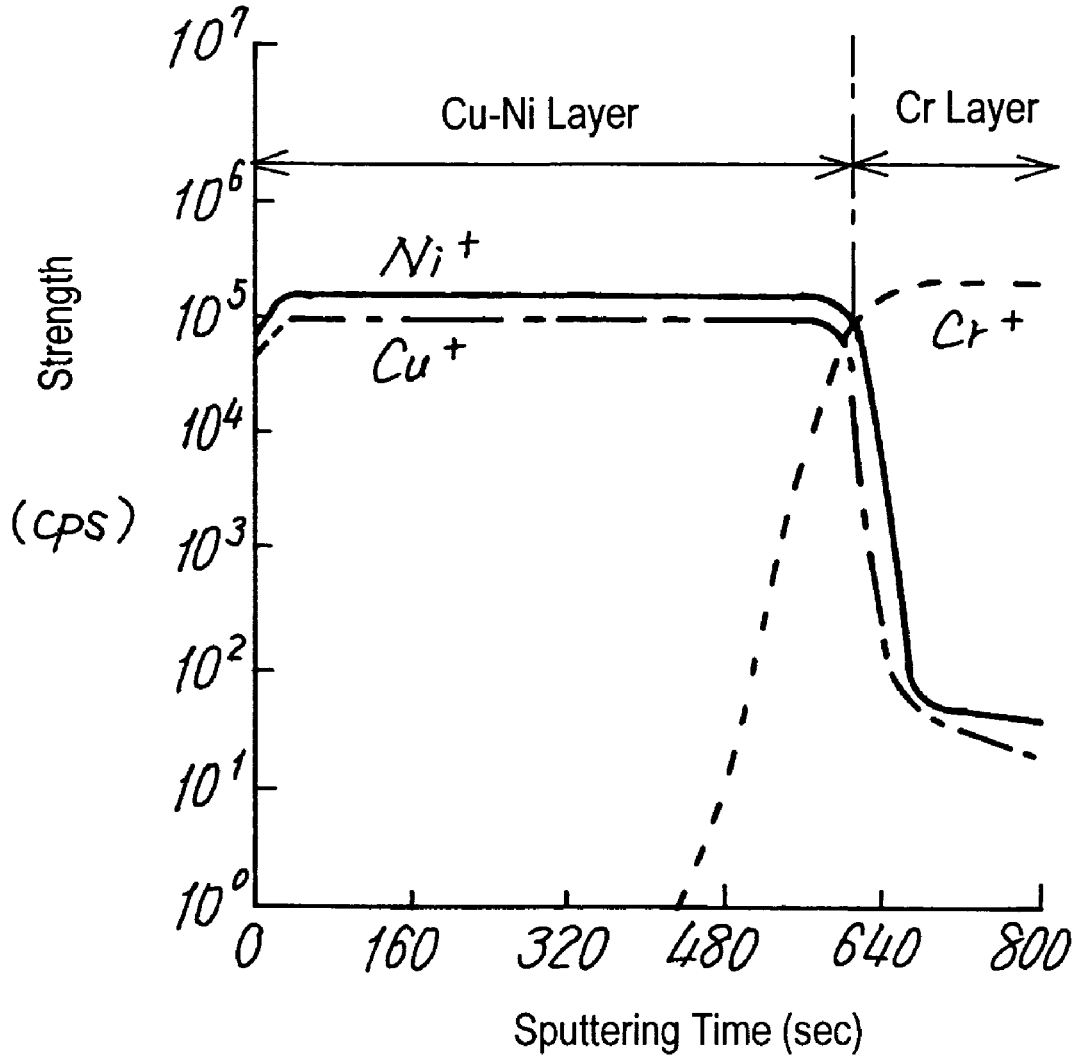
FIG. 14 is a graph illustrating a result of composition analysis of a first thin film and a second thin film of the resistor using an SIMS method.

FIG. 14 shows a result of composition analysis made on the first thin film 39 consisting of a thin chromium film and the second thin film 40 of a copper-nickel alloy film by the Secondary Ion Mass Spectroscopy (SIMS) method. An added amount of nickel in the second thin film 40 is 6.2 wt. % according to this embodiment. FIG. 14 shows sputtering time on the axis of abscissa representing film thickness of the copper-nickel alloy film above a base surface, and number of atoms of copper, nickel, chromium and the like on the axis of ordinate. As obvious from FIG. 14, nickel is distributed uniformly in the copper base metal of the copper-nickel alloy film layer from the base surface to the interface with the chromium film layer, whole a diffusion layer in which copper, nickel and chromium coexist exists in the interface between the copper-nickel alloy film layer and the chromium film layer. This teaches that the second thin film 40 made of a thin copper-nickel alloy film has transformed into "complete solid solution", in which nickel diffused completely into the copper base metal forms a single phase. Although FIG. 14 represents the alloy containing 6.2 wt. % of nickel, the same result as that of FIG. 14 can be obtained with any amount of added nickel through the entire composition range.

The resistor including the second thin film 40 of thin copper-nickel alloy film constructed as above according to the first exemplary embodiment of this invention has a special property, which will be described hereinafter.

Figure 15A:
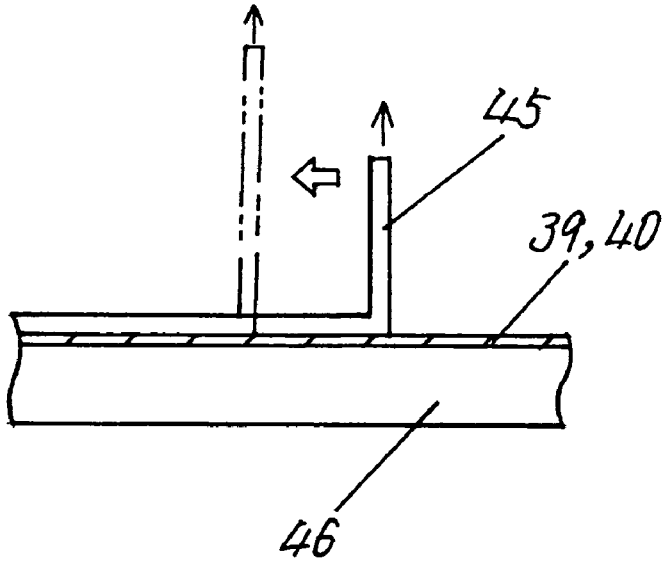
FIGS. 15A and 15B showing a method of testing characteristics.
Figure 15B:
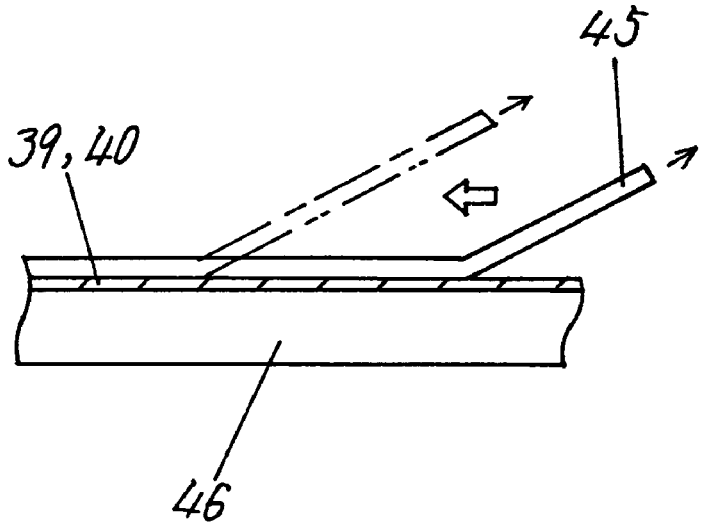

To evaluate the property, a series of tests is executed by a method described in Japanese Industrial Standard, JIS H8504C, titled "Method of adhesion test for metallic coatings", and adhesive tape of 18 mm wide specified in JIS Z1522 "Pressure sensitive adhesive cellophane tapes" in the test is used, as shown in FIGS. 15A and 15B. A pull force in any of a vertical direction and a slanting direction is applied to alumina substrate 46 for peeling off the adhesive tape 45 in the test, as specified in JIS H 8504 standard and shown in FIGS. 15A and 15B.

More specifically, alumina substrate 46 is used as a test specimen of the test, and a thin chromium film is formed by sputtering method on a side surface of the alumina substrate 46 as first thin film 39. Then, another thin copper-nickel alloy film serving as the second thin film 40 over the first thin film 39 is formed by sputtering method in the same manner as the first thin film 39. Then, a pattern of 0.3 mm wide is formed in the films with laser.

Then, the specimen is left under accelerated aging in the condition of 65° C. in temperature and 95% in humidity. After adhesive tape 45 is applied on the surface of second thin film 40, the adhesive tape 45 is pulled at once. Then, the bonding property was evaluated by counting a number of patterns, from which the second thin films 40 came off, out of a total number of patterns to obtain their ratio.

In addition to the above, a nickel plate as first plating film 43 and a solder plate as second plating film 44 are formed by electrolytic plating method after the second thin film 40 is formed for a test specimen for evaluation of interfacial bonding between the first plating film 43 and the second thin film 40.

Group of samples consisting of 1.6 wt. %, 6.2 wt. % 12.6 wt. % and 0 wt. % of added amount of nickel in the thin copper-nickel alloy films was evaluated.

Table 1 shows a result of the evaluation in peel-off ratio of the interfaces between the second thin films 40 and the first thin films 39 after 500 hours of accelerated aging.

TABLE 1

| Added Amount of Ni (wt. %) | 0 | 1.6 | 6.2 | 12.6 |
|---|---|---|---|---|
| Peel-Off Ratio (%) | 35.0 | 0.0 | 0.0 | 0.0 |

As clear from Table 1, the bonding property in the interface between the second thin film 40 and the first thin film 39 is improved substantially as nickel to the thin copper film is added.

Table 2 shows a result of the evaluation in peel-off ratio of the interfaces between the first plating films 43 and the second thin films 40 after 500 hours of accelerated aging.

TABLE 2

| Added Amount of Ni (wt. %) | 0 | 1.6 | 6.2 | 12.6 |
|---|---|---|---|---|
| Peel-Off Ratio (%) | 15.0 | 0.0 | 0.0 | 0.0 |

As is clear from Table 2, the bonding property in the interface between the first plating film 43 and the second thin film 40 is improved also substantially as nickel to the thin copper film is added.

According to the first exemplary embodiment of the invention, the first thin films 39 and the second thin films 40 formed by sputtering method are explained, but the method is not limited only to the sputtering method. Similar advantage and effect as those of the first exemplary embodiment of this invention are also obtained even if first thin films 39 and second thin films 40 are formed by other film-forming techniques, such as vacuum evaporation method, ion plating method, P-CVD method, and the like.

According to the first exemplary embodiment of the invention, the first thin films 39 formed of thin chromium films is explained, but they are not limited only to the chromium films. Similar advantage and effect as those of the first exemplary embodiment of the invention are also obtained even if first thin films 39 are formed of any other material having large bonding property against the substrate, such as chromium-silicon alloy films, nickel-chromium alloy films, titanium films, titanium-base alloy films and the like.

Figure 16:
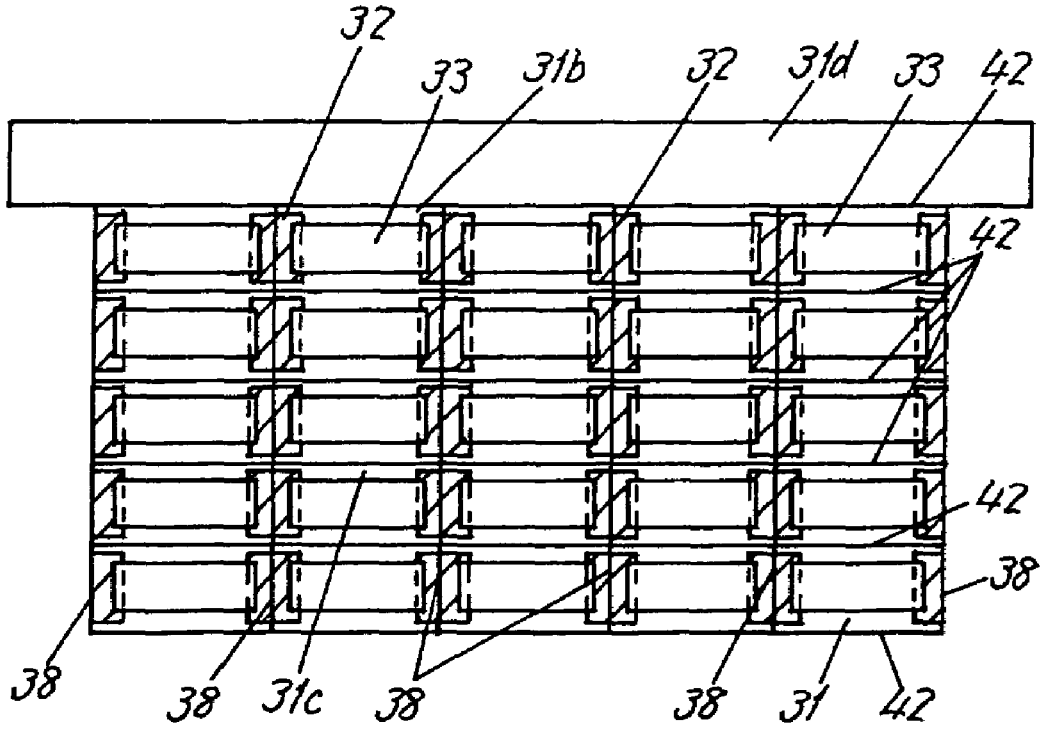
FIG. 16 is a plan view of a sheet-form substrate for use in manufacturing the resistor, wherein a void area is formed at one side of the substrate.
Figure 17:
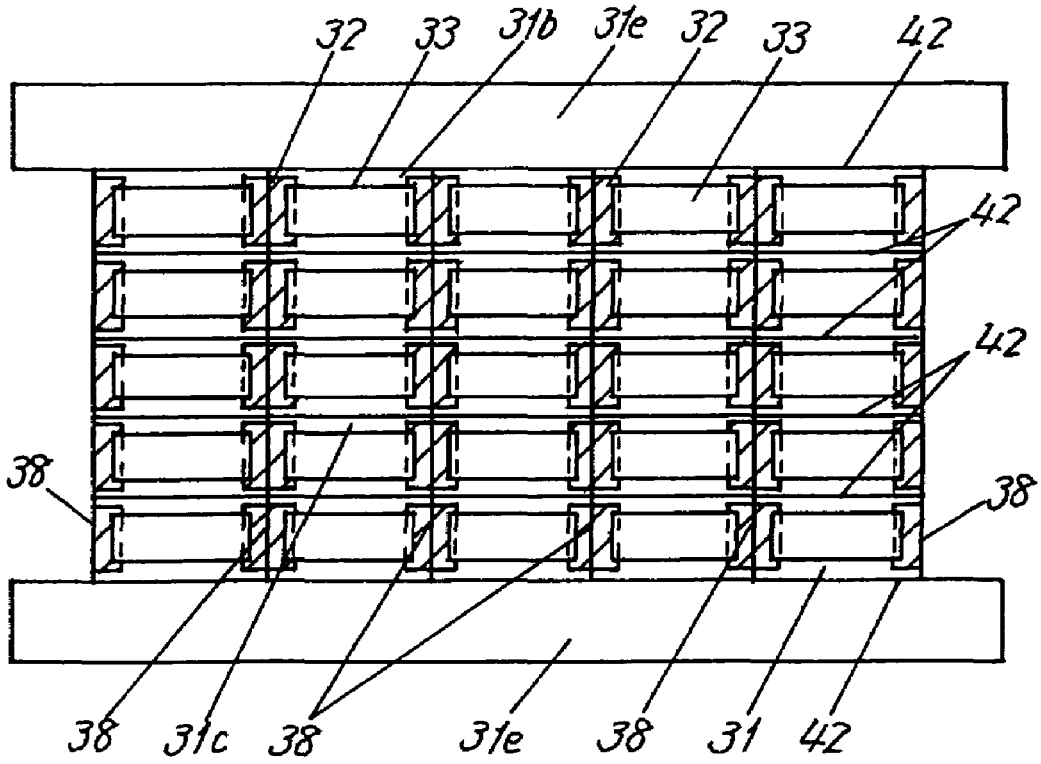
FIG. 17 is a plan view of another sheet-form substrate for use in manufacturing the resistor, wherein void areas are formed at both sides of the substrate.
Figure 18:
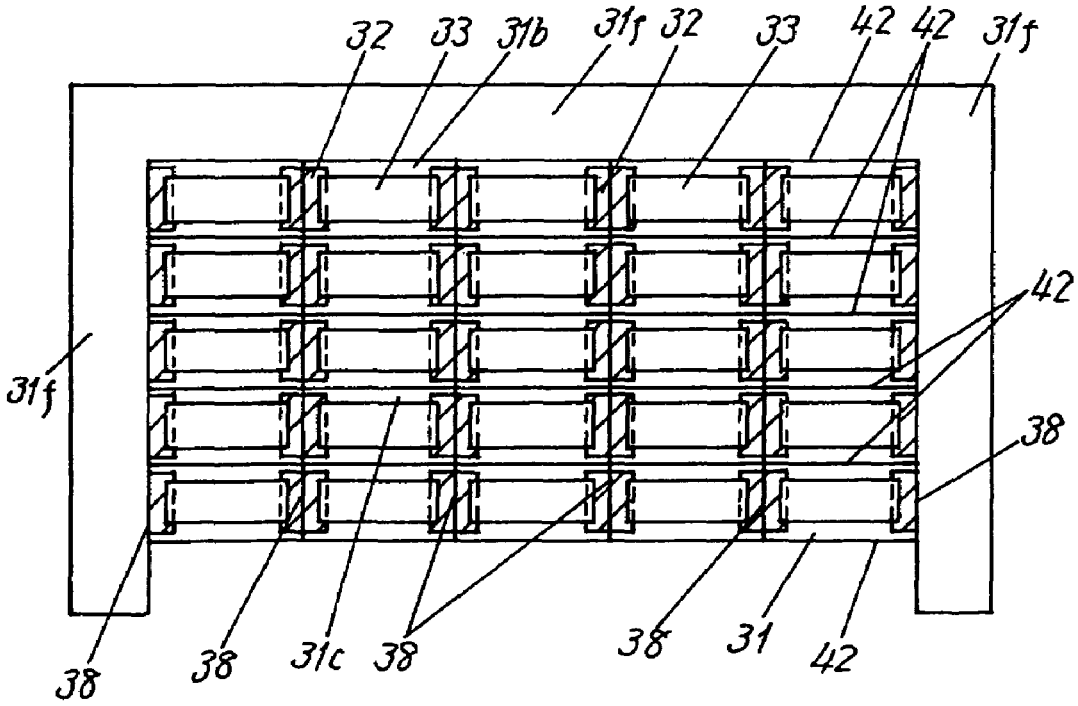
FIG. 18 is a plan view of still another sheet-form substrate for use in manufacturing the resistor, wherein a void area is formed at three sides of the substrate.

Moreover, in the first exemplary embodiment of the invention, the void area 31*a* is formed substantially in a square shape around the entire peripheral margin of the sheet-form substrate 31, which does not yield any product in the end. However, the void area 31*a* is not necessarily formed around the entire peripheral margin of the sheet-form substrate 31. Similar advantage and effect can be achieved as those of the first exemplary embodiment of this invention, even if, for examples, void area 31*d* is formed at one side of sheet-form substrate 31 as shown in FIG. 16, void areas 31*e* are formed at both sides of sheet-form substrate 31 as shown in FIG. 17, or void area 31*f* is formed at three sides of sheet-form substrate 31 as shown in FIG. 18.

Furthermore, in the first exemplary embodiment of the invention, the laser scriber is used for forming the plural second separations 42. However, the second separations 42 may be formed by dicing method in the same manner as the slit-like first separations 38. In this case, the dicing can work easily with a dicing machine commonly used for semiconductors and the like.

Second Exemplary Embodiment

A resistor and a method of manufacturing the resistor according to a second exemplary embodiment of the invention will be described with reference to the accompanying drawings.

Figure 19:
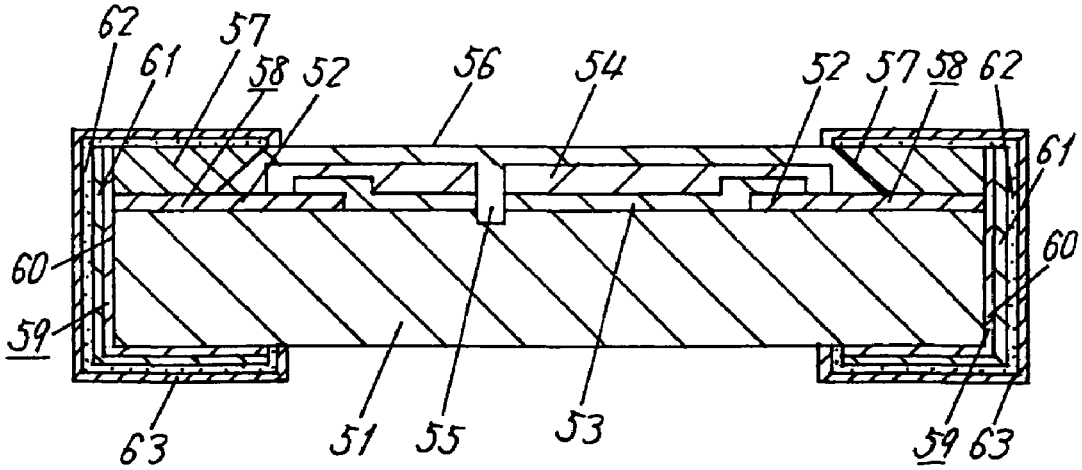
FIG. 19 is a sectional view of a resistor according to a second exemplary embodiment of the present invention.

FIG. 19 is a sectional view of the resistor according to the second exemplary embodiment of the invention.

In FIG. 19, reference numeral 51 denotes a segment substrate separated along slit-like first separations and second separations intersecting at right angles with the first separations, from a sheet-form substrate made of sintered 96% alumina. Reference numeral 52 denotes a pair of first upper surface electrode layers made mainly of silver and formed on one of main surfaces (i.e. upper surface) of substrate 51. Reference numeral 53 denotes a resistor element formed of ruthenium oxide-base material on the upper surface of substrate 51 in such a manner that parts of it overlap with the pair of first upper surface electrode layers 52, so that they come into electrical connection therewith. Reference numeral 54 denotes a first protective layer made mainly of glass and formed on an upper surface of the resistor element 53. Reference numeral 55 denotes a trimming slit provided to adjust a resistance of resistor element 53 between the pair of first upper surface electrode layers 52. Reference numeral 56 denotes a second protective layer made mainly of resin and covering the first protective layer 54 consisting mainly of glass, and to also overlap partially with the pair of first upper surface electrode layers 52. Reference numeral 57 denotes a pair of bonding layers made of silver-based conductive resin formed in a manner that each of them overlaps a part of the respective one of the pair of first upper surface electrode layers 52 as well as a part of the second protective layer 56, and that this pair of bonding layers 57 together with the pair of first upper surface electrode layers 52 constitute a pair of upper surface electrodes 58. The first upper surface electrode layers 52 and the bonding layers 57 are flush with both side faces of the substrate 51. In addition, the bonding layers 57 have maximum heights in their thickness direction is greater than those of the first upper surface electrode layers 52. Reference numeral 59 denotes a pair of side face electrodes provided on the side faces of the substrate 51 in a manner to maintain electrical connection with the pair of upper surface electrodes 58. The side face electrode 59 is constructed of a multi-layered structure including first thin film 60, second thin film 61, first plating film 62, and second plating film 63. First thin film 60 formed substantially in an L-shape over the respective side face of the substrate 51 in a position abutting a side face of the substrate 51, a side edge of the first upper surface electrode layer 52 as well as a side edge of the bonding layer 57 covers an end portion on a back surface of the substrate 51. Second thin film 61 formed substantially in an L-shape overlies the first thin film 60 and connected electrically to the first thin film 60. First plating film 62 formed by nickel plating substantially in a squared-U-shape covers the second thin film 61 as well as an exposed surface of the bonding layer 57. Second plating film 63 formed by tin plating having substantially a squared-U-shape covers the first plating film 62.

In the above-described structure, the pair of upper surface electrodes 58 includes first upper surface electrode layers 52 and bonding layers 57 overlapping the first upper surface electrode layers 52. They can therefore have increased areas of contact between the pair of side face electrodes 59 and the pair of upper surface electrodes 58, so as to improve reliability of the electrical connections between the upper surface electrodes 58 and the side face electrodes 59.

Also, the first upper surface electrode layers 52 and the bonding layers 57 constituting the upper surface electrodes 58 are flush with the side faces of substrate 51. As a result, the side face electrodes 59, which are provided over the side faces of substrate 51 and are connected electrically to the upper surface electrodes 58, can be formed steadily and continuously from the side faces of substrate 51 and the side edges of the first upper surface electrode layers 52 and the bonding layers 57 adjoining the side faces of substrate 51, if the side face electrodes 59 are formed of thin films.

Furthermore, the electrical connections of the upper surface electrodes 58 to the resistor element 53 are made only with the first upper surface electrode layers 52 out of the first upper surface electrode layers 52 and the bonding layers 57 that constitute the upper surface electrodes 58. Therefore, this structure does not cause any change in resistance even after the bonding layers 57 are subsequently formed. As a result, it can maintain good ohmic contacts, thereby achieving a highly reliable resistor with no change in resistance after adjusting the resistance.

Also, in the structure between the first upper surface electrode layers 52 and the bonding layers 57 that constitute the upper surface electrodes 58, the bonding layers 57 are formed so that the maximum height in their thickness directions is greater than those of the first upper surface electrode layers 52. Therefore, the bonding layers 57 can increase connecting areas between the upper surface electrodes 58 and the side face electrodes 59, which are provided over the side faces of substrate 51 and are connected electrically to the upper surface electrodes 58, if the side face electrodes 59 are formed of thin films. As a result, the structure can improve reliability of the electrical connections between the upper surface electrodes 58 and the side face electrodes 59.

Moreover, the first thin films 60 and the second thin films 61 constituting the side face electrodes 59 are formed substantially in an L-shape over the back surface and the side faces of the substrate 51. This enables the first thin films 60 and the second thin films 61 to be formed only from one side of the surfaces, i.e. the back side, of the substrate 51 when they are formed by the film-forming technique, which improves productivity.

Referring to the accompanying drawings, a method of manufacturing the resistor constructed as described above according to the second exemplary embodiment of the invention will be described.

Figure 20:
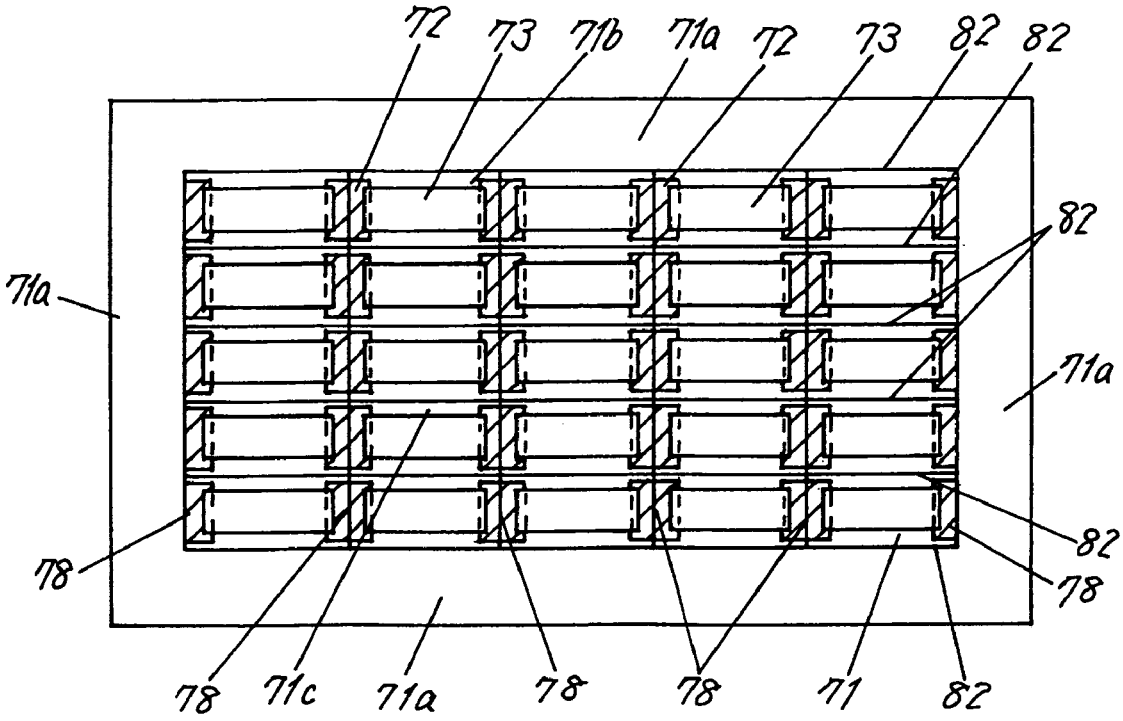
FIG. 20 is a plan view of a sheet-form substrate for use in manufacturing the resistor, wherein a void area is formed in the entire peripheral margin of the substrate.

FIG. 20 is a plan view of a sheet-form substrate for use in manufacturing the resistor of the second exemplary embodiment of the invention, in which a void area is formed in the entire peripheral margin of the substrate. FIGS. 21A through 21C, 22A through 22C, 23A, 23B, 24A, 24B, 25A through 25C, 26A through 26C, 27A through 27C, 28A through 28C, 29A, 29B, 30A and 30B are schematic views of sequential processes illustrating the method of manufacturing the resistor according to the second exemplary embodiment of this invention.

Figure 21A:
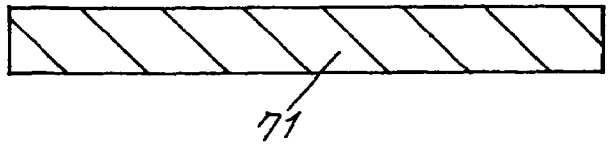
FIGS. 21A through 21C are sectional views of the resistor for showing processes of manufacturing the resistor.
Figure 22A:
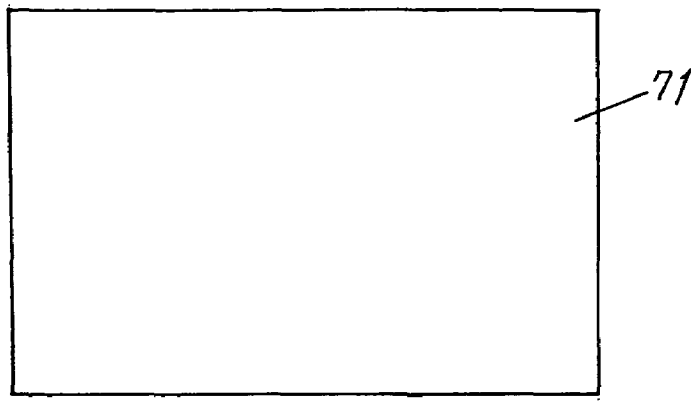
FIGS. 22A through 22C are plan views of the resistor for showing the manufacturing processes.

First, sheet-form substrate 71 of 0.2 mm thick made of sintered 96% alumina having insulating property is prepared, as shown in FIGS. 20, 21A and 22A. In this embodiment, the sheet-form substrate 71 includes void area 71*a* around the entire peripheral margin, as shown in FIG. 20, which does not yield any product in the end. Void area 31*a* is formed substantially in a square shape.

Figure 21B:
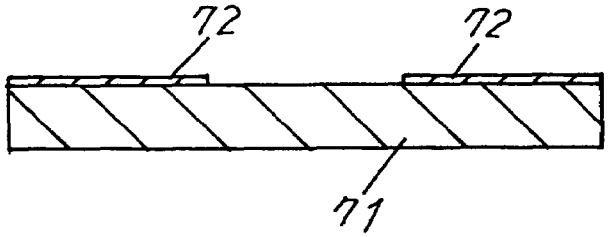
Figure 22B:
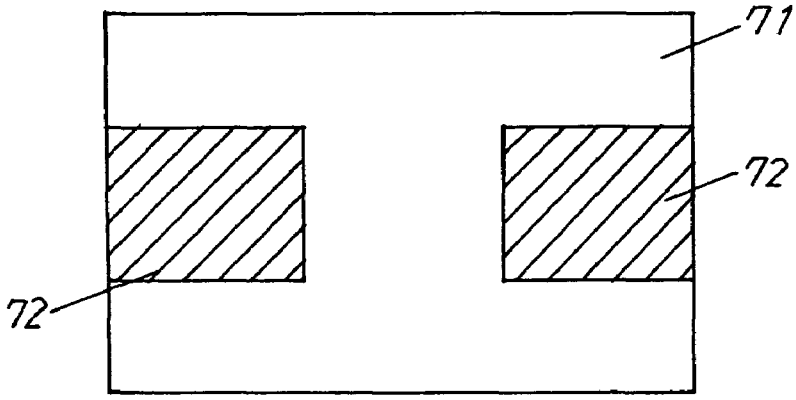

Next, as shown in FIGS. 20, 21B and 22B, plural pairs of first upper surface electrode layers 72 containing mainly silver are formed on an upper surface of the sheet-form substrate 71 by a screen printing method. Then, the first upper surface electrode layers 72 are made stable films by sintering according to a sintering profile of 850° C. as a peak temperature.

Figure 21C:
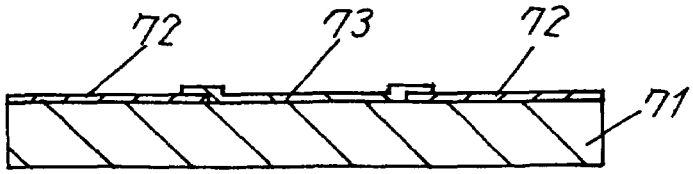
Figure 22C:
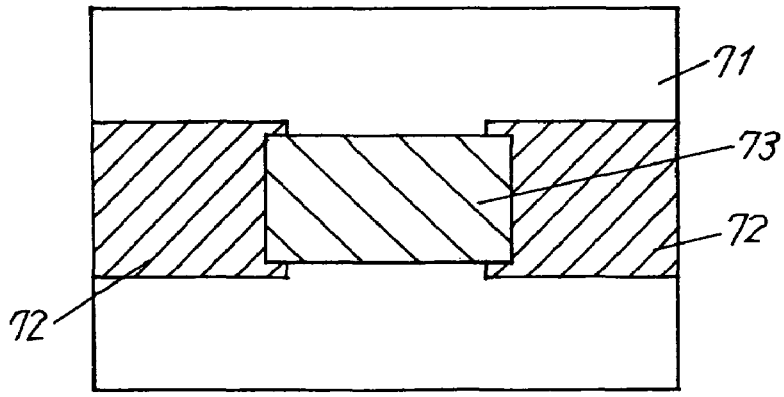

Then, plural resistor elements 73 composed of ruthenium oxide-base material by screen printing method in such positions that each of them bridges each of the plural pairs of upper surface electrode layers 72, as shown in FIGS. 20, 21C and 22C. Then, the resistor elements 73 are made stable films by sintering according to a sintering profile of 850° C. as a peak temperature.

Figure 23A:
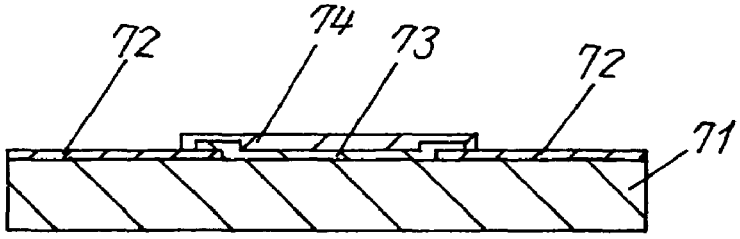
FIGS. 23A and 23B are sectional views of the resistor for showing the manufacturing processes.
Figure 24A:
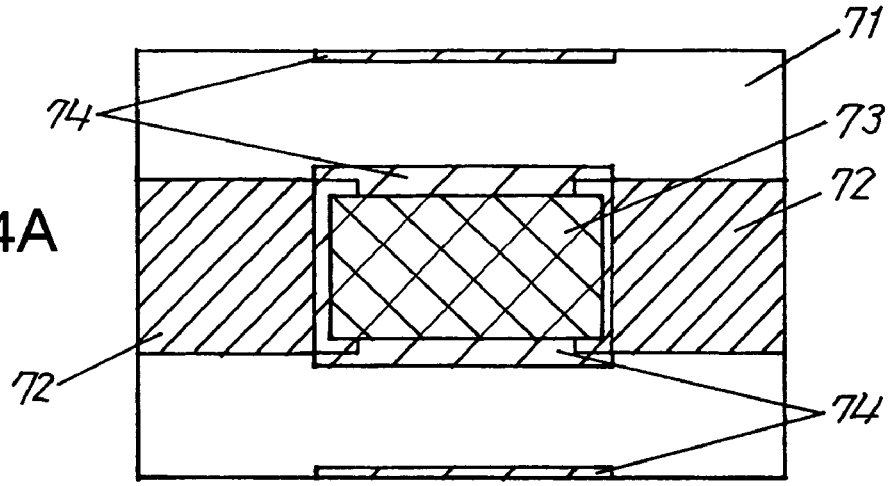
FIGS. 24A and 24B are plan views of the resistor for showing the manufacturing processes.

Next, plural first protective layers 74 containing mainly glass are formed by screen printing method in a manner that each of the layers covers each resistor element 73, as shown in FIGS. 23A and 24A. Then, the first protective layers 74 containing mainly of glass are made stable films by sintering according to a sintering profile of 600° C. as a peak temperature.

Figure 23B:
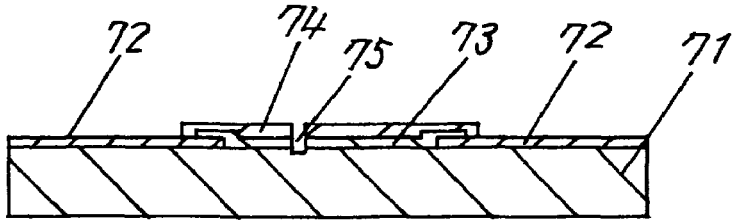
Figure 24B:
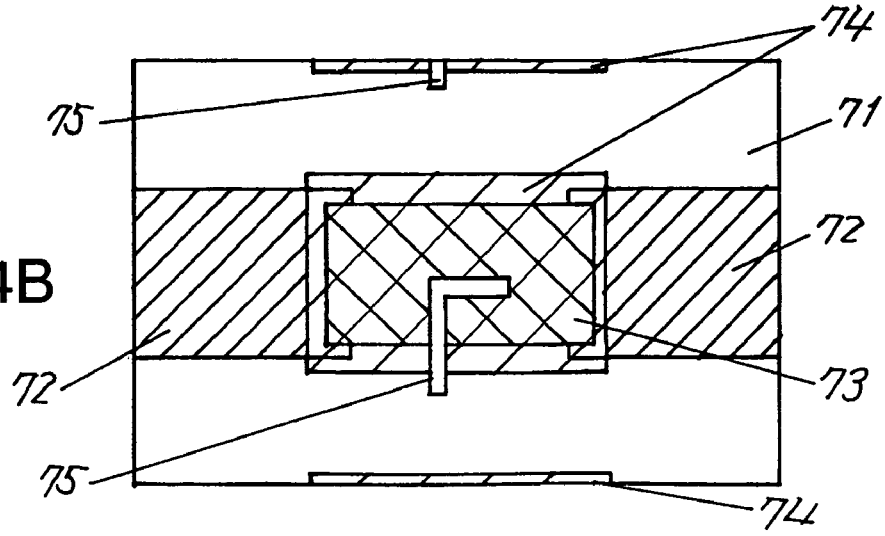

By a laser trimming method, the resistor elements 73 between the plural pairs of first upper surface electrode layers 72 are trimmed, and thus, plural trimming slits 75 are formed, as shown in FIGS. 23B and 24B, to adjust their resistances to a predetermined value.

Figure 25A:
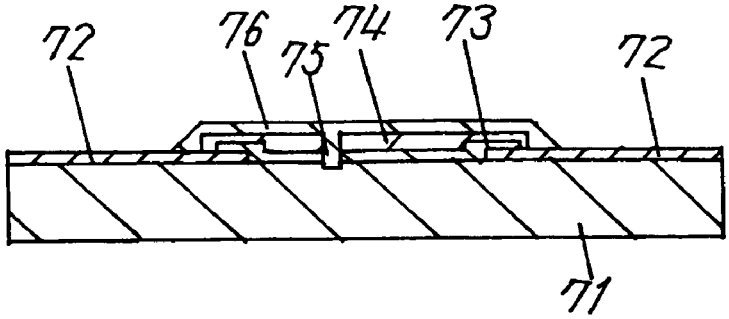
FIGS. 25A through 25C are sectional views of the resistor for showing the manufacturing processes.
Figure 26A:
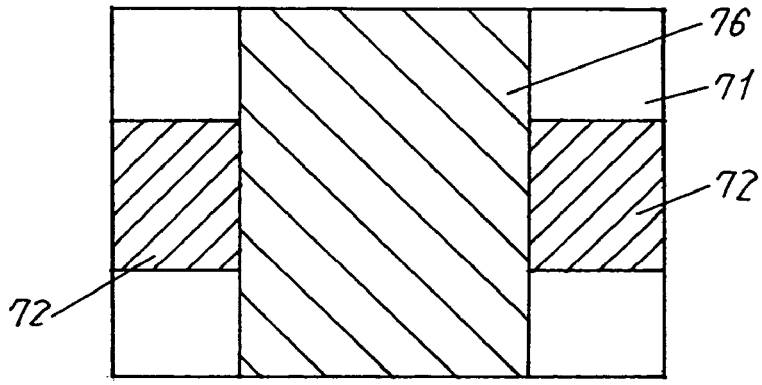
FIGS. 26A through 26C are plan views of the resistor for showing the manufacturing processes.

Next, as shown in FIGS. 25A and 26A, by a screen printing method, plural second protective layers 76 made mainly of resin are provided for covering the first protective layers 74, which consist mainly of glass and are formed along a vertical direction in the figures. The layers 76 overlap partially with the first upper surface electrode layers 72. Then the second protective layers 76 are made stable by hardening according to a hardening profile of 200° C. as a peak temperature.

Figure 25B:
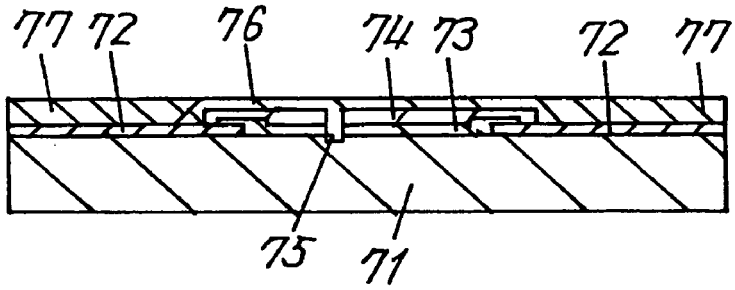
Figure 26B:
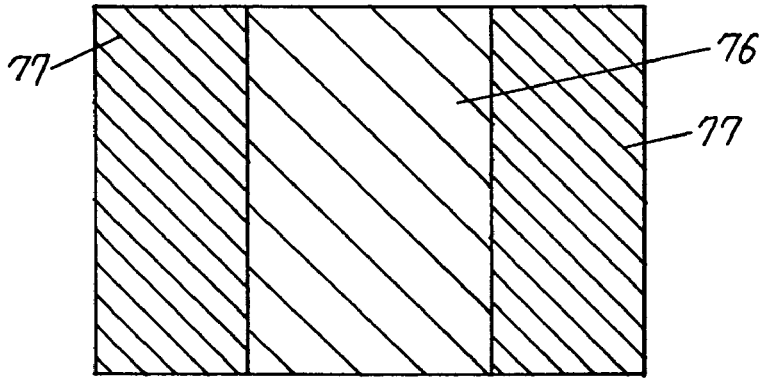

Next, plural pairs of bonding layers 77 consisting of silver-base conductive resin are formed by screen printing method in such positions that each of them overlaps a part of respective one of the plural pairs of first upper surface electrode layers 72 as well as a part of respective one of the second protective layer 76, as shown in FIGS. 25B and 26B. Then, the bonding layers 77 are made stable films by hardening with another hardening profile of 200° C. as a peak temperature.

Figure 25C:
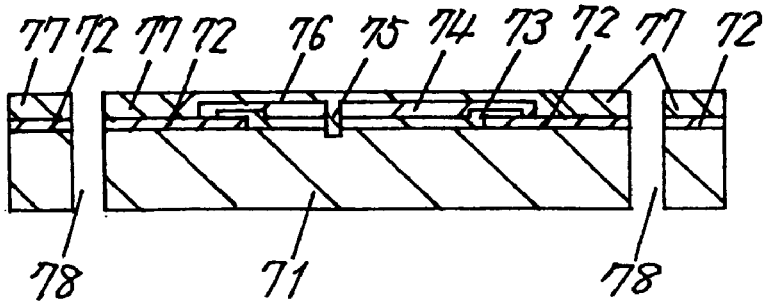
Figure 26C:
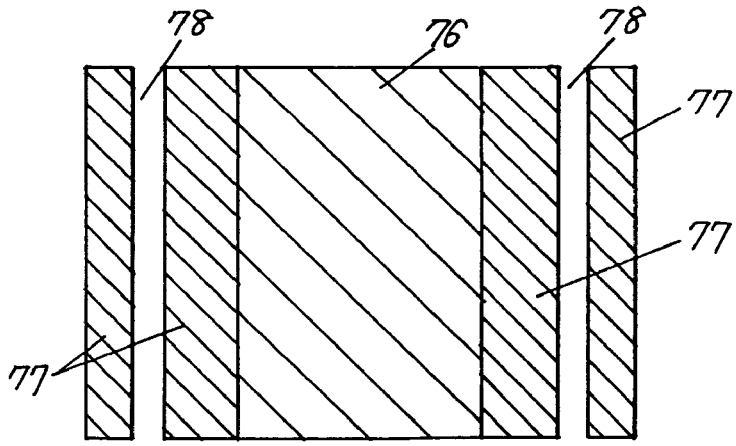

Next, plural slit-like first separations 78 are formed by a dicing method in the sheet-form substrate 71 having second protective layers 76, except for the void area 71*a* formed in the entire peripheral margin of the substrate 71, as shown in FIGS. 20, 25C and 26C, to separate the plural first upper surface electrode layers 72 and bonding layers 77, and to obtain plural oblong substrates 71*b*. In this instance, the slit-like first separations 78 are formed at a 700 μm pitch, and each of the first separations 78 is 120 μm wide. The slit-like first separations 78 are formed into slit openings cut through the sheet-form substrate 71 in a direction of its thickness. In addition, the sheet-form substrate 71 keeps its original sheet-like shape even after the slit-like first separations 78 are formed in it since the slit-like first separations 78 are formed by the dicing method only in an area excluding the void area 71*a* so as to allow the plural oblong substrates 71*b* to communicate with each other at the void area 71*a*.

Figure 27A:
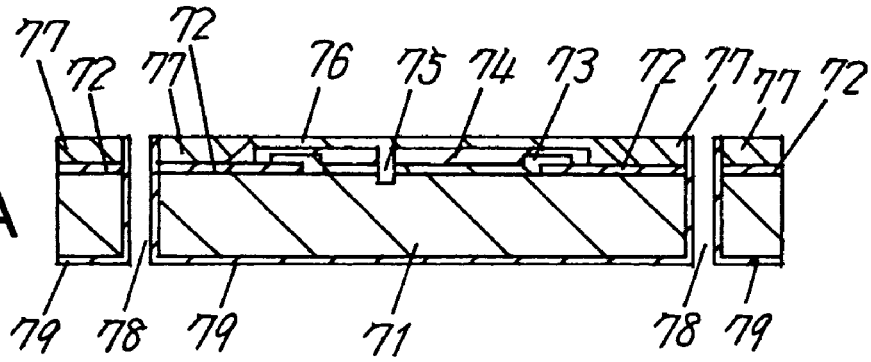
FIGS. 27A through 27C are sectional views of the resistor for showing the manufacturing processes.
Figure 28A:
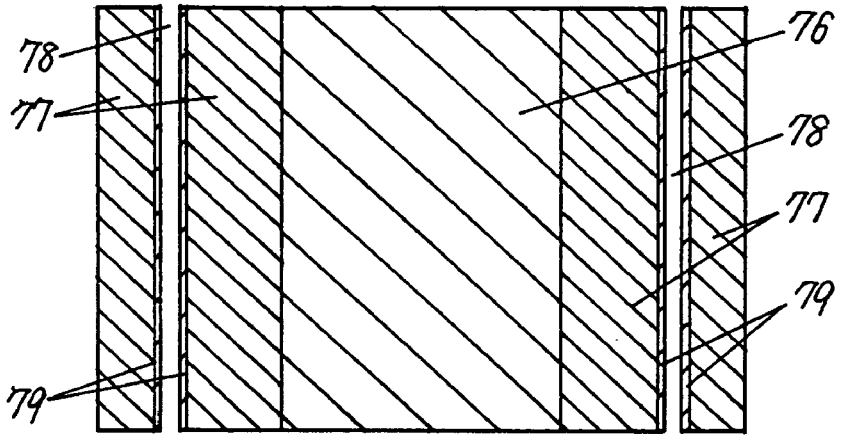
FIGS. 28A through 28C are plan views of the resistor for showing the manufacturing processes.

By a sputtering method, plural pairs of first thin films 79 composed of thin chromium films having good bonding property against the substrate 71 are then formed, to constitute a part of side face electrodes, from the back side of sheet-form substrate 71 toward and over an entire back surface of the substrate 71 as well as side face portions of the substrate 71, side edges of the first upper surface electrode layers 72 and side edges of the bonding layers 77 located inside the plural slit-like first separations 78, as shown in FIGS. 27A and 28A.

Figure 27B:
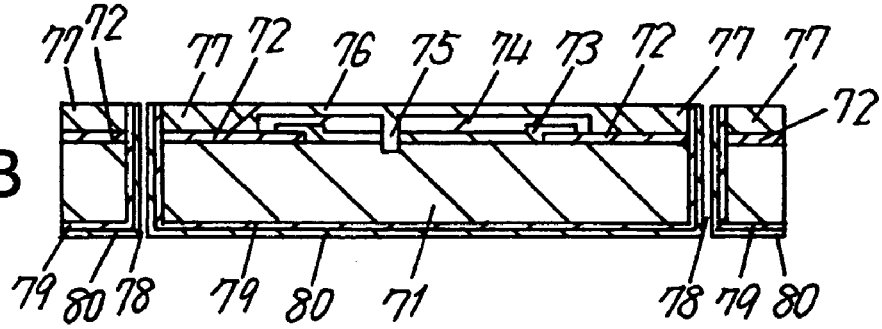
Figure 28B:
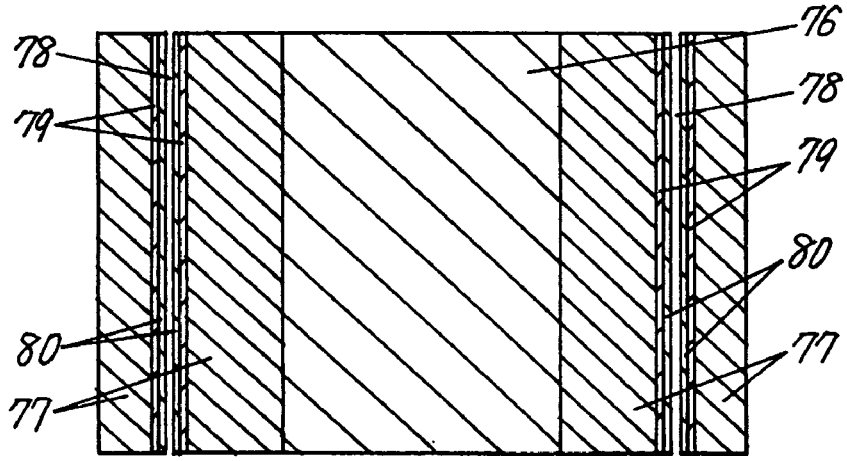

Next, by a sputtering method, plural pairs of second thin films 80 composed of thin copper-nickel alloy films are formed from the back side of sheet-form substrate 71 to constitute another part of side face electrodes on the plural pairs of first thin films 79 in an overlying manner as shown in FIGS. 27B and 28B.

Figure 27C:
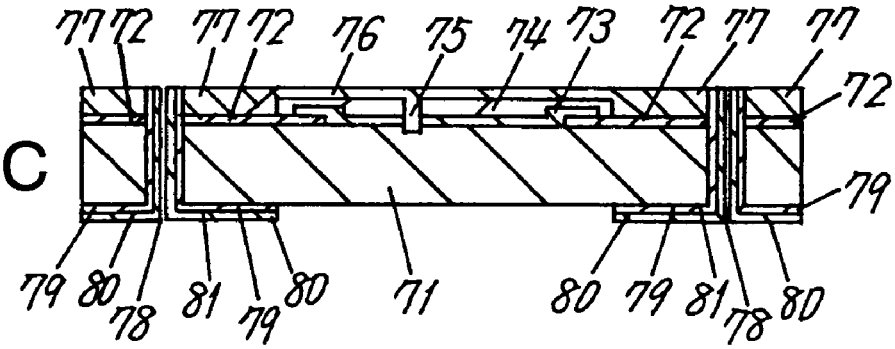
Figure 28C:
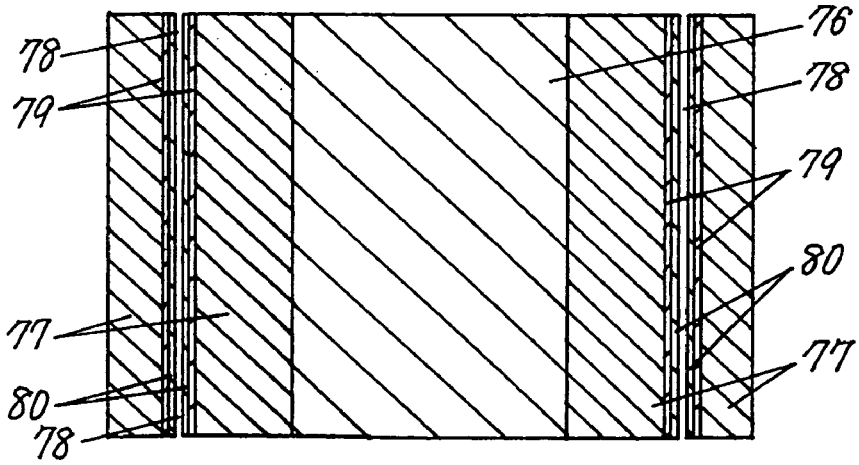

Next, plural pairs of back surface electrodes 81 are formed by removing unnecessary portions, i.e. generally the center portions, of the plural pairs of first thin films 79 and second thin films 80 formed on the entire back surface of the sheet-form substrate 71, as shown in FIGS. 27C and 28C, by evaporating them for approximately 0.3 mm wide by irradiation of laser beam having a spot diameter of approx. 0.3 mm.

Figure 29A:
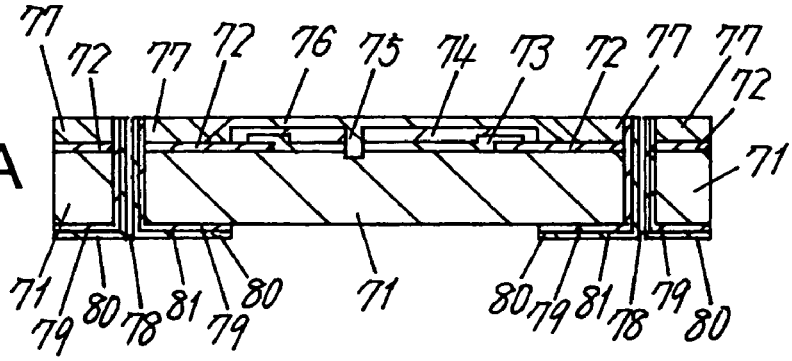
FIGS. 29A and 29B are sectional views of the resistor for showing the manufacturing processes.
Figure 30A:
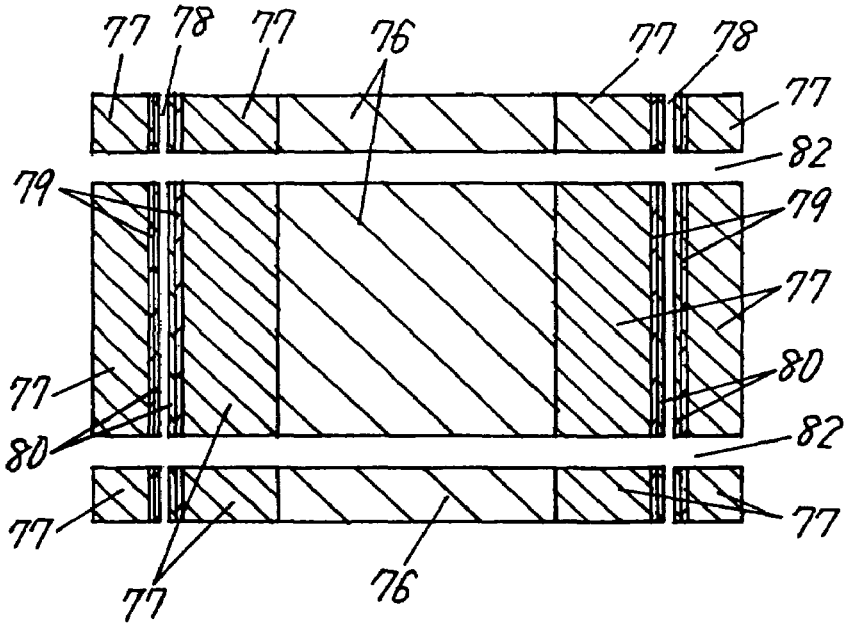
FIGS. 30A and 30B are plan views of the resistor for showing the manufacturing processes.

Next, plural second separations 82 in a direction orthogonal to the slit-like first separations 78 are formed, as shown in FIGS. 20, 29A and 30A, except for the void area 71*a* formed in the entire peripheral margin of the sheet-form substrate 71, so as to allow the resistor elements 73 formed on respective oblong substrates 71*b* of the sheet-form substrate 71 to be separable into a number of segment substrates 71*c*. In this instance, the second separations 82 are formed at a 400 μm pitch, and therefore, each of the second separations 82 has 100 μm in width. The second separations 82 are formed with a laser scriber through a first step of forming separation grooves with laser for, and splitting these separation groove portions with generally-available splitting equipment in the subsequent step of separating the oblong substrates into individual segment substrates 71*c*. In other words, this splitting method provides an advantage of separating the segment substrates 71*c* in the two steps, instead of separating them each and every time the second separations 82 are formed. In addition, since the plural second separations 82 are formed with a laser scriber only in the oblong substrates 71*b* excluding the void area 71*a*, the segment substrates 71*c* are separated individually when they are split along the second separations 82, and then separated from the void area 71*a*.

Figure 29B:
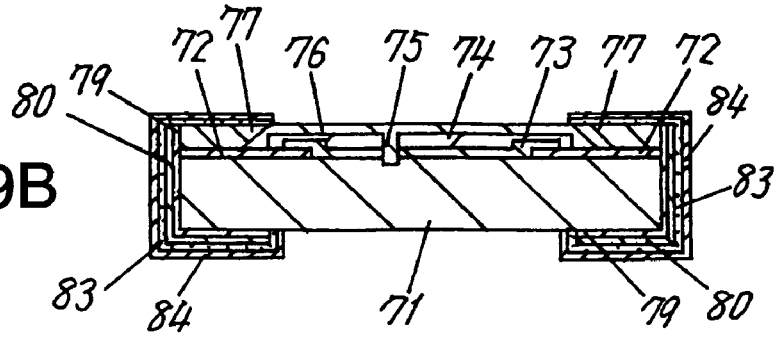
Figure 30B:
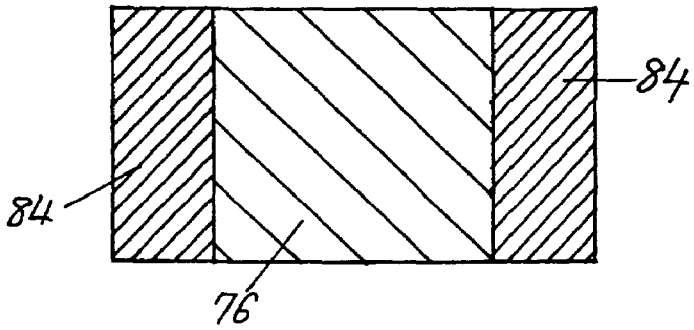

Finally, by an electroplating method, first plating films 83 of nickel plates having approximately 2 to 6 μm in thickness are formed over the second thin films 80 and exposed upper surfaces of the bonding layers 77 of the segment substrates 71*c*, as shown in FIGS. 29B and 30B. The films 83 have excellent properties in preventing flow of solder and in heat resistance. Then, by the electroplating method, second plating films 84 of tin plates having approximately 3 to 8 μm in thickness are formed for covering the first plating films 83 of nickel plates. The films 84 have excellent property in flow of solder.

The above manufacturing process yields the resistors of the second exemplary embodiment of this invention.

In the manufacturing process described above, tin plating is used to form the second plating films 84, but this is not restrictive. They can be formed by plating any tin-base alloy, such as solder and the like material. The second plating films 84 formed of such material can facilitate reliable soldering in the process of reflow soldering.

Moreover, in the above manufacturing process, the protective layer covering the resistor element 73 has a two-layer structure including first protective layer 74 composed mainly of glass over the resistor element 73 and second protective layer 76 composed mainly of resin covering the first protective layer 74 and trimming slit 75. This structure allows the first protective layer 74 to prevent the resistor from being cracked in the process of laser trimming so as to reduce current noises, and allow the second protective layer 76 of resin to ensure a resistance characteristic with good moisture-proof property since it covers the entire resistor element 73.

The above processes of manufacturing resistors according to the second exemplary embodiment of the invention differs from that of the first exemplary embodiment only in the order of forming the plural pairs of bonding layers 77 consisting of silver-base conductive resin, and all of the other processes unchanged. Thus, the above method provides practically the same advantages and effectiveness as those of the first exemplary embodiment of the invention.

Third Exemplary Embodiment

Referring to accompanying drawings, a resistor according to a third exemplary embodiment of the invention will be described.

Figure 31:
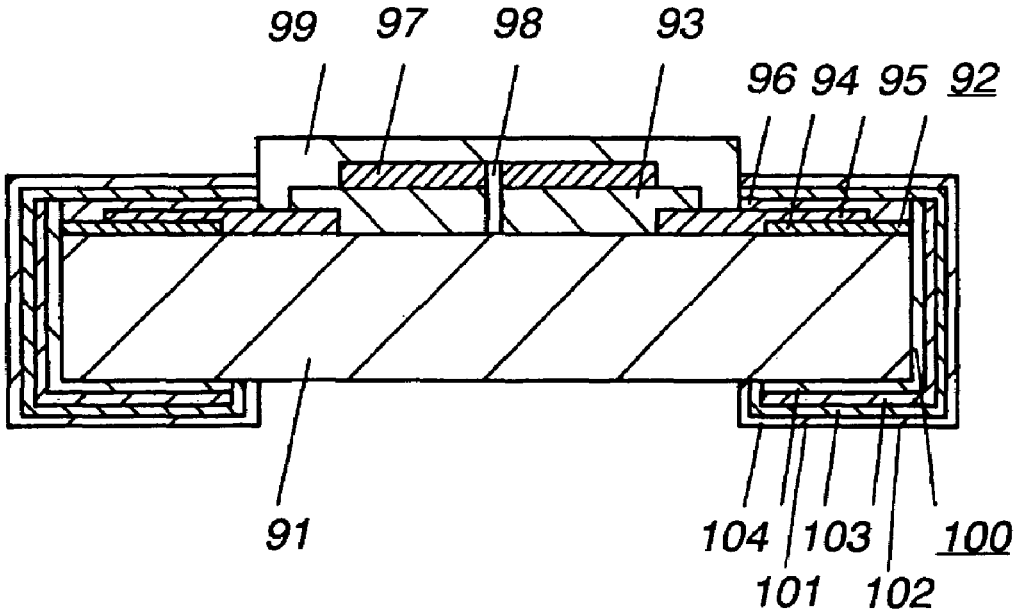
FIG. 31 is a sectional view of a resistor according to a third exemplary embodiment of the present invention.
Figure 32:
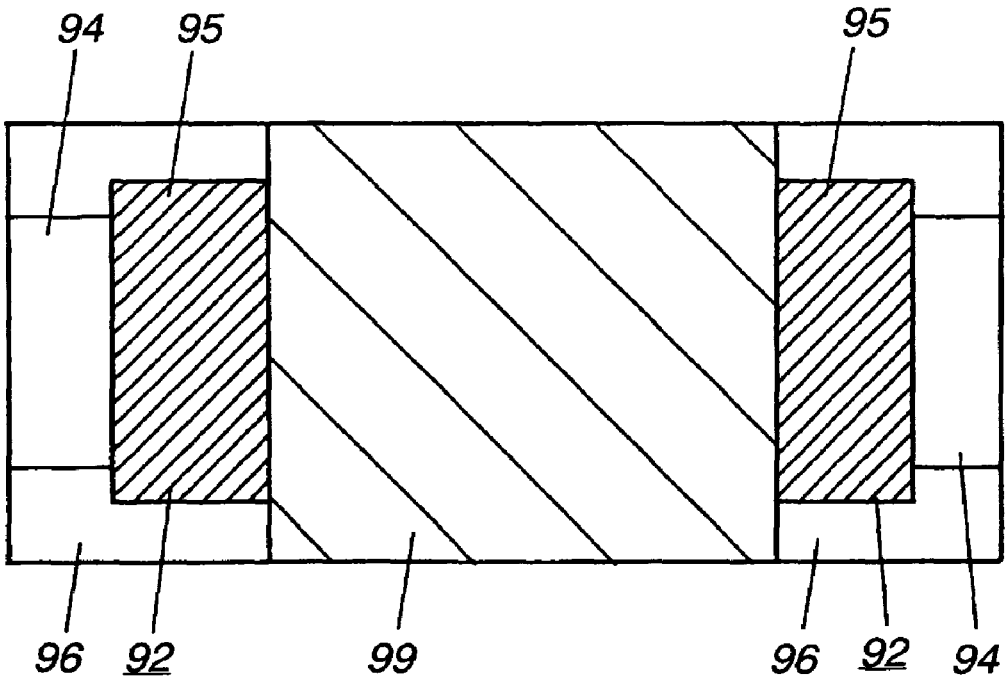
FIG. 32 is a plan view of the resistor having a side-face electrode excluded.

FIG. 31 is a sectional view of the resistor according to the third embodiment, and FIG. 32 is a plan view of the resistor having side face electrodes excluded.

The resistor according to the third exemplary embodiment of the invention includes a pair of upper surface electrodes 92 on an upper surface of substrate 91 and resistor element 93 between the pair of upper surface electrodes 92.

The upper surface electrode 92 provided on the upper surface of substrate 91 made of alumina and the like is constructed of a multi-layer structure including first upper surface electrode layer 94, second upper surface electrode layer 95 and bonding layer 96 in this order on the surface of substrate. Each first upper surface electrode layer 94 is formed from an edge at each side toward the center of the substrate 91 in a longitudinal direction thereof. The layer 94 is composed of gold-base electrode material for the purpose of providing at least an increased surface area of contact with a test probe during a process of adjustment (laser trimming) of a resistance. Each second upper surface electrode layer 95 is formed in a position slightly inward from the side edge of the substrate 91 and extending in the longitudinal direction toward the center of the substrate 91. A part of the layer 95 overlaps with one of first upper surface electrode layer 94. The second upper surface electrode layers 95 are composed of silver-base electrode and the like material. Further, each bonding layers 96 is formed in a position overlapping over corresponding ones of the first and second upper surface electrode layers 94 and 95, and it is flush with the first upper surface electrode layer 94 at the side edge of substrate 91. The bonding layers 96 are composed of silver, conductive resin or the like material for making good electrical connections of the upper surface electrodes 92 for side face electrodes, which will be discussed later. In this instance, the bonding layer 96 has the maximum height in a direction of its thickness is greater than that of the first upper surface electrode layer 94 in order to increase surface areas of contact between the side face electrodes and the upper surface electrodes 92.

Resistor element 93 is formed in a position bridging the pair of upper surface electrodes 92, and is composed of ruthenium oxide and the like material. In this embodiment, the resistor element 93 preferably makes electrical connections only with the second upper surface electrode layers 95 of the upper surface electrodes 92 to maintain good ohmic contacts, thereby achieving a highly reliable resistor with constancy in resistance value.

For adjusting the resistance to a desired value, the resistor element 93 is then provided on the upper surface thereof with first protective layer 97 composed of glass and the like, and then has its resistance adjusted by forming trimming slit 98 in the first protective layer 97 and the resistor element 93 by laser irradiation and the like. Then, the resistor is provided with second protective layer 99 composed of resin, glass or the like material covering at least the resistor element 93, which overlies and bridges the pair of second upper surface electrode layers 95 of the upper surface electrodes 92, or more preferably to cover all of the resistor element 93, first protective layer 97 and the trimmed slit 98.

The substrate 91 is also provided with a pair of side face electrodes 100 formed substantially in a squared-U-shape wrapping around side faces of the substrate 91 and to make electrical connections with the upper surface electrodes 92. Each side face electrode 100 is constructed of a multi-layer structure including first thin film 101, second thin film 102, first plating film 103, and second plating film 104 formed in this order on the side face of the substrate 91. The first thin films 101 are formed of one of chromium, chromium-base alloy film, titanium, titanium-base alloy film, and nickel-chromium alloy film, all of which has good bonding property against the substrate 91. The film 101 is formed from the back surface to the side faces of substrate 91 substantially in an L-shape by film-forming techniques as sputtering, vacuum evaporation, ion plating, and P-CVD methods. The second thin films 102 are formed of copper-base alloy film from the back surface to the side faces of substrate 91 substantially in an L-shape to overlap with the first thin films 101 to be in electrical connection thereto, by the film-forming techniques as sputtering, vacuum evaporation, ion plating, and P-CVD methods.

The first plating films 103 are formed by nickel plating having excellent property to prevent flow of solder or heat resistance to cover exposed surfaces of the upper surface electrodes 92 and the second thin films 102. Furthermore, the second plating films 104 are formed by tin plating having good bonding property with solder, to cover the first plating films 103.

Referring to accompanying drawings, a method of manufacturing the resistor constructed as above according to the third exemplary embodiment of the invention will be described.

Figure 33:
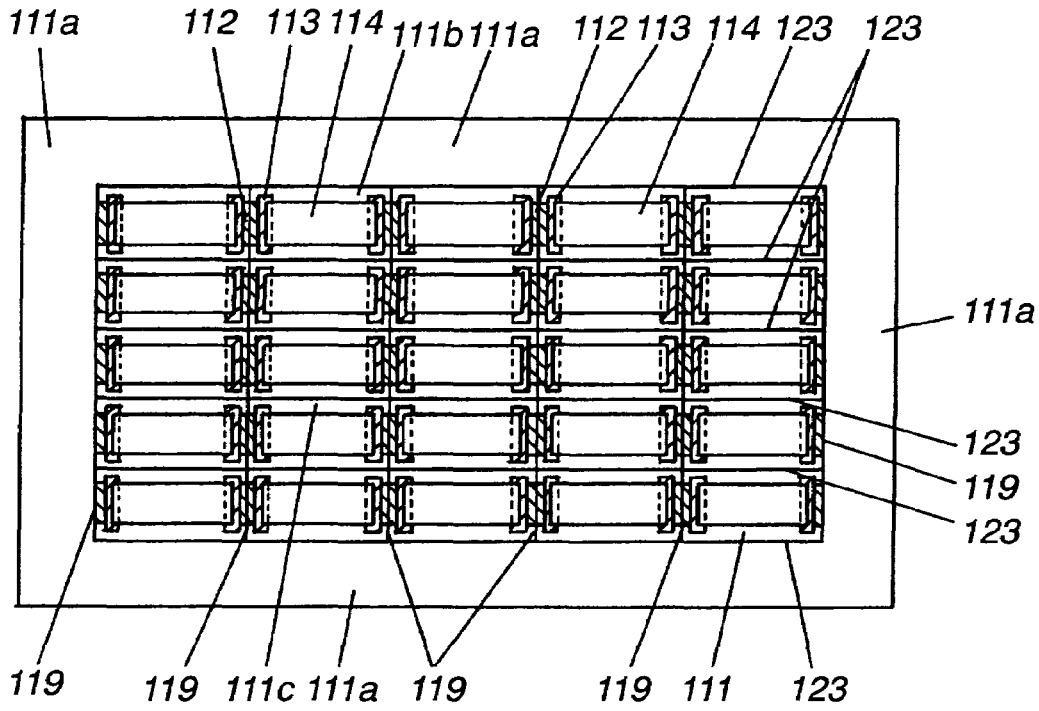
FIG. 33 is a plan view of a sheet-form substrate for use in manufacturing the resistor, wherein a void area is formed in the entire peripheral margin of the substrate.

FIG. 33 is a plan view of a sheet-form substrate for use in manufacturing the resistor of the third exemplary embodiment of this invention, in which a void area is formed in the entire peripheral margin of the substrate. FIGS. 34A, 34B, 36A, 36B, 38A, 38B, 40A, 40B, 42A, 42B, 44, 46A, 46B, 48A and 48B are sectional views illustrating sequential processes of manufacturing the resistor according to the third exemplary embodiment of this invention. FIGS. 35A, 35B, 37A, 37B, 39A, 39B, 41A, 41B, 43A, 43B, 45, 47A, 47B, 49A and 49B are plan views illustrating the sequential processes of manufacturing the resistor according to the third exemplary embodiment of this invention.

Figure 34A:
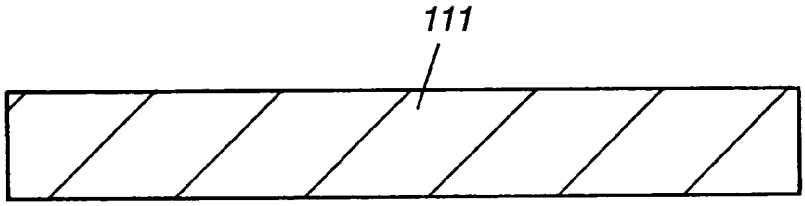
FIGS. 34A and 34B are sectional views of the resistor for showing processes for manufacturing the resistor.
Figure 35A:
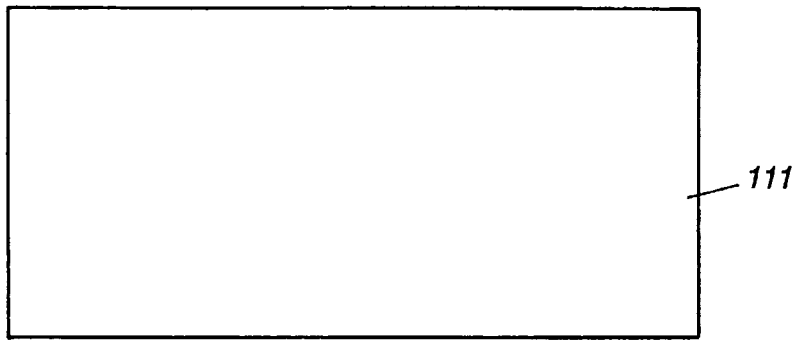
FIGS. 35A and 35B are plan views of the resistor for showing the manufacturing processes.

First, sheet-form substrate 111 of 0.2 mm thick made of sintered 96% alumina having insulating property is prepared, as shown in FIGS. 33, 34A and 35A. In this embodiment, the sheet-form substrate 111 includes void area 111*a* around the entire peripheral margin, as shown in FIG. 33, which does not yield any product in the end. The void area 111*a* is formed substantially in a square shape.

Figure 34B:
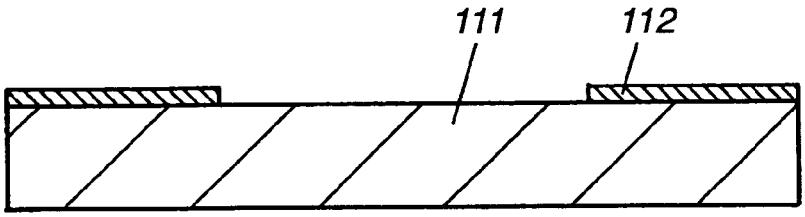
Figure 35B:
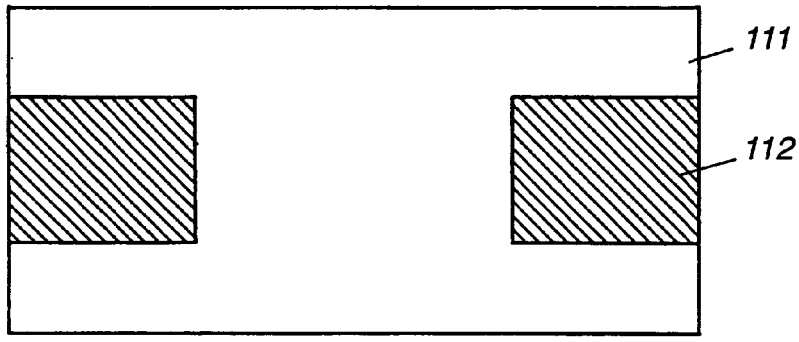

Next, as shown in FIGS. 33, 34B and 35B, plural pairs of first upper surface electrode layers 112 composed of gold-base resinate are formed on an upper surface of the sheet-form substrate 111 by a screen printing method. Then, the first upper surface electrode layers 112 are sintered according to a sintering profile of 850° C. as a peak temperature to be made stable.

Figure 36A:
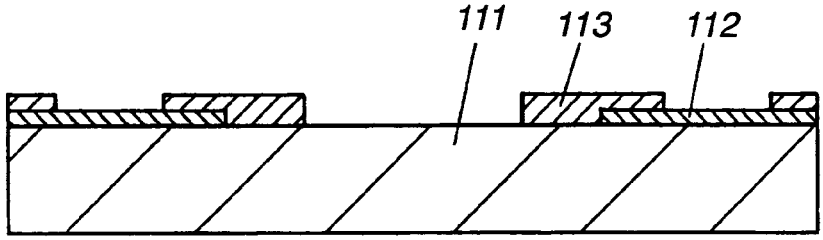
FIGS. 36A and 36B are sectional views of the resistor for showing the manufacturing processes.
Figure 37A:
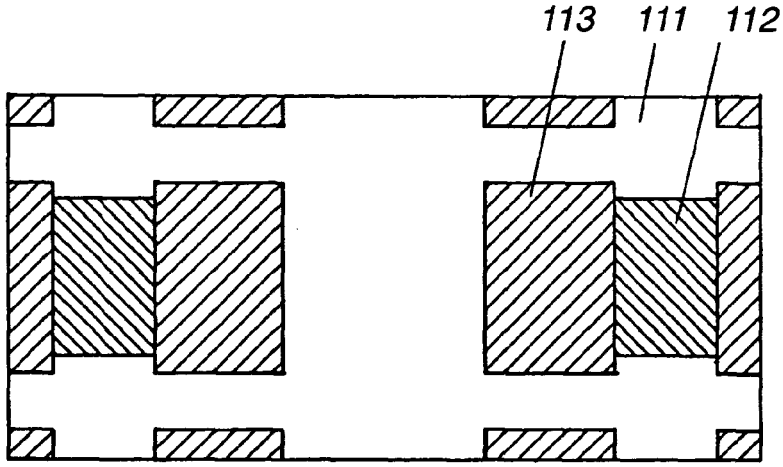
FIGS. 37A and 37B are plan views of the resistor for showing the manufacturing processes.

Plural pairs of second upper surface electrode layers 113 made mainly of silver on the upper surface of the sheet-form substrate 111 are formed by a screen printing method in positions overlapping at least a part of the corresponding one of the first upper surface electrode layers 112, as shown in FIGS. 33, 36A and 37A. Then, the second upper surface electrode layers 113 is made stable by sintering according to a sintering profile of 850° C. as a peak temperature.

Figure 36B:
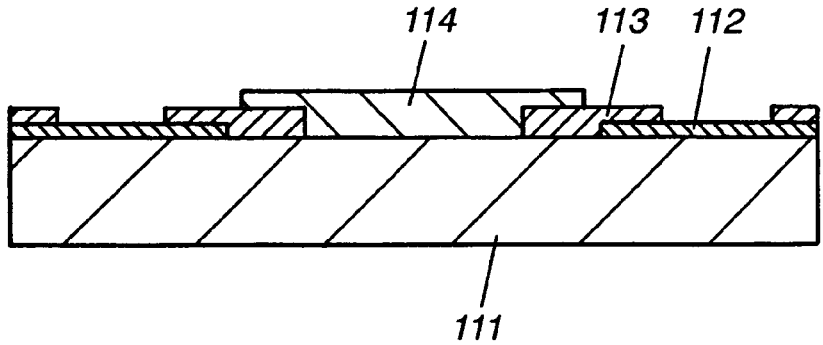
Figure 37B:
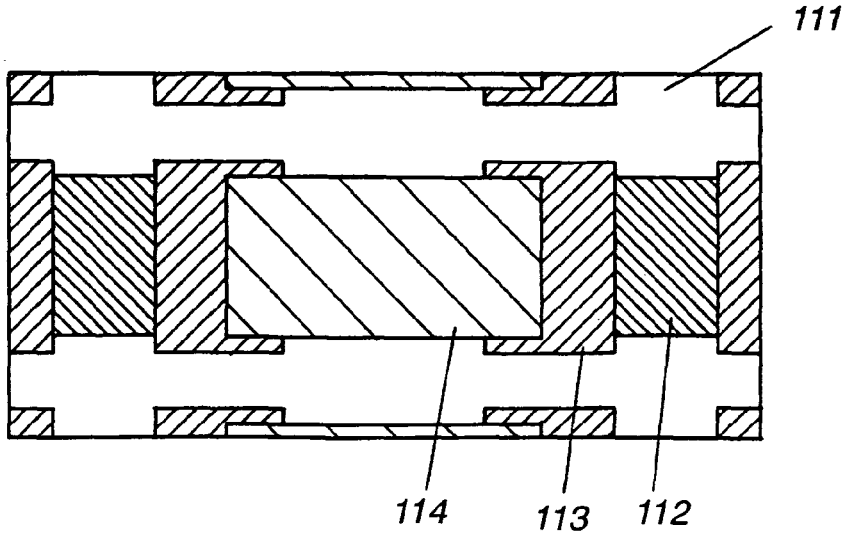

Next, plural resistor elements 114 composed of ruthenium oxide-base material are formed by a screen printing method in such positions that each of them bridges one of the plural pairs of second upper surface electrode layers 113, as shown in FIGS. 33, 36B and 37B. Then, the resistor elements 114 are made stable by sintering according to a sintering profile of 850° C. as a peak temperature.

Figure 38A:
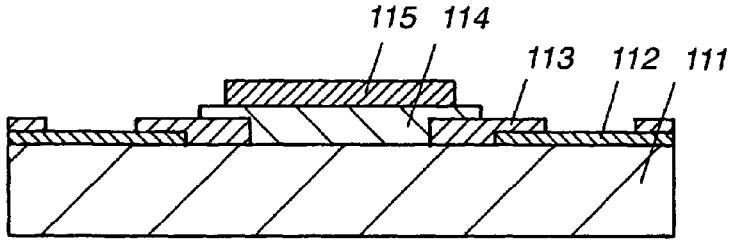
FIGS. 38A and 38B are sectional views of the resistor for showing the manufacturing processes.
Figure 39A:
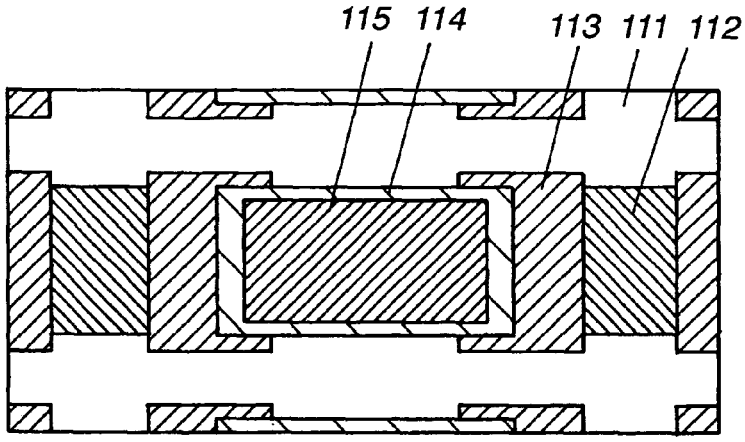
FIGS. 39A and 39B are plan views of the resistor for showing the manufacturing processes.

Next, plural first protective layers 115 containing mainly glass by a screen printing method in a manner that each covers each resistor element 114, as shown in FIGS. 38A and 39A. Then, the first protective layers 115 made mainly of glass are made stable by sintering according to a sintering profile of 600° C. as a peak temperature.

Figure 38B:
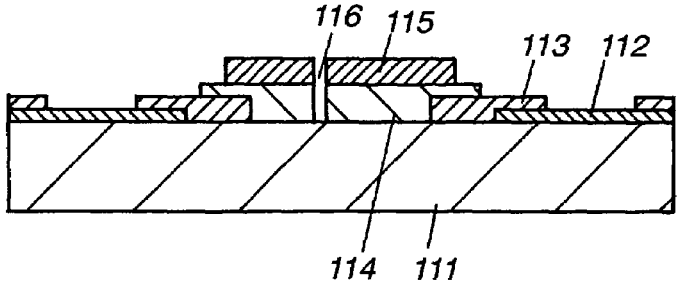
Figure 39B:
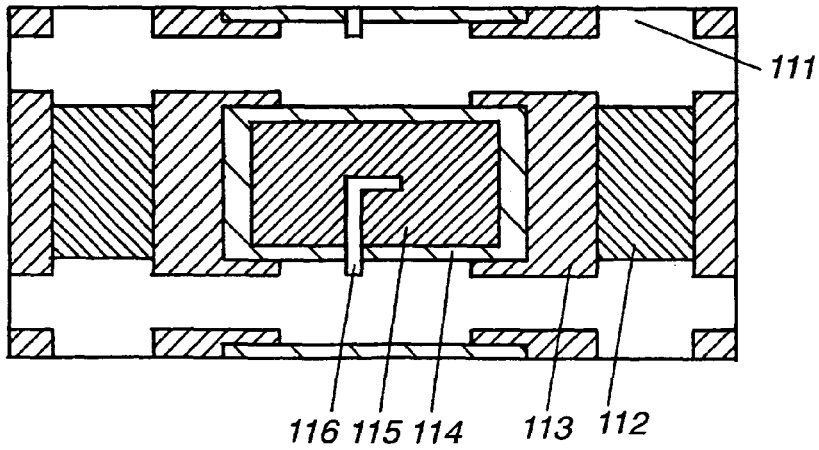

By a laser trimming method, the resistor elements 114 between the plural pairs of second upper surface electrode layers 113 are trimmed to form plural trimming slits 116, as shown in FIGS. 38B and 39B, to adjust their resistances to a predetermined value.

Figure 40A:
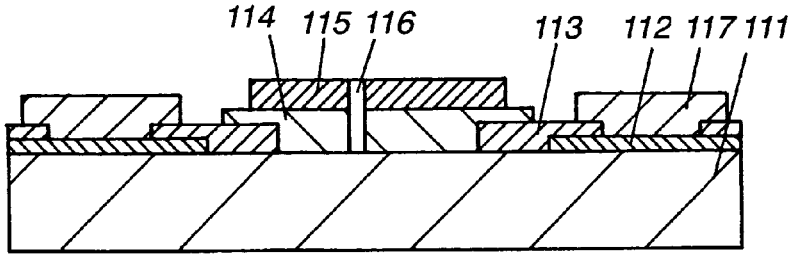
FIGS. 40A and 40B are sectional views of the resistor for showing the manufacturing processes.
Figure 41A:
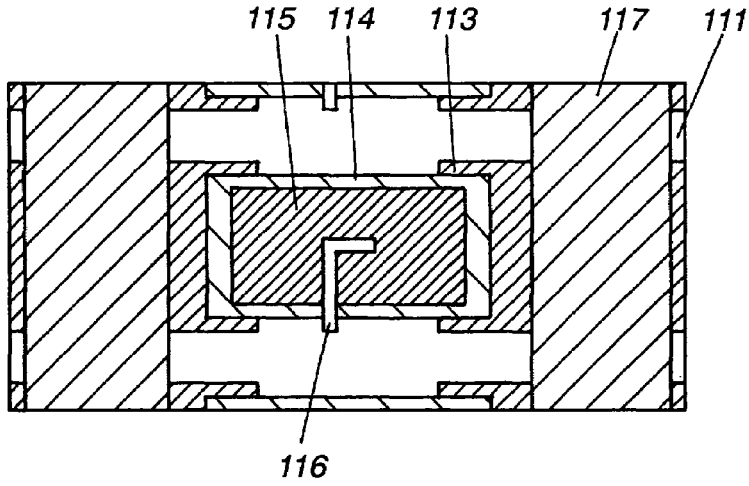
FIGS. 41A and 41B are plan views of the resistor for showing the manufacturing processes.

Next, plural pairs of bonding layers 117 composed of silver-base conductive resin area formed by a screen printing method in such positions that each of them overlaps a part of respective one of the plural pairs of first upper surface electrode layers 112 as well as a part of respective one of the second upper surface electrode layers 113, as shown in FIGS. 40A and 41A. Then, the bonding layers 117 are made stable by hardening according to a hardening profile of 200° C. as a peak temperature.

Figure 40B:
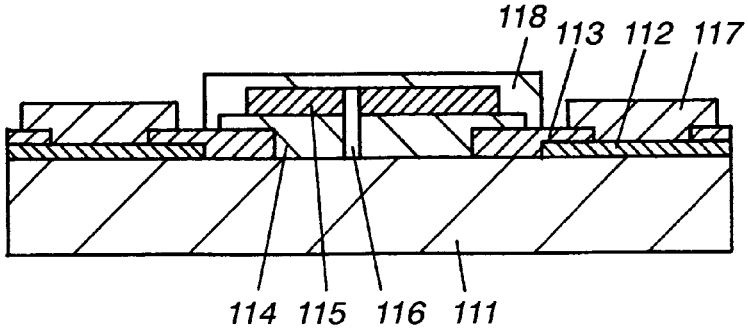
Figure 41B:
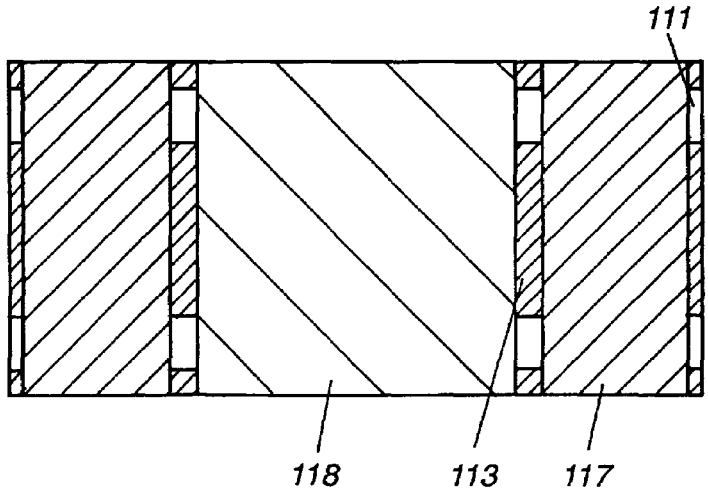

Next, as shown in FIGS. 40B and 41B, by a screen printing method, plural second protective layers 118 made mainly of resin for covering the plural first protective layers 115, which consist mainly of glass are formed along a vertical direction in the figures. The layers 118 cover partially the resistor elements 114 and the second upper surface electrode layers 113. Then, the second protective layers 118 are made stable by hardening according to a hardening profile of 200° C. as a peak temperature.

Figure 42A:
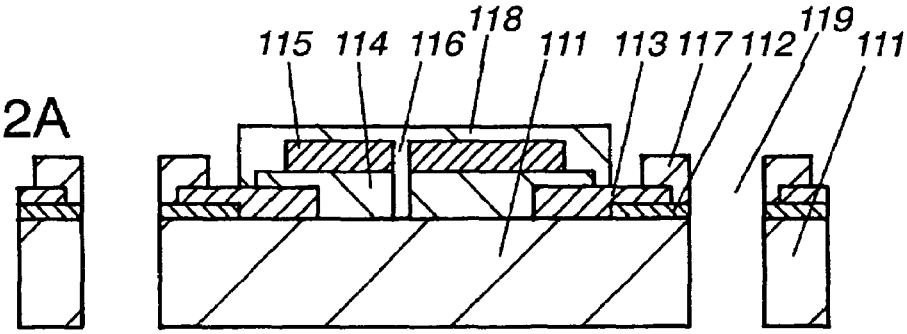
FIGS. 42A and 42B are sectional views of the resistor for showing the manufacturing processes.
Figure 43A:
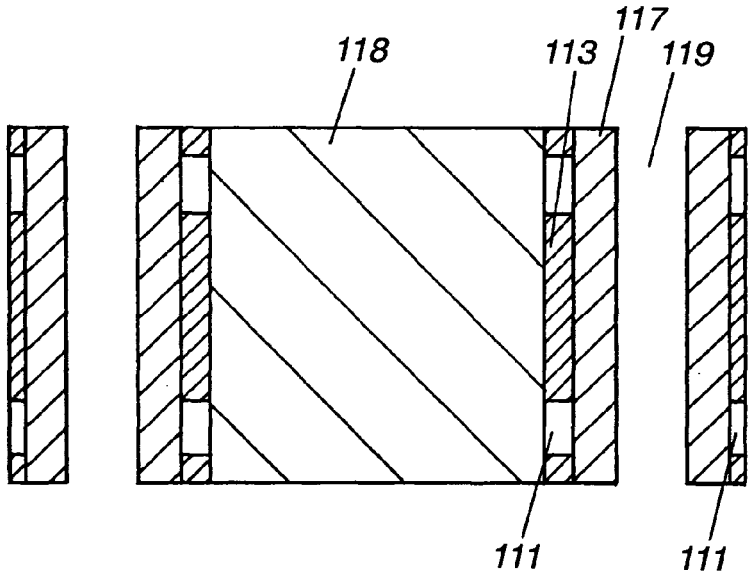
FIGS. 43A and 43B are plan views of the resistor for showing the manufacturing processes.

Next, plural slit-like first separations 119 are formed by a dicing method in the sheet-form substrate 111 having the second protective layers 118 except the void area 111*a* formed in the entire peripheral margin of the substrate 111, as shown in FIGS. 33, 42A and 43A, to separate the plural pairs of first upper surface electrode layers 112 and bonding layers 117, and to obtain plural oblong substrates 111*b*. In this instance, the slit-like first separations 119 are formed at a 700 μm pitch, and each first separation 119 is 120 μm wide. The slit-like first separations 119 are formed into slit openings cut through the sheet-form substrate 111 in a direction of its thickness. In addition, the sheet-form substrate 111 keeps its original sheet-like shape even after the slit-like first separations 119 are formed since the slit-like first separations 119 are formed by the dicing method only in an area excluding the void area 111*a* so as to allow the plural oblong substrates 111*b* to communicate with each other at the void area 111*a*.

Figure 42B:
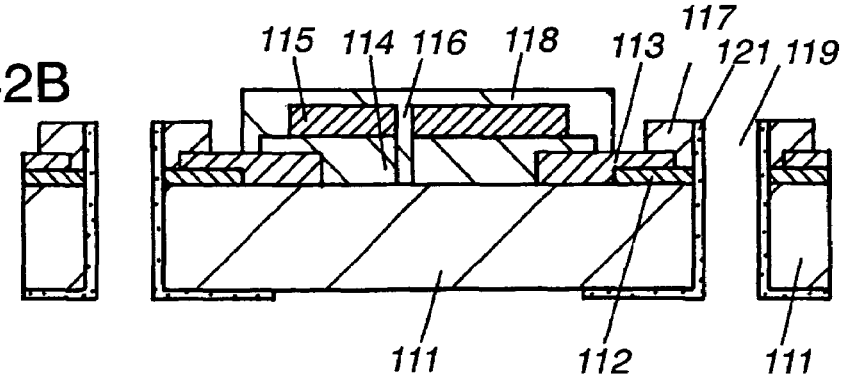
Figure 43B:
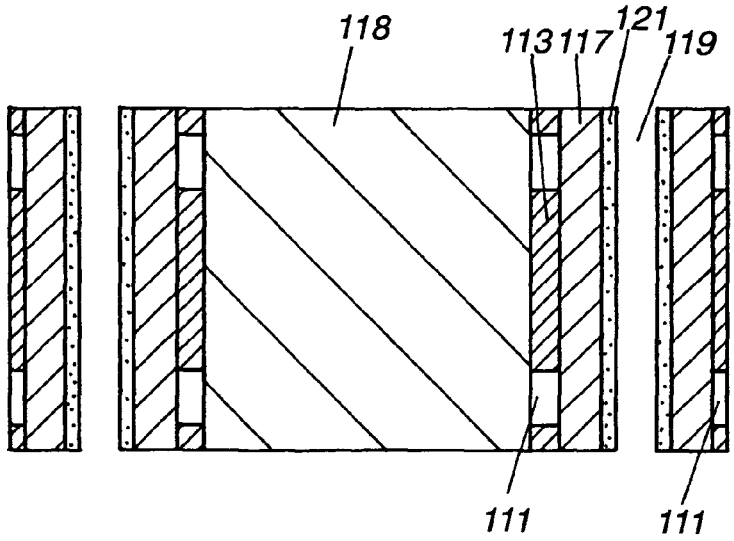

Then, plural pairs of first thin films 121 composed of thin chromium films having good bonding property against the substrate 111 are formed from the back side of sheet-form substrate 111 by a sputtering method using a mask (not shown in the figures). The films 121 constitute parts of side face electrodes 120 over parts of a back surface as well as side face portions of the substrate 111, side edges of the first upper surface electrode layers 112, and side edges of the bonding layers 117 located inside the plural slit-like first separations 119. The films 121 are formed substantially in an L-shape, as shown in FIGS. 42B and 43B.

Figure 44:
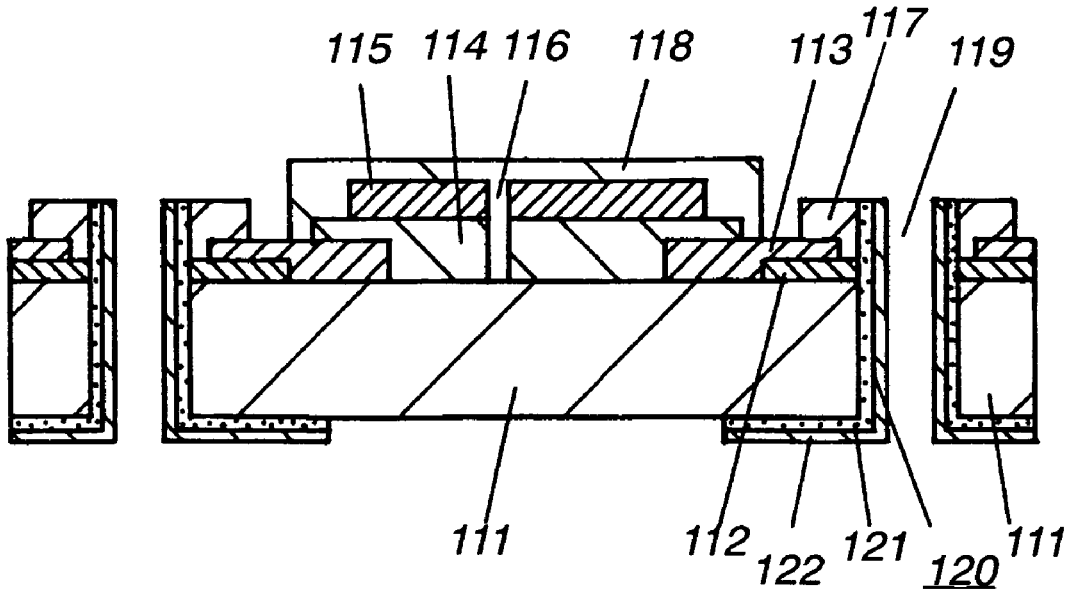
FIG. 44 is a sectional view of the resistor for showing the manufacturing processes.
Figure 45:
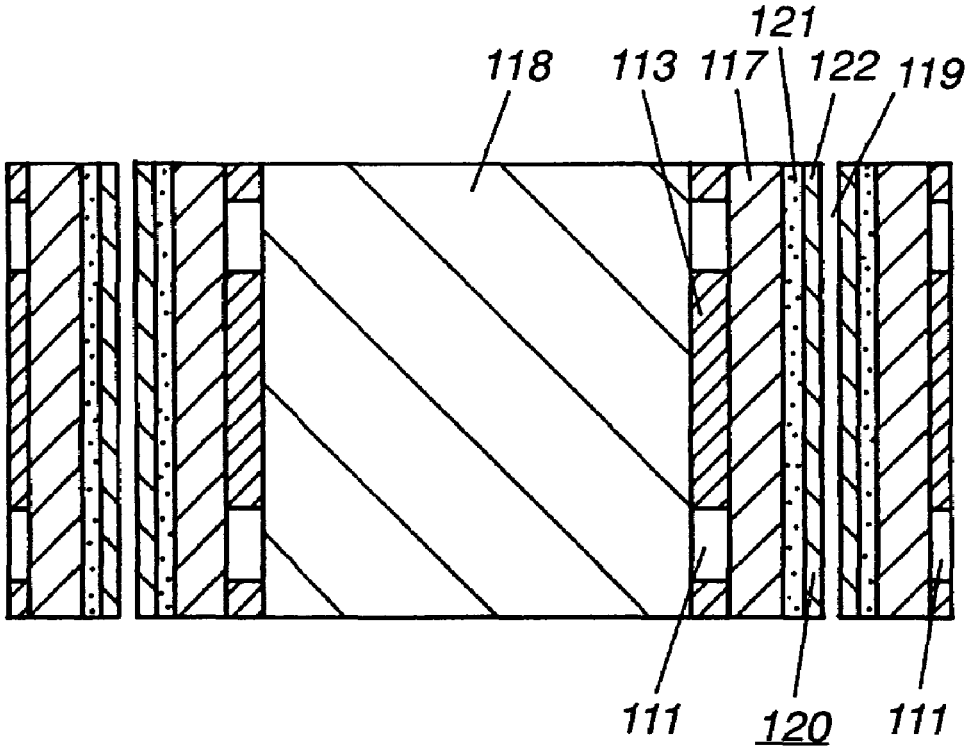
FIG. 45 is a plan view of the resistor for showing the manufacturing processes.

Next, plural pairs of second thin films 122 composed of thin copper-nickel alloy films are formed from the back side of sheet-form substrate 111 by a sputtering method using a mask (not shown in the figures). The films 122 constitute other parts of side face electrodes 120 over the plural pairs of first thin films 121 in an overlying manner as shown in FIGS. 44 and 45.

Figure 46A:
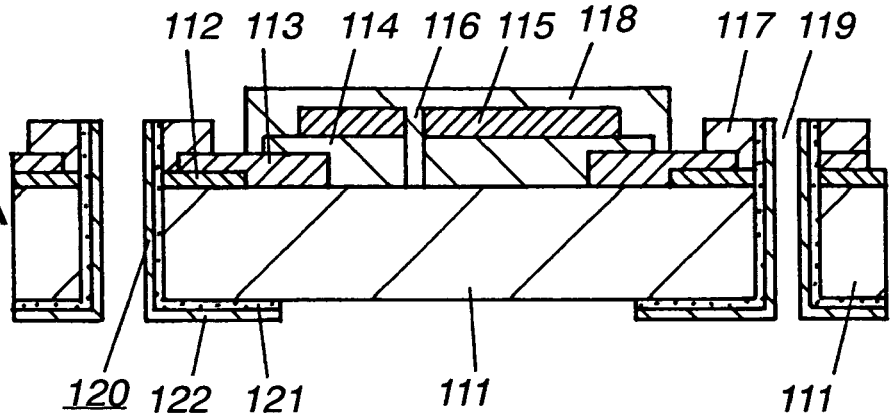
FIGS. 46A and 46B are sectional views of the resistor for showing the manufacturing processes.
Figure 46B:
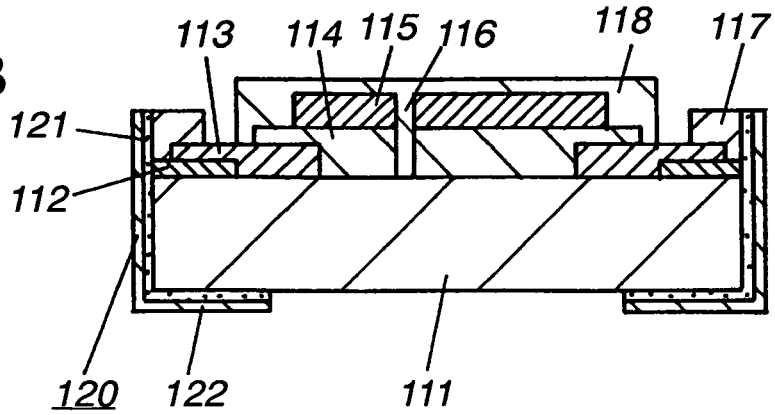
Figure 47A:
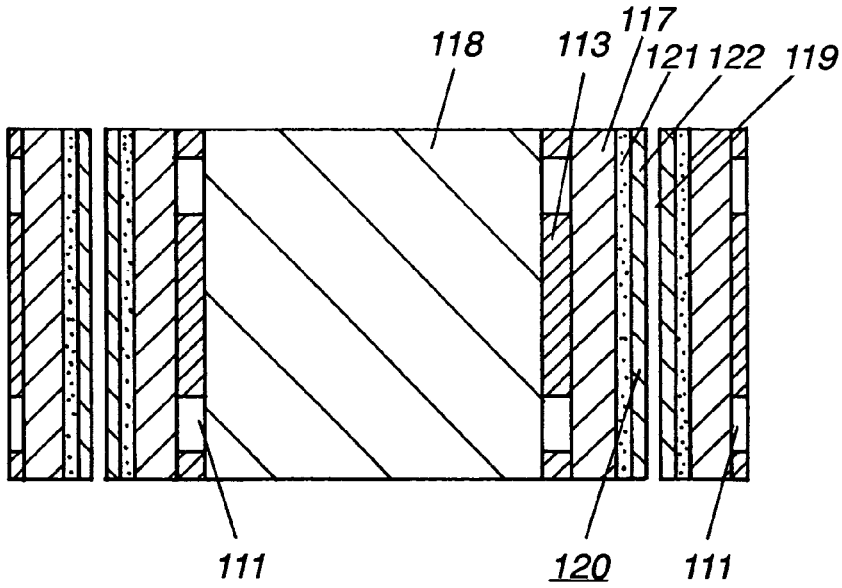
FIGS. 47A and 47B are plan views of the resistor for showing the manufacturing processes
Figure 47B:
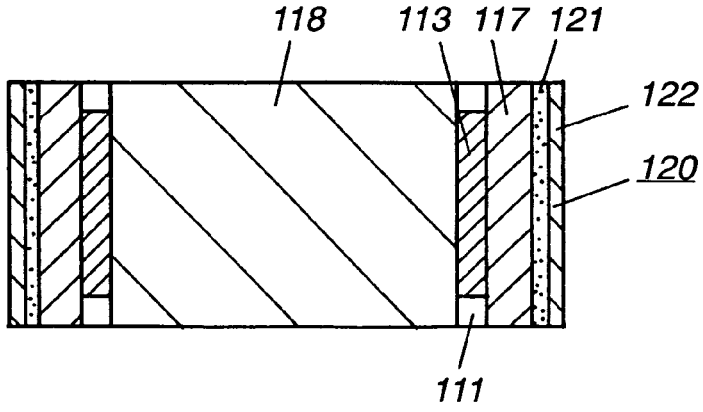

Subsequently, plural second separations 123 are formed in a direction orthogonal to the slit-like first separations 119 except for the void area 111*a* formed in the entire peripheral margin of the sheet-form substrate 111, as shown in FIGS. 33, 46A, 46B, 47A and 47B so as to dispose each resistor element 114 on each oblong substrate 111*b* of the sheet-form substrate 111 separable into a number of segment substrates 111*c*. In this instance, the second separations 123 are formed at a 400 μm pitch, and therefore, each second separation 123 has 100 μm width. The plural second separations 123 are formed with a laser scriber as a first step of forming separation grooves with the laser, as shown in FIGS. 46A and 47A, and the separation groove portions are split with generally-available splitting equipment in the subsequent step of separating the oblong substrates into segment substrates 111*c*, as shown in FIGS. 46B and 47B. In other words, the splitting method provides an advantage of separating the segment substrates 111*c* in the two steps, instead of separating them each and every time the second separations 123 are formed. In addition, since the second separations 123 are formed with a laser scriber only in the oblong substrates 111*b* excluding the void area 111*a*, the segment substrates 111*c* are separated when they are split along the second separations 123, and then separated from the void area 111*a*.

Figure 48A:
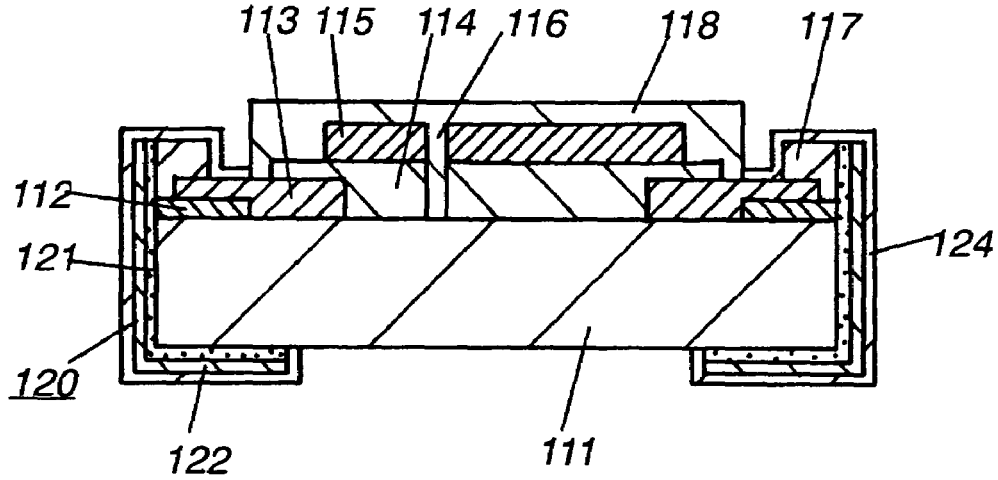
FIGS. 48A and 48B are sectional views of the resistor for showing the manufacturing processes
Figure 49A:
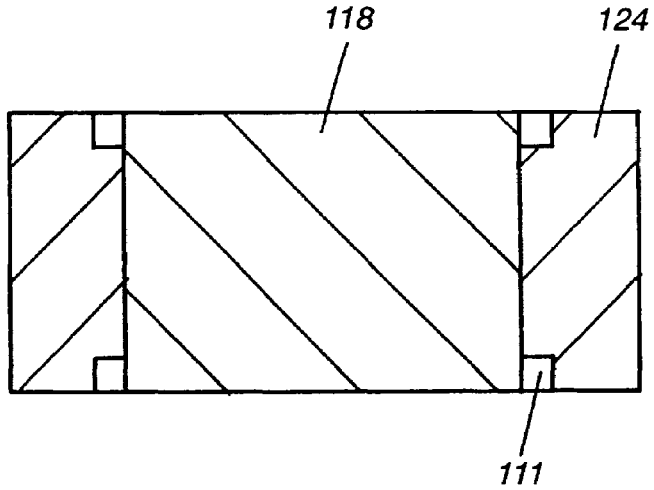
FIGS. 49A and 49B are plan views of the resistor for showing the manufacturing processes

Then, by an electroplating method, first plating films 124 of nickel plates having approximately 2 to 6 μm thickness and excellent properties in preventing flow of solder and in heat resistance are formed for covering the second thin films 122 constituting parts of side face electrodes 120, exposed side surfaces of the bonding layers 117 and upper surfaces of the second upper surface electrode layers 113, as shown in FIGS. 48A and 49A.

Figure 48B:
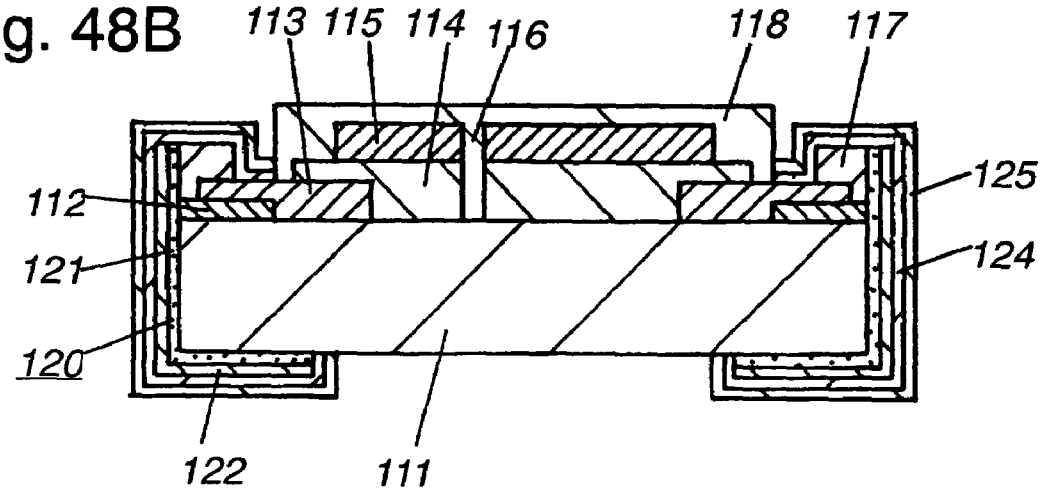
Figure 49B:
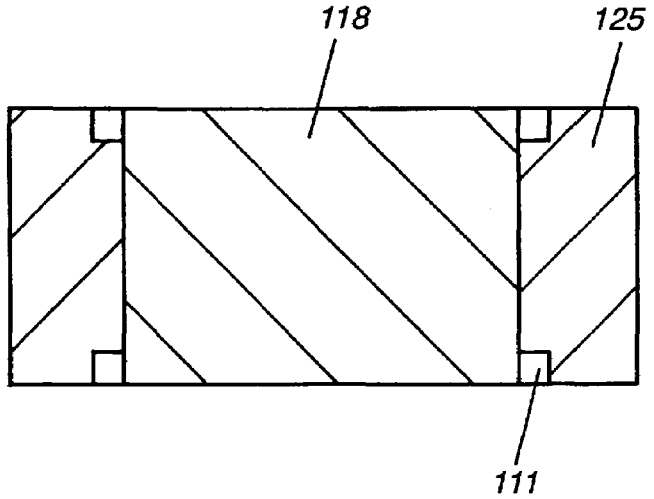

Finally, by an electroplating method, second plating films 125 of tin plates having approximately 3 to 8 μm thickness and excellent property in flow of solder are formed for covering the first plating films 124 of nickel plates as shown in FIGS. 48B and 49B.

The above manufacturing process produces the resistors of the third exemplary embodiment of the invention.

In the manufacturing process described above, although tin plating is used to form the second plating films 125, this is not restrictive, and they can be formed by plating any tin-base alloy, such as solder and the like material. The second plating films 125 formed of such material can facilitate reliable soldering in the process of reflow soldering.

Moreover, in the above manufacturing process, the protective layer covering the resistor element 114 has a two-layer structure including first protective layer 115 composed mainly of glass over the resistor element 114 and second protective layer 118 composed mainly of resin covering the first protective layer 115 and trimming slit 116. This structure allows the first protective layer 115 to prevent the resistor from being cracked in the process of laser trimming so as to reduce current noises, and allows the second protective layer 118 of resin to ensure a resistance characteristic with good moisture-proof property since it covers the entire resistor element 114.

Furthermore, the resistors manufactured in the above manufacturing process have high accuracy (±0.005 mm or less) in dimension of intervals of the slit-like first separations 119 formed by the dicing method and the second separations 123 formed with the laser scriber. In addition, the resistors as final products have overall length and width of 0.6 mm by 0.3 mm accurately since all of the first thin films 121, second thin films 122, first plating films 124, and second plating films 125 constituting the side face electrodes 120 can be formed precisely in their thickness. Moreover, since pattern sizes of the first upper surface electrode layers 112 and the resistor elements 114 are so accurate that dimensional ranking of the segment substrates is not required, nor is it required to consider dimensional variations within the same dimensional rank of the segment substrates. As a result, the resistor has a larger effective area of the resistor elements 114 than the conventional resistor. In other words, while resistor elements of the conventional resistor have dimensions of approximately 0.20 mm long by 0.19 mm wide, resistor elements 114 of the resistors according to the third exemplary embodiment of the invention is measured approximately 0.25 mm long by 0.24 mm wide, which is about 1.6 times greater in the surface area.

In addition, in the above manufacturing process, the plural slit-like first separations 119 are formed by the dicing method in the sheet-form substrate 111, which does not require dimensional ranking of the segment substrates. Accordingly, a complex process in the production of the conventional resistor can be eliminated by avoiding the dimensional ranking of the segment substrates. It also facilitates the dicing process, which can be carried out easily with the conventional dicing equipment.

Moreover, in the above manufacturing process, void area 111*a*, which does not become products in the end, is formed around the entire peripheral margin of the sheet-form substrate 111, and the first separations 119 are formed in a manner that the plural oblong substrates 111*b* communicate with each other at the void area 111*a*. Since the oblong substrates 111*b* communicate at the void area 111*a* even after the first separations 119 are formed, the oblong substrates 111*b* do not come apart from the sheet-form substrate 111. This can thus facilitate the subsequent process of the sheet-form substrate 111 with the void area 111*a* kept integral after the process of forming the first separations 119, thereby simplifying the manufacturing process.

Furthermore, in the manufacturing process above, although the first thin films 121 and the second thin films 122 that constitute the side face electrodes 120 are formed by the sputtering method using a mask (not shown in the figures), the process is not limited to it. Back side portions of the side face electrodes 120 may be formed without the mask (not shown in the figures). For example, the films may be formed by forming thin films over the entire back surface of a sheet-form substrate by the sputtering method, and by removing unnecessary portions of the thin films formed on the entire back surface, i.e. generally the center portions on the back surface of the sheet-form substrate, by evaporating them with laser irradiation.

Although the second thin films 122 described above were formed with thin films of copper-base alloy, the films may preferably be thin films of copper-nickel alloy among a number of like materials. This arrangement is already been discussed in detail in the first exemplary embodiment of the invention.

In the third exemplary embodiment of the invention, the sputtering method to form the first thin films 121 and the second thin films 122 is described, but the method is not limited only to the sputtering method. Similar advantage and effect as those of the third exemplary embodiment of the invention are also obtainable even if first thin films 121 and second thin films 122 are formed by other film-forming techniques, such as vacuum evaporation method, ion plating method, P-CVD method, and the like.

According to the third exemplary embodiment of the invention, the first thin films 121 are made of thin chromium films, but they are not limited only to the chromium films. Similar advantage and effect as those of the third exemplary embodiment of this invention are obtainable even if first thin films 121 are formed of other material having large bonding property against the substrate, such as chromium-silicon alloy films, nickel-chromium alloy films, titanium films, titanium-base alloy films and the like.

Figure 50:
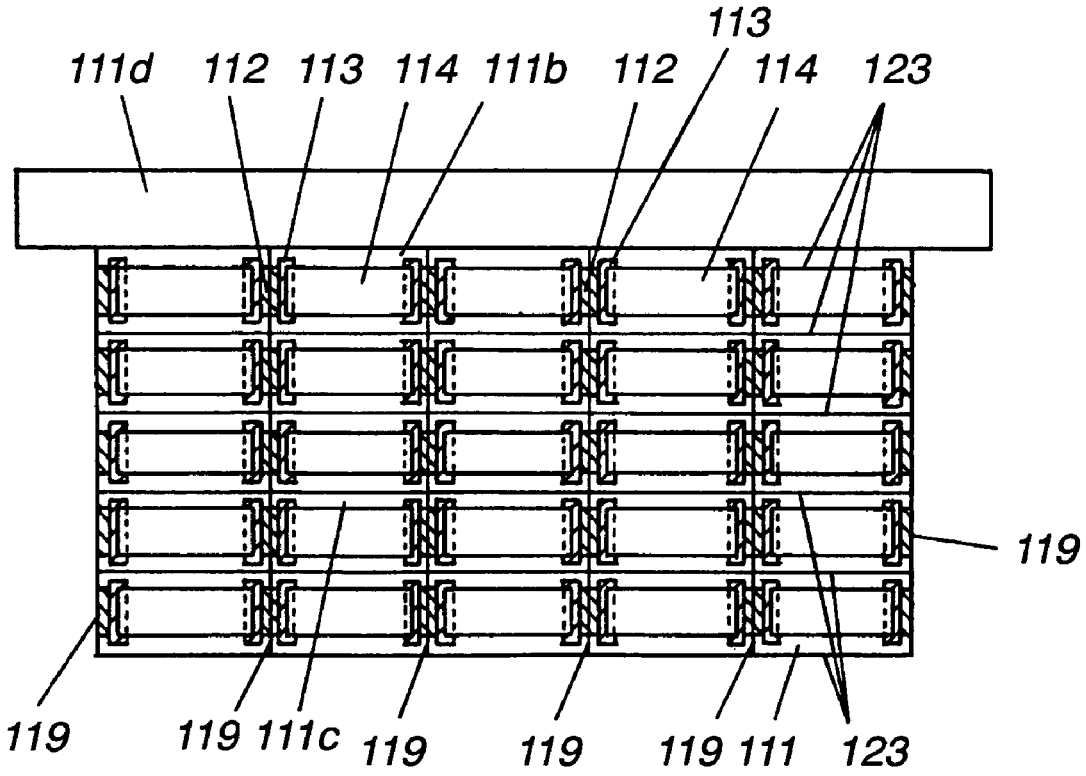
FIG. 50 is a plan view of a sheet-form substrate for use in manufacturing the resistor, wherein a void area is formed at one side of the substrate.
Figure 51:
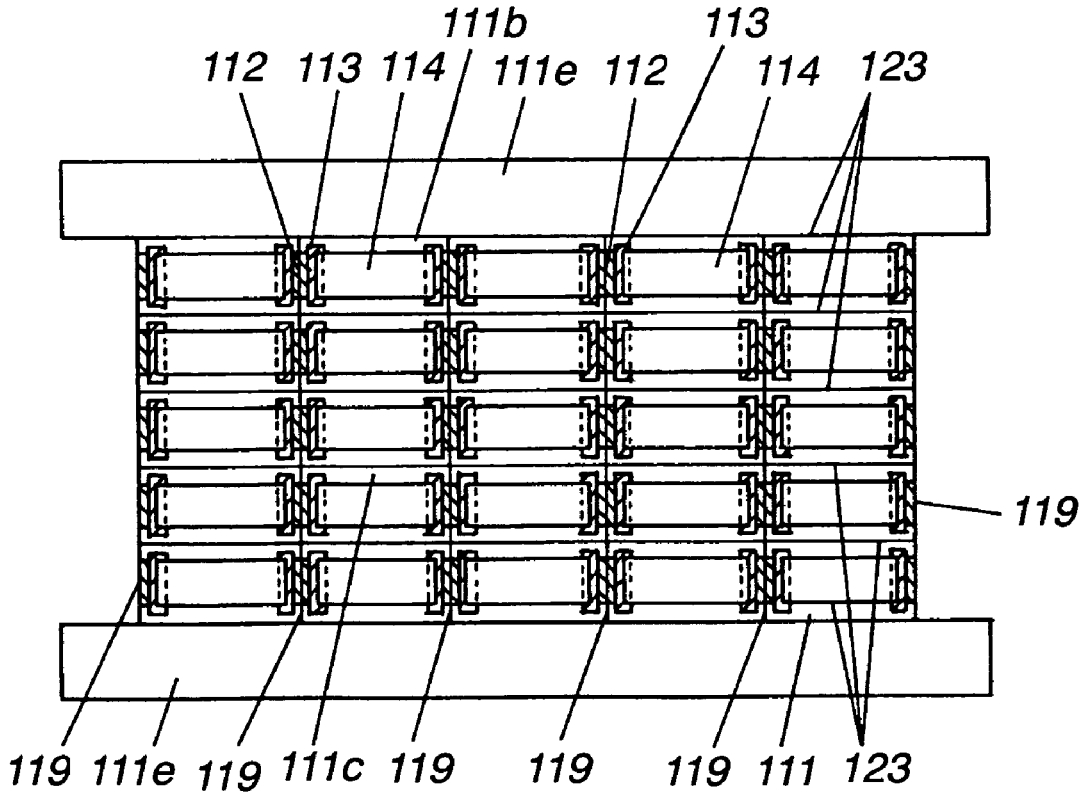
FIG. 51 is a plan view of another sheet-form substrate for use in manufacturing the resistor, wherein void areas are formed at both sides of the substrate.
Figure 52:
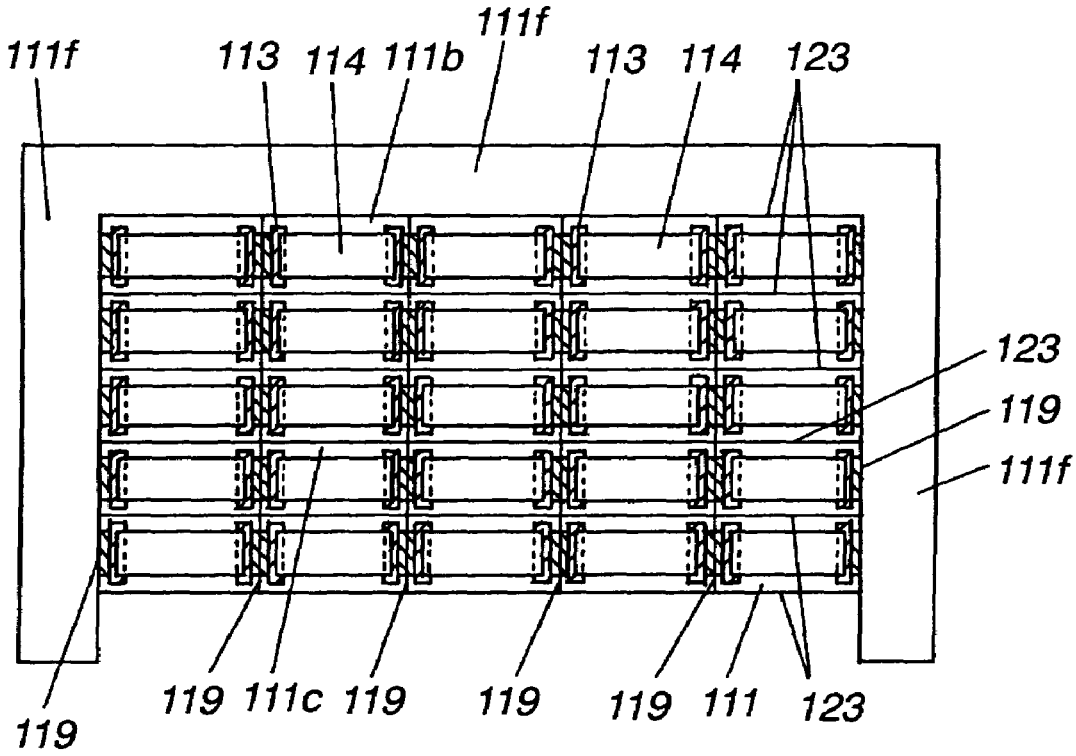
FIG. 52 is a plan view of still another sheet-form substrate for use in manufacturing the resistor, wherein a void area is formed at three sides of the substrate.

Moreover, in the third exemplary embodiment of the invention, the void area 111*a* is formed substantially in a square shape around the entire peripheral margin of the sheet-form substrate 111, which does not yield any product in the end. However, the void area 111*a* is not necessarily formed around the entire peripheral margin of the sheet-form substrate 111. Similar advantage and effect can be achieved as those of the third exemplary embodiment of this invention even if, for examples, void area 111*d* is formed at one side of sheet-form substrate 111, as shown in FIG. 50, void areas 111*e* are formed at both sides of sheet-form substrate 111, as shown in FIG. 51, or void area 111*f* is formed at three sides of sheet-form substrate 111, as shown in FIG. 52.

Furthermore, in the third exemplary embodiment of the invention, the laser scriber is used to form the second separations 123. However, the second separations 123 may be formed by a dicing method in the same manner as the slit-like first separations 119. In this case, the dicing can be carried out easily with a dicing machine commonly used for semiconductors and the like.

In the above manufacturing process of resistors according to the third exemplary embodiment of the invention, the process of forming the bonding layers 117 of conductive resin to overlap with the first upper surface electrode layers 112 and the second upper surface electrode layers 113 is executed after the process of forming the first protective layers 115 of glass to cover the resistor layers 114, and the process of trimming the resistor elements 114 between the pairs of the second upper surface electrode layers 113 to adjust the resistance. However, the above order may be changed so that the process of forming the pairs of the bonding layers 117 of conductive resin to overlap with the first upper surface electrode layers 112 and the second upper surface electrode layers 113 may be executed after the process of forming the first protective layers 115 of glass to cover the resistor elements 114, the process of trimming the resistor elements 114 between the pairs of the second upper surface electrode layers 113 to adjust the resistance, and the process of forming the second protective layers 118 of resin to cover at least the first protective layers 115 of glass. Like advantage and effect is obtainable as those of the third exemplary embodiment of this invention even with the above processes of manufacturing method.

That is, the manufacturing method discussed in the third exemplary embodiment of the invention does not cause any change in resistance even after adjustment of the resistance by trimming, since sintering temperature of the first protective layers 115 made mainly of glass is 600° C. or higher, and a temperature for forming the bonding layers 117 composed of conductive resin is approx. 200° C. This manufacturing method does not cause any change in resistance after the adjustment of the resistance by trimming even if the order of the processes is altered, since a temperature for sintering the first protective layers 115 made mainly of glass is 600° C. or higher, and a temperature for forming the second protective layers 118 made of resin layers and the bonding layers 117 composed of conductive resin is approx. 200° C.

According to the third exemplary embodiment of the invention, as described above, the upper surface electrode 92 formed on the main surface (i.e. upper surface) of substrate 91 is constructed of a multi-layer structure including first upper surface electrode layer 94, second upper surface electrode layer 95 disposed on the first upper surface electrode layer 94 to overlap at least a part thereof, and bonding layer 96 overlapping to both the first upper surface electrode layer 94 and the second upper surface electrode layer 95, as shown in FIG. 31. Therefore, for manufacturing small sized resistors, the first upper surface electrode layers 94 allows a test probe for measuring a resistance in the process of trimming to make contact with not only one of the second upper surface electrode layers 95 but also another of the second upper surface electrode layers 95 located in the adjoining resistor simultaneously to a time a sheet-form substrate carrying a large number of resistors. In addition, if side face electrodes 100 are formed over side faces of the substrate 100 by the film-forming technique, the bonding layers 96 overlapping the first upper surface electrode layers 94 and the second upper surface electrode layers 95 can increase connecting areas between the side face electrodes 100 and the upper surface electrodes 92, thereby giving an advantage of improving reliability of the electrical connections between the upper surface electrodes 92 and the side face electrodes 100.

Furthermore, the second upper surface electrode layers 95 are formed at positions slightly shifting inward from the side edges of the substrate 91. This arrangement provides an advantage that the second upper surface electrode layers 95 do not lift loose or form burrs if the sheet-form substrate 91 carrying a large number of resistors is diced into individual segments or split into strips of oblong substrate, because of absence of the second upper surface electrode layers 95 at the splitting areas.

Moreover, the first upper surface electrode layers 94 and the bonding layers 96 constituting the upper surface electrodes 92 are flush with the side faces of substrate 91. This structure gives an advantage that the side face electrodes 100 of thin films can be formed firmly and continuously throughout from the side faces of substrate 91 and the side edges of the first upper surface electrode layers 94 and the bonding layers 96 adjoining the side faces of substrate 91, when the side face electrodes 100 are formed on the side faces of substrate 91.

Furthermore, the electrical connections of the upper surface electrodes 92 to the resistor element 93 are made only with the second upper surface electrode layers 95 out of the first upper surface electrode layers 94, second upper surface electrode layers 95, and bonding layers 96 that constitute the upper surface electrodes 92. Therefore, this structure gives an advantage of providing highly reliable resistors with no change in their resistances after adjustment of the resistances, since it causes no change of the resistances and maintain good ohmic contacts even after the bonding layers 92 are formed.

Also, out of the first upper surface electrode layers 94, second upper surface electrode layers 95 and bonding layers 96 that constitute the upper surface electrodes 92, the bonding layer 96 has its maximum height in its thickness direction greater than that of the first upper surface electrode layers 94. Therefore, this structure gives an advantage of improving reliability of the electrical connections between the upper surface electrodes 92 and the side face electrodes 100, since the bonding layers 96 can increase connecting areas between the upper surface electrodes 92 and the side face electrodes 100 of thin films if the side face electrodes 100 are formed by the film-forming technique on the side faces of substrates 91.

Moreover, the first upper surface electrode layers 94 of conductive resin constitute the upper surface electrodes 92. This provides another advantage of facilitating the process of splitting and separating the first upper surface electrode layers 94 when the sheet-form substrate carrying a large number of resistors is diced into individual segments or split into strips of oblong substrate, which reduces likelihood of peeling loose or burring the first upper surface electrode layers 94.

The substrate 91 is provided with the pair of side face electrodes 100 substantially in a squared-U-shape on the side faces thereof for electrical connections with at least the first upper surface electrode layers 94 and the bonding layers 96. This structure provides reliable electrical connections between the upper surface electrodes 92 and the side face electrodes 100, so as to gives still another advantage of providing highly reliable resistors.

Furthermore, since the second thin films 102 in electrical connection with the first thin films 101 are composed of thin films of copper-base alloy, the admixing metal in the copper-base alloy films and component metal of the first thin films 101 produce complete solid solution in the interfaces between the first thin films 101 and the second thin films 102. This structure provides an advantage of increasing bonding strength between the first thin films 101 and the second thin films 102.

Moreover, since the second thin films 102 constituting the side face electrodes 100 are composed of thin films of copper-nickel alloy containing 1.6 wt. % of nickel into the base metal of copper, the nickel in the copper-nickel alloy films and component metal of the first thin films 101 produce complete solid solution. This arrangement provides another advantage of increasing bonding strength between the first thin films 101 and the second thin films 102.

Additionally, the first thin films 101 and the second thin films 102 constituting the side face electrodes 100 are formed substantially in an L-shape over the back surface to the side faces of the substrate 91. This enables the first thin films 101 and the second thin films 102 to be formed easily only from the back surface toward a direction of the upper surface of the substrate 91 by a film-forming technique, thereby giving an advantage of improving productivity.

Fourth Exemplary Embodiment

Referring to accompanying drawings, a resistor according to a fourth exemplary embodiment of the invention will be described.

Figure 53:
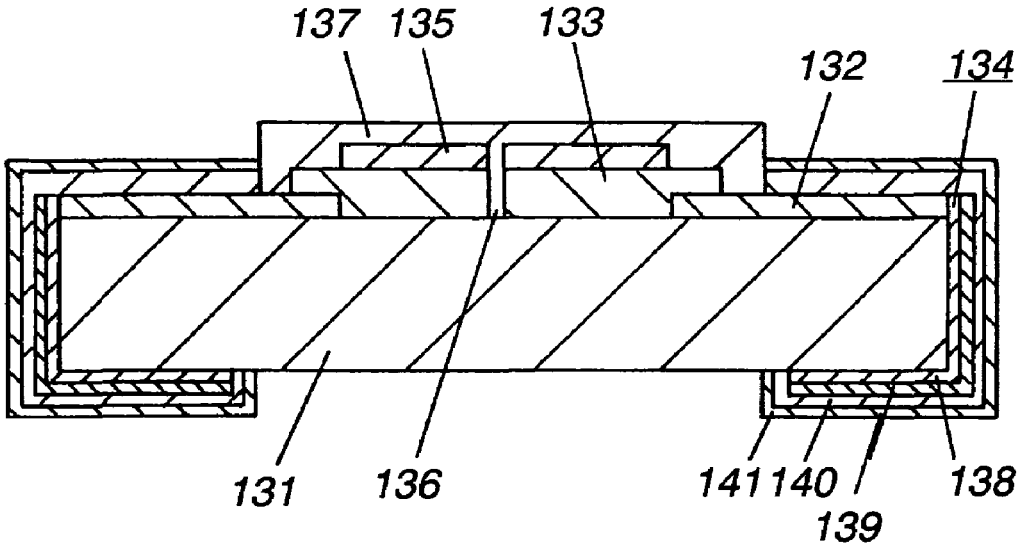
FIG. 53 is a sectional view of a resistor according to a fourth exemplary embodiment of the present invention.

FIG. 53 is a sectional view of the resistor according to the fourth exemplary embodiment of the invention.

As shown in FIG. 53, the resistor according to the fourth exemplary embodiment of the invention includes substrate 131, a pair of upper surface electrodes 132 provided on an upper surface of substrate 131, resistor element 133 formed between the pair of upper surface electrodes 132, and a pair of side face electrodes 134 provided on the substrate 131 substantially in a squared-U-shape to cover around side faces of the substrate 131.

The resistor element 133 is provided on an upper surface thereof with first protective layer 135 composed of glass and the like, and trimming slit 136 is cut through both the resistor element 133 and the first protective layer 135 by laser or the like for adjusting its resistance to a desired value. Then, the resistor is provided with second protective layer 137 composed of resin, glass or the like material to cover at least the resistor element 133, which overlies and bridges the pair of upper surface electrodes 132, or more preferably to cover all of the resistor element 133, first protective layer 135 and the trimmed slit 136.

The pair of side face electrodes 134 covering around side faces of the substrate 131 is formed substantially in a squared-U-shape to make electrical connections with the upper surface electrodes 132. Each side face electrode 134 is constructed of a multi-layer structure including first thin film 138, second thin film 139, first plating film 140, and second plating film 141 formed in this order on the side face of the substrate 131. The first thin films 138 are formed of one of chromium, chromium-base alloy film, titanium, titanium-base alloy film and nickel-chromium alloy film, all having good bonding property to the substrate 131, from the back surface to the side faces of substrate 131 substantially in an L-shape by film-forming techniques as sputtering, vacuum evaporation, ion plating, and P-CVD methods. The second thin films 139 are formed of copper-base alloy film from the back surface to the side faces of substrate 131 substantially in an L-shape to overlap with the first thin films 138 so as to be connected electrically thereto, by film-forming techniques as sputtering, vacuum evaporation, ion plating, and P-CVD methods.

The first plating films 140 are formed by nickel plating having excellent property to prevent flow of solder or heat resistance and covers exposed surfaces of the upper surface electrodes 132, parts of the first thin films 138, and the second thin films 139. Furthermore, the second plating films 141 are formed by tin plating having good bonding property with solder, and covers the first plating films 140.

Referring to accompanying drawings, a method of manufacturing the resistor constructed as above according to the fourth exemplary embodiment of the invention will be described.

Figure 54:
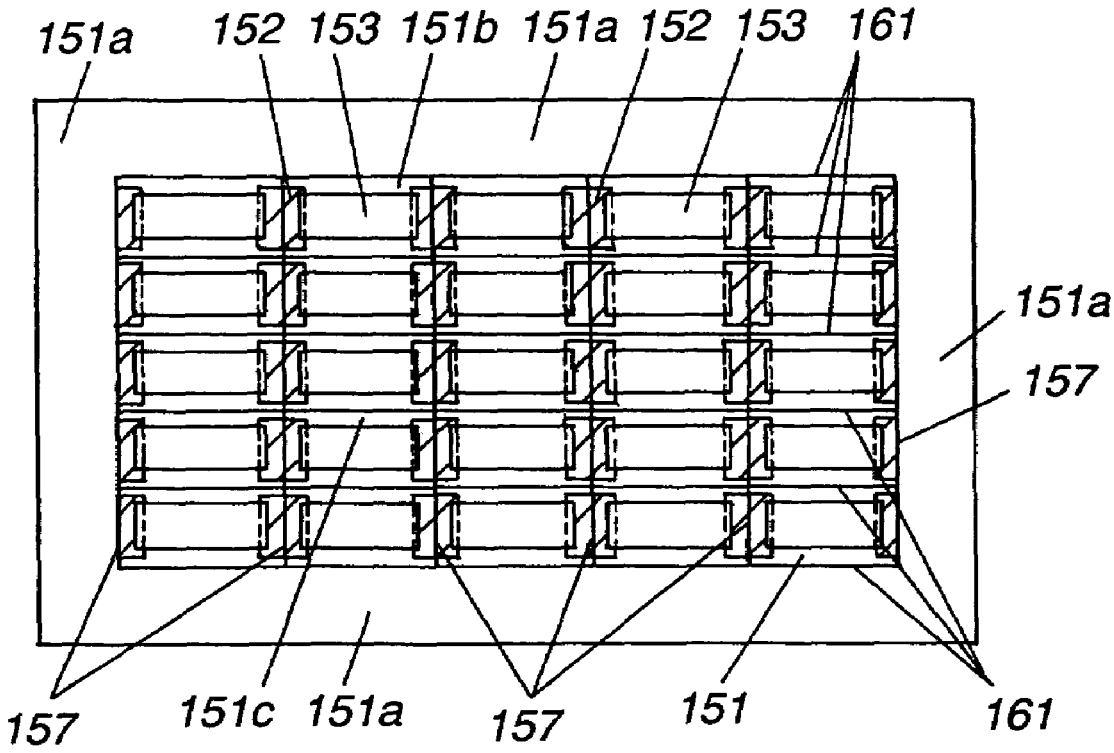
FIG. 54 is a plan view of a sheet-form substrate for use in manufacturing the resistor, wherein a void area is formed in the entire peripheral margin of the substrate.

FIG. 54 is a plan view of a sheet-form substrate for use in manufacturing the resistor of the fourth exemplary embodiment of the invention, in which a void area is formed in the entire peripheral margin of the substrate. FIGS. 55A, 55B, 57A, 57B, 59A, 59B, 61A, 61B, 63A, 63B, 65A and 65B are sectional views illustrating sequential processes of manufacturing the resistor according to the fourth exemplary embodiment of the invention. FIGS. 56A, 56B, 58A, 58B, 60A, 60B, 62A, 62B, 64A, 64B, 66A and 66B are plan views illustrating sequential processes of manufacturing the resistor according to the fourth exemplary embodiment of the invention.

Figure 55A:
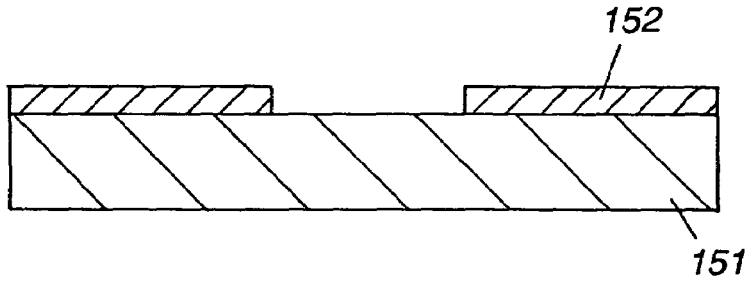
FIGS. 55A and 55B are sectional views of the resistor for showing processes of manufacturing the resistor.
Figure 56A:
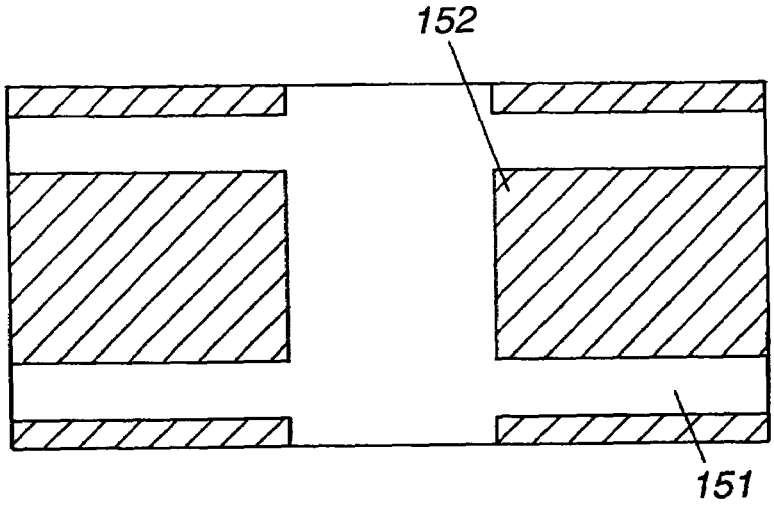
FIGS. 56A and 56B are plan views of the same resistor for showing the manufacturing processes.

First, sheet-form substrate 151 of 0.2 mm thickness made of sintered 96% alumina having insulating property are prepared, as shown in FIGS. 54, 55A and 56A. In this embodiment, the sheet-form substrate 151 includes void area 151*a* around the entire peripheral margin, as shown in FIG. 54, which does not yield any product in the end. Void area 151*a* is formed substantially in a square shape.

Then, plural pairs of upper surface electrode layers 152 containing mainly silver are formed on an upper surface of the sheet-form substrate 151 by a screen printing method. Then the upper surface electrode layers 152 are made stable by sintering according to a sintering profile of 850° C. as a peak temperature.

Figure 55B:
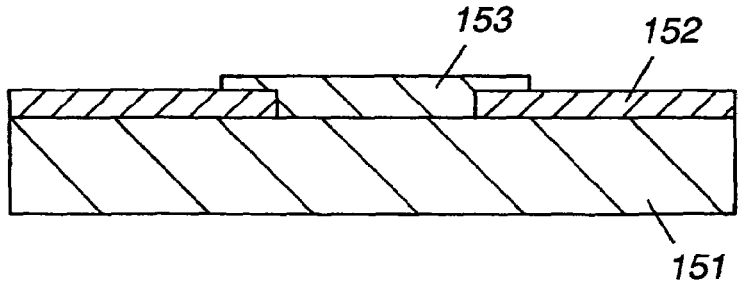
Figure 56B:
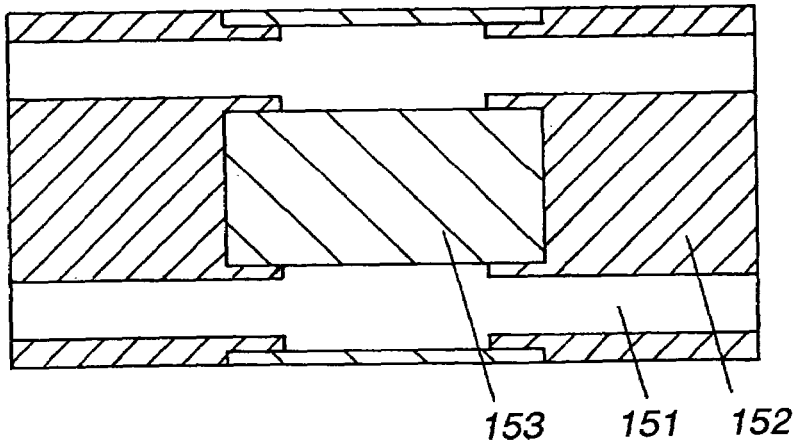

Next, plural resistor elements 153 composed of ruthenium oxide-base material are formed by a screen printing method at positions bridging respective pairs of upper surface electrode layers 152, as shown in FIGS. 54, 55B and 56B. Then, the resistor elements 153 are made stable by sintering according to a sintering profile of 850° C. as a peak temperature.

Figure 57A:
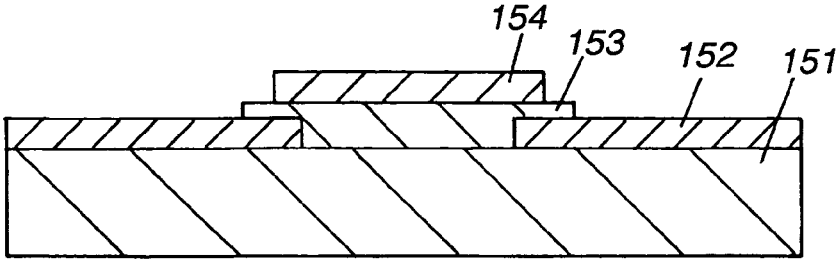
FIGS. 57A and 57B are sectional views of the resistor for showing the manufacturing processes.
Figure 58A:
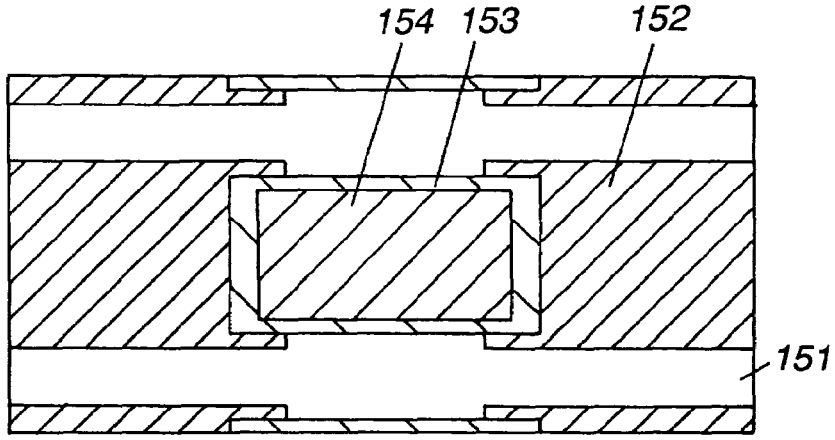
FIGS. 58A and 58B are plan views of the resistor for showing the manufacturing processes.

Then, plural first protective layers 154 containing mainly glass are formed by a screen printing method. Layers 154 cover the plural resistor elements 153, respectively, as shown in FIGS. 57A and 58A. Then, the first protective layers 154 formed mainly of glass are made stable by sintering according to a sintering profile of 600° C. as a peak temperature.

Figure 57B:
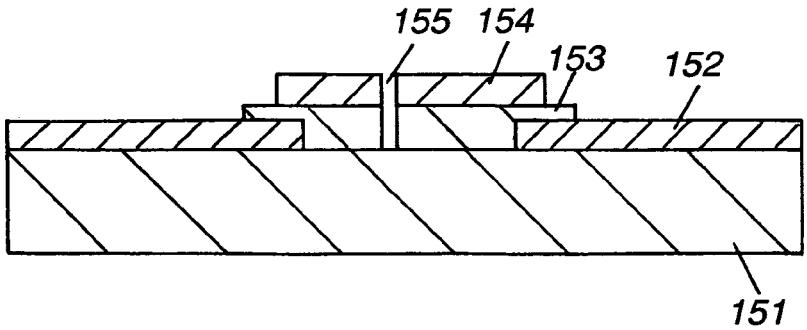
Figure 58B:
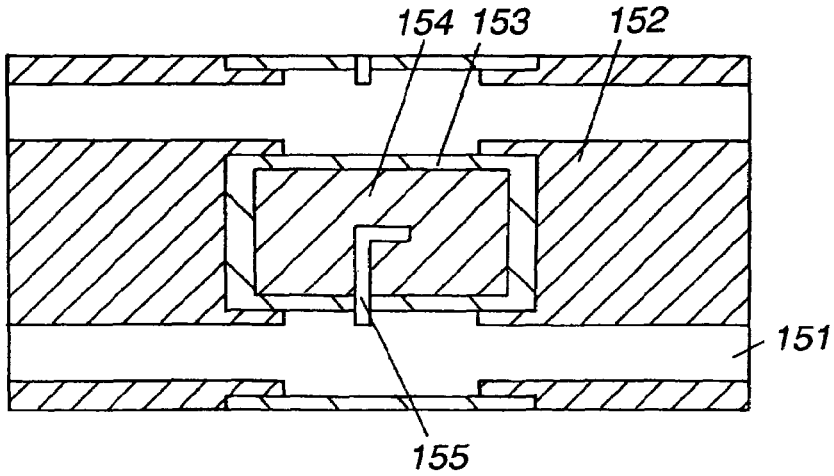

By a laser trimming method, the resistor elements 153 between the plural pairs of upper surface electrode layers 152 are trimmed to form plural trimming slits 155, as shown in FIGS. 57B and 58B, to adjust their resistances to a predetermined value.

Figure 59A:
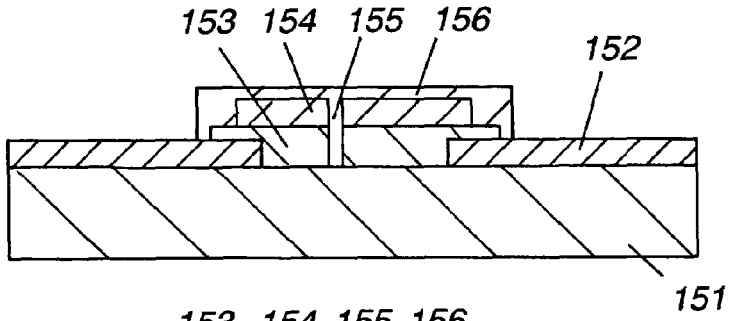
FIGS. 59A through 59B are sectional views of the resistor for showing the manufacturing processes.
Figure 60A:
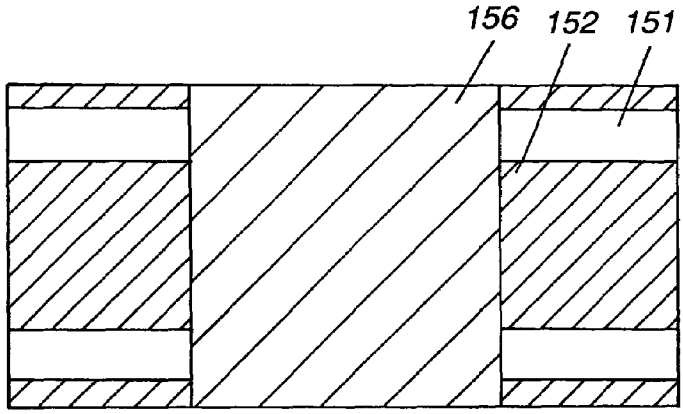
FIGS. 60A through 60B are plan views of the resistor for showing the manufacturing processes.

Next, as shown in FIGS. 59A and 60A, by a screen printing method, plural second protective layers 156 made mainly of resin are formed for covering entirely respective first protective layers 154, which consist mainly of glass and are formed along a vertical direction in the figures. The layers 1556 also covers parts of the resistor elements 153 and the upper surface electrode layers 152. Then, the second protective layers 156 are stable by hardening according to a hardening profile of 200° C. as a peak temperature.

Figure 59B:
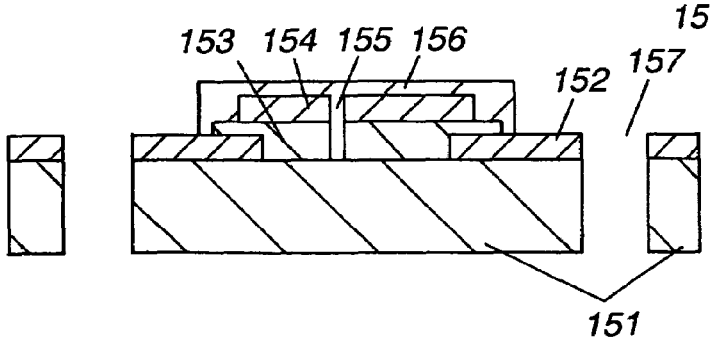
Figure 60B:
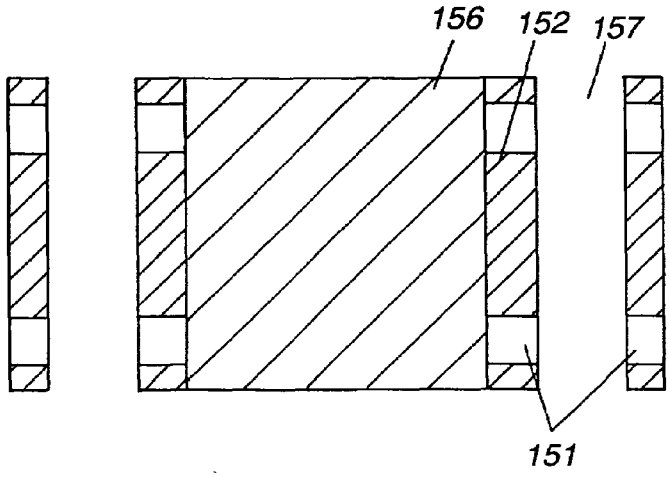

Next, plural slit-like first separations 157 are formed by a dicing method in the sheet-form substrate 151 having the second protective layers 156, except for the void area 151*a* formed in the entire peripheral margin of the substrate 151, as shown in FIGS. 54, 59B and 60B. The separations 157 are provided for separating the plural pairs of upper surface electrode layers 152 to provide plural oblong substrates 151*b*. In this instance, the slit-like first separations 157 are formed at a 700 μm pitch, and each first separations 157 is 120 μm wide. The slit-like first separations 157 are formed as slit openings cut through the sheet-form substrate 151 in a direction of its thickness. In addition, the sheet-form substrate 151 keeps its original sheet-like shape even after the slit-like first separations 157 are formed in it since the slit-like first separations 157 are formed by the dicing method only in an area other than the void area 151*a*. The plural oblong substrates 151*b* communicate with each other at the void area 151*a*.

Figure 61A:
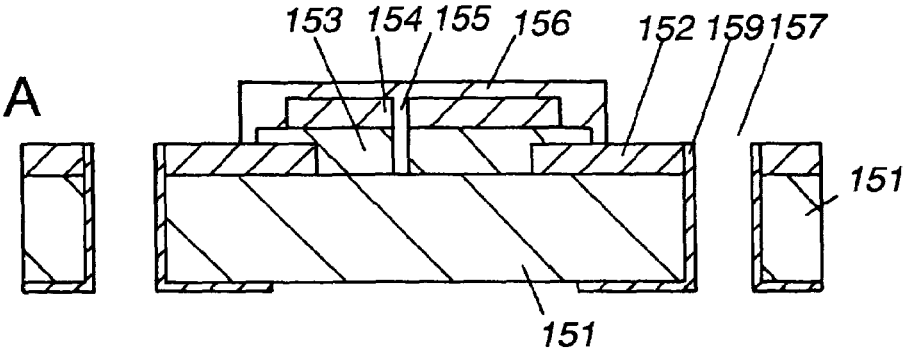
FIGS. 61A through 61B are sectional views of the resistor for showing the manufacturing processes.
Figure 62A:
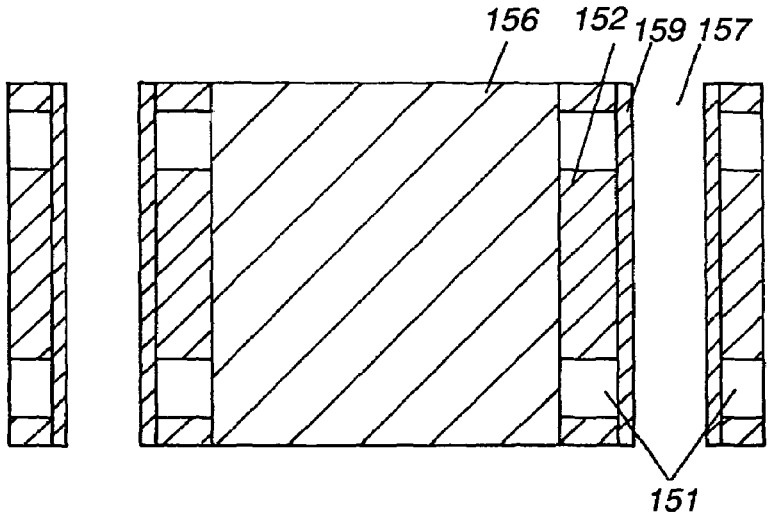

Then, plural pairs of first thin films 159 composed of thin chromium films having good bonding property to the substrate 151 are formed from the back side of sheet-form substrate 151 by a sputtering method using a mask (not shown in the figures), to constitute parts of side face electrodes 158 over parts of a back surface as well as side face portions of the substrate 151 and side edges of the upper surface electrode layers 152 located inside the plural slit-like first separations 157. The first thin films 159 are formed substantially in an L-shape, as shown in FIGS. 61A and 62A.

Figure 61B:
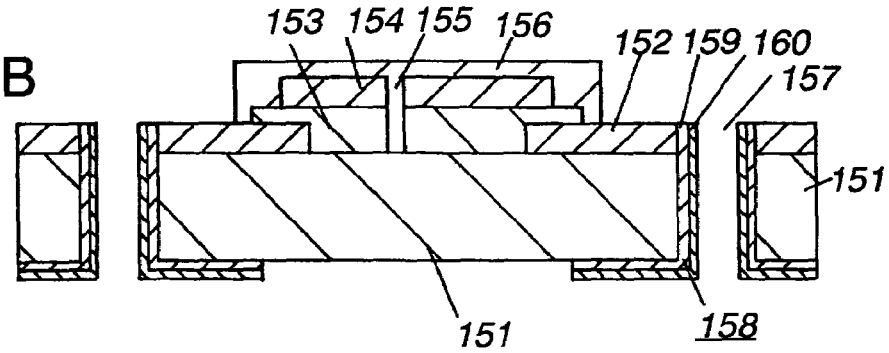
Figure 62B:
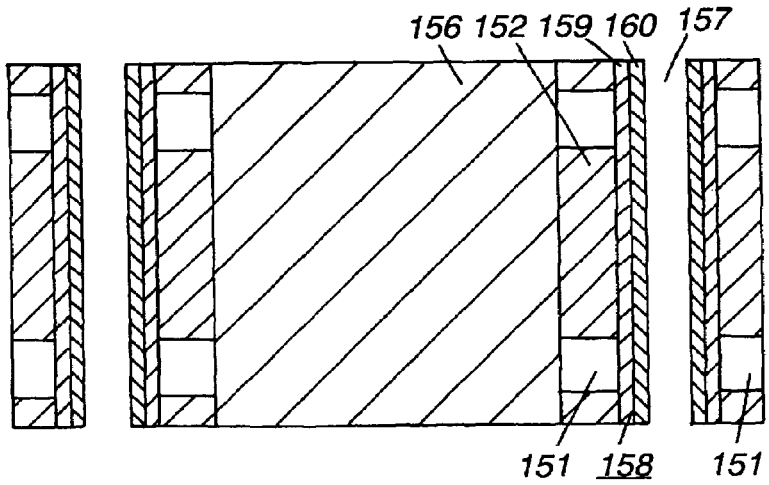

Next, plural pairs of second thin films 160 composed of thin films of copper-nickel alloy, are formed from the back side of sheet-form substrate 151 by a sputtering method using a mask (not shown in the figures), to constitute other parts of side face electrodes 158, over the plural pairs of first thin films 159 in an overlying manner as shown in FIGS. 61B and 62B.

Figure 63A:
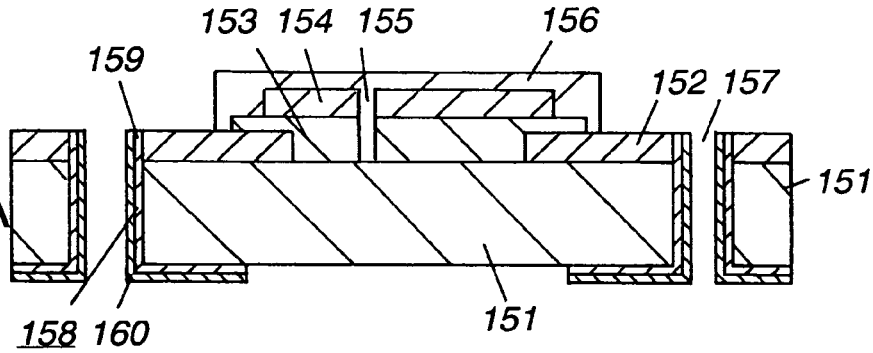
FIGS. 63A and 63B are sectional views of the resistor for showing the manufacturing processes.
Figure 63B:
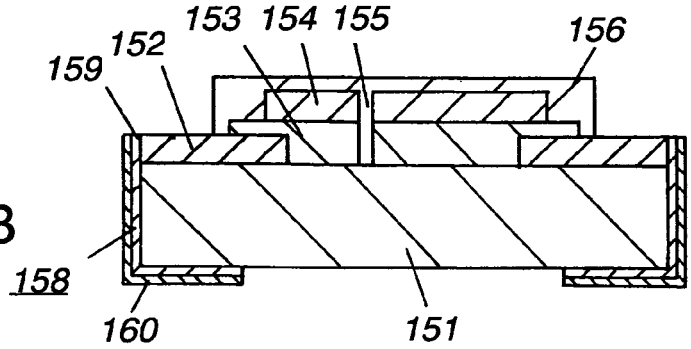
Figure 64A:
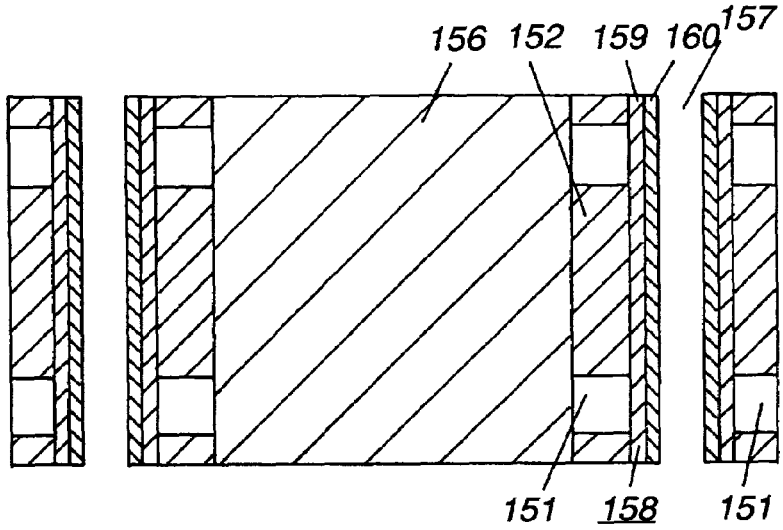
FIGS. 64A and 64B are plan views of the resistor for showing the manufacturing processes.
Figure 64B:
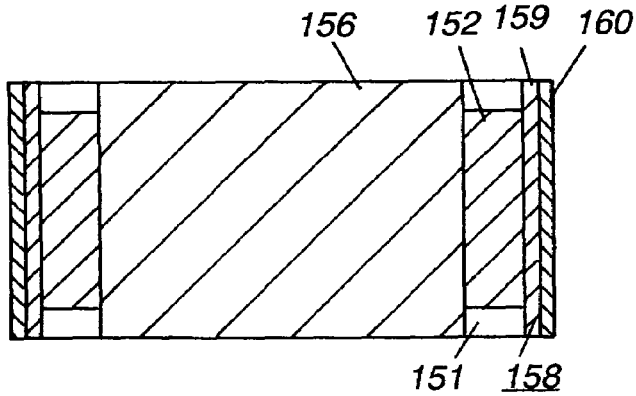

Subsequently, plural second separations 161 are formed in a direction orthogonal to the slit-like first separations 157, as shown in FIGS. 54, 63A, 63B, 64A and 64B, except for the void area 151*a* formed in the entire peripheral margin of the sheet-form substrate 151. The plural resistor elements 153 formed on each of oblong substrates 151*b* of the sheet-form substrate 151 are separable into a number of segment substrates 151*c*. In this instance, the plural second separations 161 are formed at a 400 μm pitch, and therefore, each of the second separations 161 has 100 μm width. The plural second separations 161 are formed with a laser scriber in a first step of forming separation grooves with laser, as shown in FIGS. 63A and 64A, and splitting these separation groove portions with generally-available splitting equipment in the subsequent step of separating the substrate into individual segment substrates 151*c* as shown in FIGS. 63B and 64B. In other words, this splitting method provides an advantage of separating the segment substrates 151*c* in the two steps, instead of separating them each and every time the second separations 161 are formed. In addition, since the plural second separations 161 are formed with a laser scriber only in the oblong substrates 151*b* excluding the void area 151*a*, the segment substrates 151*c* are separated when they are split along the second separations 161, and then separated from the void area 151*a*.

Figure 65A:
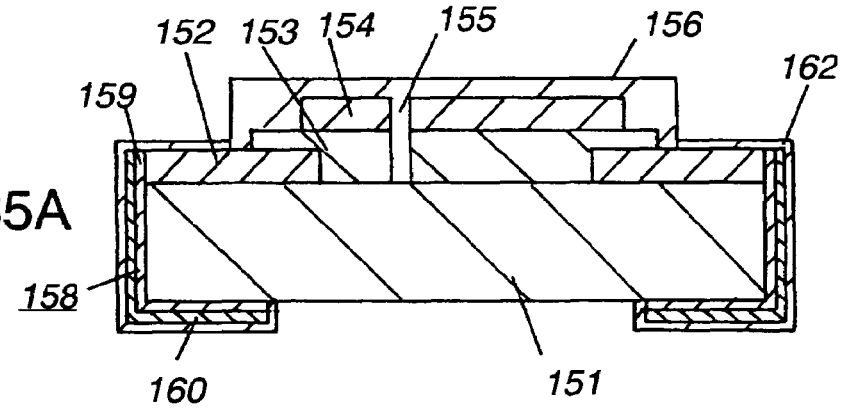
FIGS. 65A and 65B are sectional views of the resistor for showing the manufacturing processes.
Figure 66A:
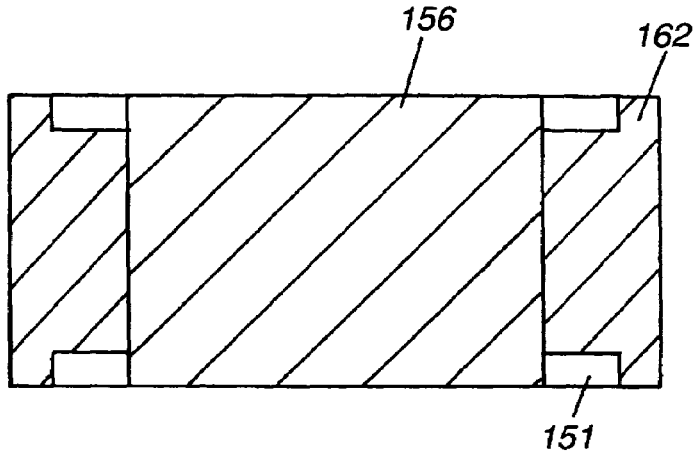
FIGS. 66A and 66B are plan views of the resistor for showing the manufacturing processes.

Then, by an electroplating method, first plating films 162 of nickel plates having approximately 2 to 6 μm thickness and excellent properties in preventing flow of solder and in heat resistance are formed for covering the first thin films 159 and the second thin films 160 constituting the side face electrodes 158, and exposed upper surfaces of the upper surface electrode layers 152, as shown in FIGS. 65A and 66A.

Figure 65B:
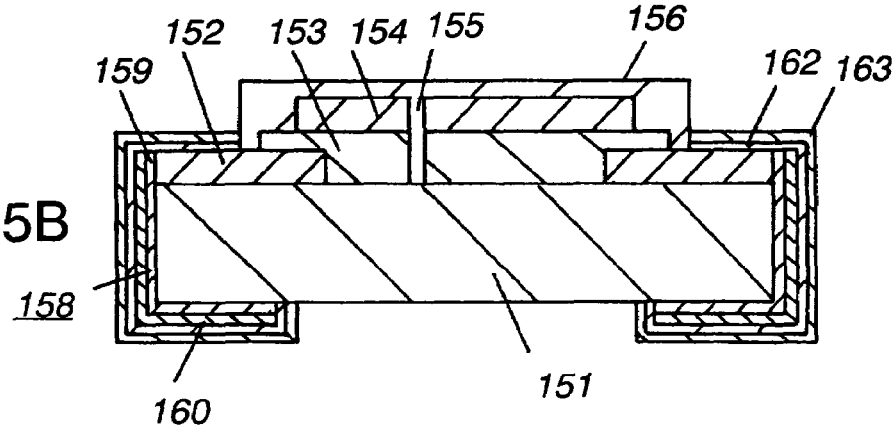
Figure 66B:
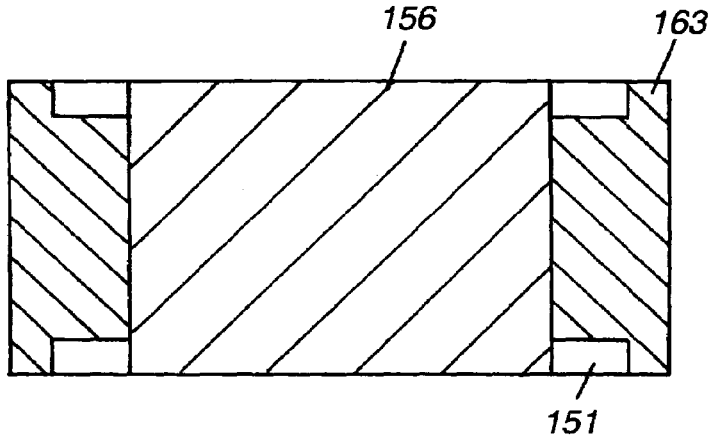

Finally, by an electroplating method, second plating films 163 of tin plates having approximately 3 to 8 μm thickness and excellent property in flow of solder are formed for covering the first plating films 162 of nickel plates, as shown in FIGS. 65B and 66B.

The above manufacturing process produces the resistors of the fourth exemplary embodiment of this invention.

In the manufacturing process described above, although tin plating is used to form the second plating films 163, this is not restrictive, and they can be formed by plating any tin-base alloy, such as solder and the like material. The second plating films 163 formed of such material can facilitate reliable soldering in the process of reflow soldering.

Moreover, in the above manufacturing process, the protective layer covering the resistor element 153 and the like has a two-layer structure including first protective layer 154 and second protective layer 156. First protective layer 154 is composed mainly of glass over the resistor element 153. Second protective layer 156 is composed mainly of resin covering the first protective layer 154 and trimmed slit 155. This structure allows the first protective layer 154 to prevent the resistor from being cracked in the process of laser trimming so as to reduce current noises, and allows the second protective layer 156 of resin to ensure a resistance characteristic with good moisture-proof property since it covers the entire resistor element 153.

Furthermore, the resistors manufactured in the above manufacturing process have high accuracy (±0.005 mm or less) in dimension of intervals of the slit-like first separations 157 formed by the dicing method and the second separations 161 formed with the laser scriber. In addition, the resistors as final products have overall length and width of 0.6 mm by 0.3 mm with good accuracy since all of the first thin films 159, second thin films 160, first plating films 162, and second plating films 163 constituting the side face electrodes 158 can be formed precisely in their thickness. Moreover, since pattern sizes of the upper surface electrode layers 152 and the resistor elements 153 are so accurate, dimensional ranking of the individual segment substrates is not required, nor is it required to consider dimensional variations within the same dimensional rank of the segment substrates. As a result, the resistor has a larger effective area of the resistor elements 153 than the conventional resistor. In other words, while resistor element of the conventional resistor has dimensions of approximately 0.20 mm long by 0.19 mm wide, resistor elements 153, the resistor according to the fourth exemplary embodiment of this invention measure has approximately 0.25 mm long by 0.24 mm wide, which is about 1.6 times or greater in the surface area.

In addition, in the above manufacturing process, the slit-like first separations 157 are formed by the dicing method using the sheet-form substrate 151, which does not require dimensional ranking of the segment substrates. Accordingly, a complex process required for manufacturing the conventional resistor is eliminated by avoiding the dimensional ranking of the segment substrates. It also facilitates the dicing process, which can be carried out easily with ordinary dicing equipment.

Moreover, in the above manufacturing process, void area 151*a* which does not become products in the end are formed around the entire peripheral margin of the sheet-form substrate 151, and the first separations 157 are formed in a manner that the plural oblong substrates 151*b* communicate with each other at the void area 151*a*. Since the plural oblong substrates 151*b* communicate at the void area 151*a* even after the first separations 157 are formed, the oblong substrates 151*b* do not come apart from the sheet-form substrate 151. This arrangement can thus facilitate a subsequent process in condition that the sheet-form substrate 151 includes the void area 151*a* kept integral after the process of forming the first separations 157, thereby simplifying the manufacturing process.

Furthermore, in the manufacturing process above, although the first thin films 159 and the second thin films 160 that constitute the side face electrodes 158 are formed by the sputtering method using a mask (not shown in the figures), the process is not limited to it. Back side portions of the side face electrodes 158 may be formed without the mask (not shown in the figures) by forming thin films on the entire back surface of a sheet-form substrate by the sputtering method, and by removing unnecessary portions of the thin films formed on the entire back surface, i.e. generally the center portions on the back surface of the sheet-form substrate, by evaporating them with laser irradiation.

Although the second thin films 160 described above were formed with thin films of copper-base alloy, and preferably with thin films of copper-nickel alloy among a number of like materials. The reasons are not repeated here since they have already been discussed in detail in the first exemplary embodiment of this invention.

In the fourth exemplary embodiment of this invention, the sputtering method is used to form the first thin films 159 and the second thin films 160, but the method is not limited only to the sputtering method. Similar advantage and effect as those of the fourth exemplary embodiment of this invention are also obtainable even if first thin films 159 and second thin films 160 are formed by other film-forming techniques, such as vacuum evaporation method, ion plating method, P-CVD method.

In the fourth exemplary embodiment of this invention, the first thin films 159 are formed of thin chromium films, but they are not limited only to the chromium films. Similar advantage and effect as those of the fourth exemplary embodiment of this invention are obtainable even if first thin films 159 are formed of other material having good bonding property to the substrate, such as chromium-silicon alloy films, nickel-chromium alloy films, titanium films, and titanium-base alloy films.

Figure 67:
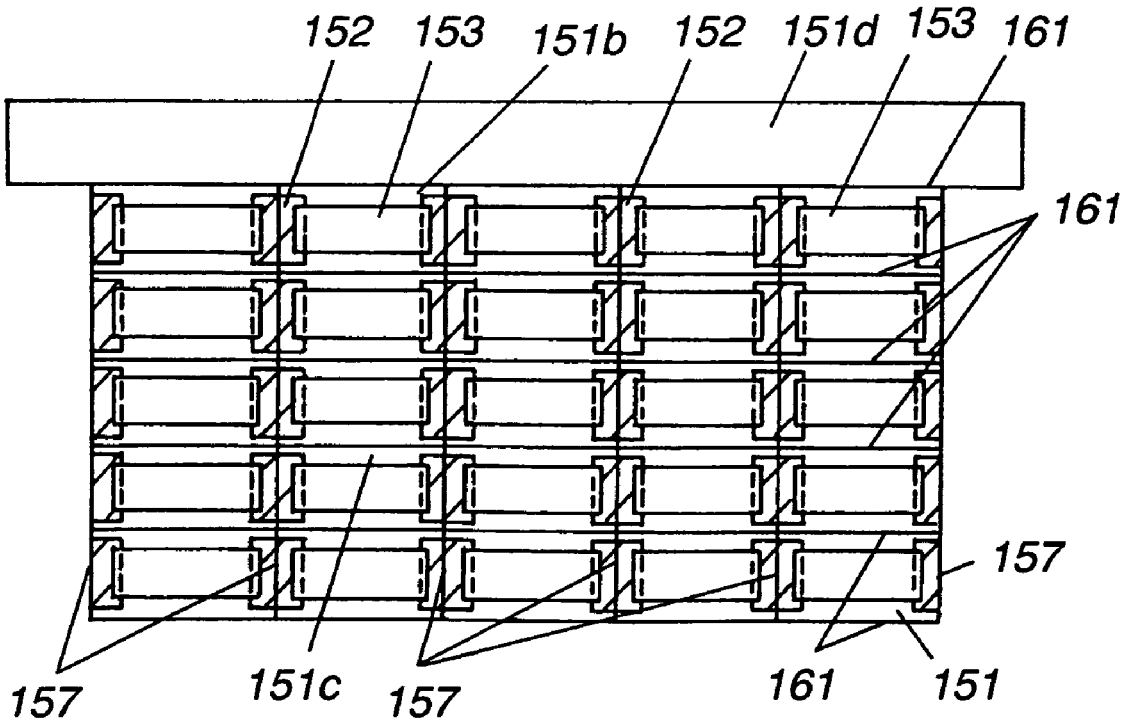
FIG. 67 is a plan view of a sheet-form substrate for use in manufacturing the resistor, wherein a void area is formed at one side of the substrate.
Figure 68:
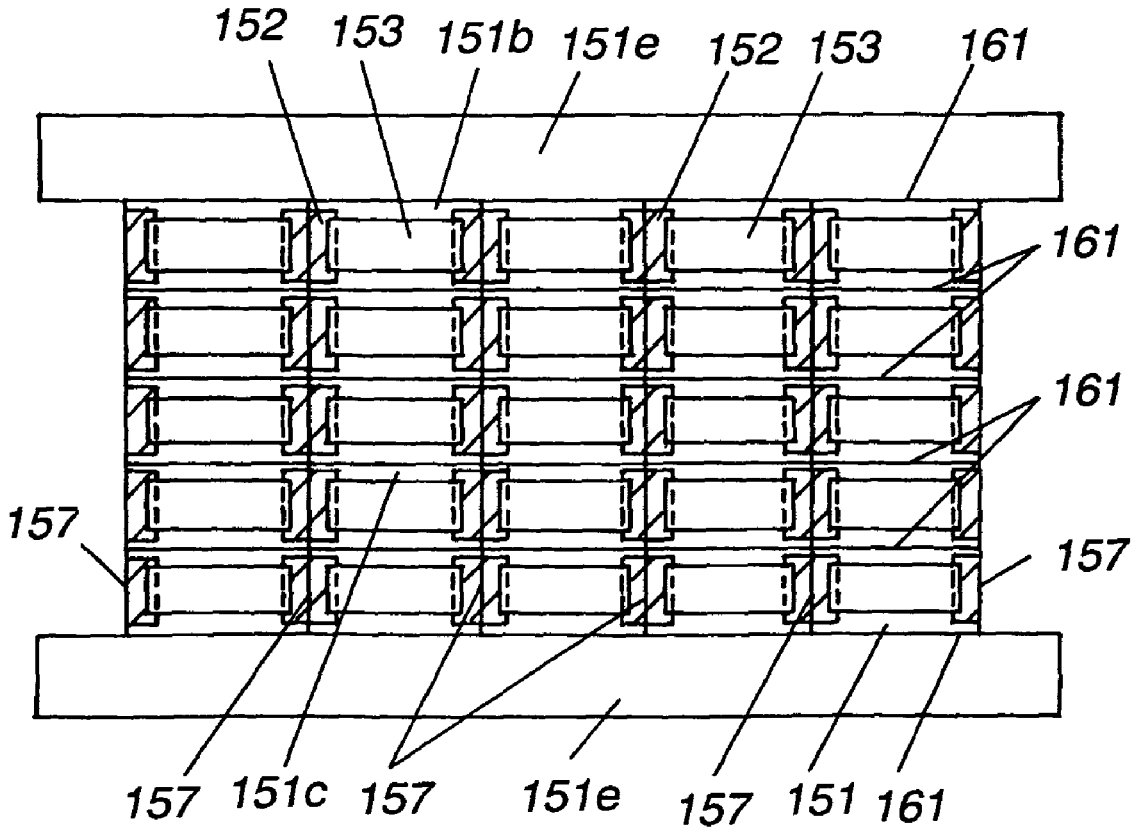
FIG. 68 is a plan view of another sheet-form substrate for use in manufacturing the resistor, wherein void areas are formed at both sides of the substrate.
Figure 69:
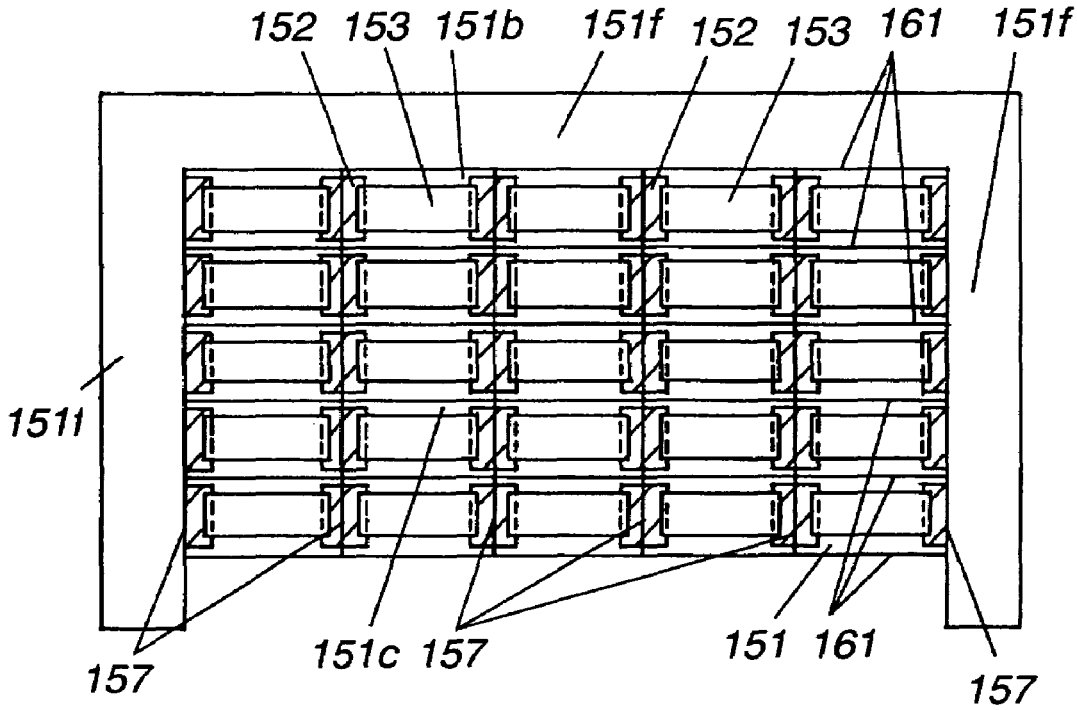
FIG. 69 is a plan view of still another sheet-form substrate for use in manufacturing the resistor, wherein a void area is formed at three sides of the substrate.
Figure 70:
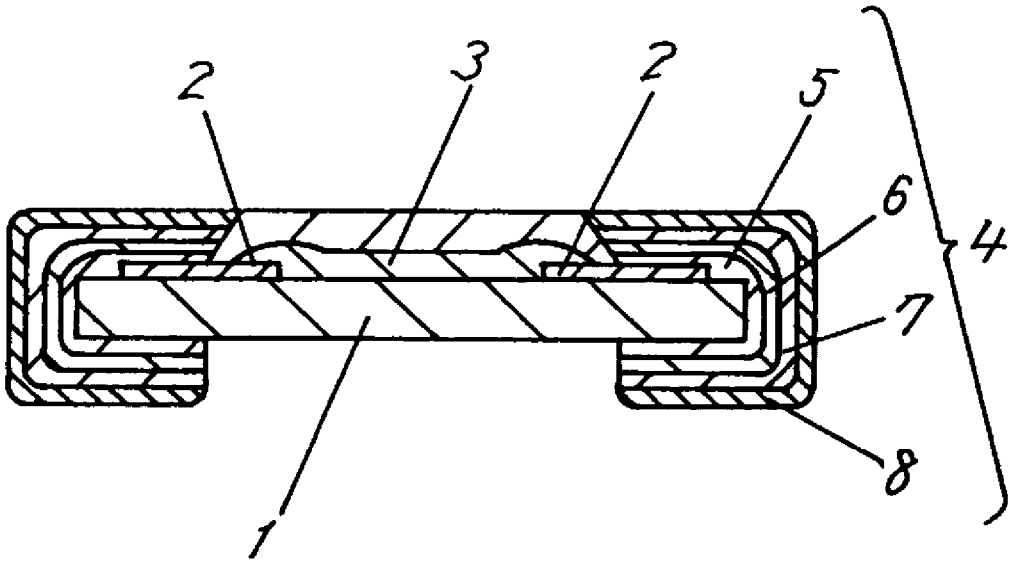
FIG. 70 is a sectional view of a conventional resistor.

Moreover, in the fourth exemplary embodiment of this invention, the void area 151*a* is formed substantially in a square shape around the entire peripheral margin of the sheet-form substrate 151, which does not yield any product in the end. However, the void area 151*a* are not necessarily formed around the entire peripheral margin of the sheet-form substrate 151. Similar advantage and effect to those of the fourth exemplary embodiment of this invention are obtainable if, for examples, void area 151*d* is formed at one side of sheet-form substrate 151 as shown in FIG. 67, void areas 151*e* are formed at both sides of sheet-form substrate 151 as shown in FIG. 68, or void area 151*f* is formed at three sides of sheet-form substrate 151 as shown in FIG. 69.

Furthermore, in the fourth exemplary embodiment of this invention, the laser scriber is used to form the second separations 161. However, the second separations 161 may be formed by a dicing method in the same manner as the slit-like first separations 157. In this case, the dicing can be carried out easily with a dicing machine commonly used for semiconductors and the like.

According to the fourth exemplary embodiment of this invention, as discussed above and shown in FIG. 53, the resistor includes substrate 131, resistor element 133 formed on one of the main surfaces (i.e. upper surface) of the substrate 131, and first protective layer 135, and second protective layer 137 disposed to cover at least the resistor element 133. The resistor is further provided with a pair of upper surface electrodes 132 on one of the main surfaces (i.e. upper surface) of the substrate 131. The resistor element 133 is located between the pair of upper surface electrodes 132. A pair of side face electrodes 134 are provided substantially in a squared-U-shape to cover around side faces of the substrate 131 and in electrical connection to the upper surface electrodes 132. Each of the side face electrodes 134 is constructed of a multi-layer structure including first thin film 138, second thin film 139, first plating film 140, and second plating film 141. First thin film 138 is formed of one of chromium film, titanium film, chromium-base alloy film, titanium-base alloy film, and nickel-chromium alloy film, all of which have good bonding property to the substrate 131. Second thin film 139 is formed of copper-base alloy film in electrical connection to the first thin film 138. First plating film 140 is formed by nickel plating to cover at least the second thin film 139. Second plating film 141 covering at least the first plating film 140. In the above structure, admixing metal in the copper-base alloy films and component metal in the first thin films 138 produce complete solid solution at the interfaces between the first thin films 138 and the second thin films 139, and the metal provides an advantage of increasing bonding strength between the first thin films 138 and the second thin films 139.

Furthermore, since the second thin films 138 constituting the side face electrodes 134 are composed of thin films of copper-nickel alloy containing 1.6 wt. % of nickel into the base metal of copper, the nickel in the copper-nickel alloy films and component metal of the first thin films 138 produce complete solid solution. This structure provides an advantage of increasing bonding strength between the first thin films 138 and the second thin films 139.

In addition, the first thin films 138 and the second thin films 139 constituting the side face electrodes 134 are formed substantially in an L-shape over the back surface to the side faces of the substrate 131. This arrangement enables the first thin films 138 and the second thin films 139 to be formed easily only from the back surface toward a direction of the upper surface of the substrate 131 by the film-forming technique, thereby giving an advantage of improving productivity.

INDUSTRIAL APPLICABILITY

As described above, the resistor of the present invention includes a pair of upper surface electrodes formed on a main surface of a substrate, and a pair of side face electrodes provided on side faces of the substrate and electrically connected to the pair of upper surface electrodes. The upper surface electrode includes a first upper surface electrode layer and a bonding layer laid on top of the first upper surface electrode layer. The side face electrode has a multi-layered structure including a first thin film, a second thin film, a first plating film, and a second plating film. The first thin film is formed of one of chromium films, titanium films, chromium-base alloy films, and titanium-base alloy films, all having a good bonding property to the substrate and disposed to side faces of the substrate. The second thin film is formed of copper-base alloy film and electrically connected to the first thin film. The first plating film is formed by nickel plating and covering at least the second thin film. The second plating film covers at least the first plating films. The pair of upper surface electrode includes the first upper surface electrode layer and the bonding layer laid on top of the first upper surface electrode layer. Therefore, contact areas between the pair of side face electrodes and the pair of upper surface electrode can be increased if the pair of side face electrode are formed with thin film on the side faces of the substrate and electrically connected to the pair of upper surface electrodes. This arrangement improves reliability of electrical connections between the upper surface electrodes and the side face electrodes. In addition, the side face electrodes have the second thin films in electrical connection with the first thin films, and the second thin films are formed of thin copper alloy films. Therefore, an admixing metal composing the thin copper alloy films produces complete solid solution with component metal of the first thin films at the interfaces between the first thin films and the second thin films. This provides a remarkable advantage and effectiveness in increasing bonding strength between the first thin films and the second thin films, thereby improving reliability of the resistor.

The invention claimed is:

1. A resistor comprising:

a substrate having a main surface, a back surface opposite to said main surface, and a side surface;

a pair of upper surface electrodes formed on said main surface of said substrate, each of said upper electrodes having a side surface flush with respect to said side surface of said substrate, each of said upper surface electrodes comprising:

a first upper surface electrode layer having a side surface flush with respect to said side surface of said substrate; and a bonding layer on and in contact with said first upper surface electrode layer, said bonding layer having a side surface flush with respect to said side surface of said substrate, said bonding layer comprising conductive resin;

a resistor element connected electrically with said upper surface electrodes;

a protective layer for covering said resistor element; and a pair of side surface electrodes, each of said side surface electrodes being provided on said side surface of said substrate and connected electrically to each of said upper surface electrodes, each of said side electrodes being provided on and in contact with said side surface of said first upper surface electrode layer and said side surface of said bonding layer, each of said side surface electrodes comprising:

a first film formed of one of chromium film, titanium film, alloy film which contains chromium, and alloy film which contains titanium, having a bonding property against said substrate, said first film provided on and in contact with said side surface of said first upper surface electrode layer and said side surface of said bonding layer;

a first plating film formed by nickel plating over said first film; and a second plating film over said first plating film.

2. The resistor according to claim 1, wherein a maximum height of each of said bonding layer in a thickness direction thereof is greater than a maximum height of each of said first upper surface electrode layer in a thickness direction thereof.

3. The resistor according to claim 1, wherein said first upper surface electrode layer comprises silver-base material, and said bonding layer comprises conductive resin.

4. The resistor according to claim 1, wherein each of said side surface electrodes further comprises a second film formed of copper-base alloy film and connected electrically to said first film, and wherein said second film comprises a film of copper-nickel alloy containing copper and 1.6 wt. % or more of nickel.

5. The resistor according to claim 4, wherein said first and second films are shaped substantially in an L-shape over a back surface and said side face of said substrate without overlaying the main surface of the substrate.

6. A resistor comprising:

a substrate having a main surface, a side surface, and a back surface opposite to the main surface;

a pair of upper surface electrodes, each of upper surface electrodes comprising:

a first upper surface electrode layer on said main surface of said substrate, said first upper electrode layer having a side surface flush with respect to said side surface of said substrate;

a second upper surface electrode layer on said main surface of said substrate, said second upper surface electrode layer having a portion over said first upper surface electrode layer; and a bonding layer on said first and second upper surface electrode layers, said bonding layer having a side surface flush with respect to said side surface of said substrate, said bonding layer comprising conductive resin;

a resistor element connected with said second upper electrode layer of each of said pair of upper surface electrodes;

a protective layer covering said resistor element; and a pair of side face electrodes provided on the side surface of the substrate, each of the side face electrodes comprising a first film on the back surface and the side face of the substrate without overlaying the main surface of the substrate, said first film being formed of one of chromium film, titanium film, alloy film which contains chromium, and alloy film which contains titanium, having a bonding property against said substrate, said first film is provided on and in contact with said side surface of said first upper electrode layer and said side surface of said bonding layer.

7. The resistor according to claim 6, wherein said second upper surface electrode layers are disposed inward from said side surface of said substrate.

8. The resistor according to claim 6, wherein said resistor element contacts only said second upper surface electrode layers out of said first upper surface electrode layers, said second upper surface electrode layers, and said bonding layers.

9. The resistor according to claim 6, wherein a maximum height of said bonding layer in a thickness direction thereof is greater than a maximum height of said first upper surface electrode layer in a thickness direction thereof.

10. The resistor according to claim 6, wherein said first upper surface electrode layers of said upper surface electrodes comprise resinate of noble metal-base material.

11. The resistor according to claim 6, wherein each of said side face electrode further comprises:

a first plating film formed by nickel plating over said first film; and a second plating film over said first plating film.

12. The resistor according to claim 11, wherein each of said side face electrode further comprises a second film connected electrically to said first film, wherein said second film comprises a film of copper-nickel alloy containing copper and 1.6 wt, % or more of nickel.

13. The resistor according to claim 12, wherein said second film of said side face electrodes is shaped substantially in an L-shape over the back surface and the side face of said substrate.

* * * * *

UNITED STATES PATENT AND TRADEMARK OFFICE

CERTIFICATE OF CORRECTION

PATENT NO. : 7,057,490 B2
APPLICATION NO. : 10/362709
DATED : June 6, 2006
INVENTOR(S) : Masato Hashimoto et al.

It is certified that error appears in the above-identified patent and that said Letters Patent is hereby corrected as shown below:

Cover Page, Item (30) Foreign Application Priority Data
Add
-- March 14, 2001 (JP) 2001-72242 --
-- March 14, 2001 (JP) 2001-72243 --

Signed and Sealed this

Twenty-eighth Day of November, 2006

JON W. DUDAS
*Director of the United States Patent and Trademark Office*